US007101096B2

(12) United States Patent
Sasai et al.

(10) Patent No.: US 7,101,096 B2
(45) Date of Patent: Sep. 5, 2006

(54) TRAY FOR TRANSFERRING RECORDING MEDIA, AND RECORDING APPARATUS

(75) Inventors: Yoji Sasai, Nagano-ken (JP); Masaki Shimomura, Nagano-ken (JP); Masahiro Isono, Nagano-ken (JP); Mamoru Ukita, Nagano-ken (JP); Hiroshi Asawa, Nagano-ken (JP); Kenjiro Ishihara, Nagano-ken (JP); Koji Hashiuchi, Nagano-ken (JP); Kazuo Otsuka, Nagano-ken (JP); Hiroyuki Tajima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 201 days.

(21) Appl. No.: 09/962,544

(22) Filed: Sep. 24, 2001

(65) Prior Publication Data

US 2002/0067940 A1 Jun. 6, 2002

(30) Foreign Application Priority Data

| | | |
|---|---|---|
| Sep. 25, 2000 | (JP) | 2000-289928 |
| Oct. 20, 2000 | (JP) | 2000-321639 |
| Oct. 20, 2000 | (JP) | 2000-327014 |
| Oct. 20, 2000 | (JP) | 2000-327015 |
| Oct. 20, 2000 | (JP) | 2000-327018 |
| May 30, 2001 | (JP) | 2001-161816 |
| May 31, 2001 | (JP) | 2001-165245 |

(51) Int. Cl.
*B41J 29/00* (2006.01)
*B41J 347/104* (2006.01)

(52) U.S. Cl. ..... 400/48; 400/23; 347/104

(58) Field of Classification Search ..... 400/23, 400/29, 30, 48; 347/104
See application file for complete search history.

(56) References Cited

U.S. PATENT DOCUMENTS

| | | | |
|---|---|---|---|
| 5,797,688 | A | 8/1998 | Wen |
| 6,079,892 | A | 6/2000 | Yamaguchi et al. |

(Continued)

FOREIGN PATENT DOCUMENTS

| | | | |
|---|---|---|---|
| EP | 0 574 860 | A | 12/1993 |
| EP | 0 983 861 | A2 | 3/2000 |

(Continued)

OTHER PUBLICATIONS

Machine translation of JP 2000–173238 from Japanese Patent Office website.*

(Continued)

*Primary Examiner*—Daniel J. Colilla
(74) *Attorney, Agent, or Firm*—Stroock & Stroock & Lavan LLP

(57) ABSTRACT

A transferring tray for a printing apparatus for printing on one major surface of a recording media having disc shape, wherein the printing apparatus includes, a carriage having a printing head, reciprocating in a main scanning direction, a transferring unit transferring the recording media in a sub scanning direction, a detecting unit detecting the recording media being transferred by the transferring unit, and a recording unit printing on the one major surface of the recording media, the transferring tray including: a tray body having a rectangular plate shape made of a material which is not detected by the detecting unit; a detected portion formed on either one of two major surfaces of the tray body, being detectable by the detecting unit; and a mounting portion having a mounting recess such that the one major surface of the recording media comes up to substantially same level as one of the major surfaces of the tray body when the recording media is mounted on the transferring tray.

45 Claims, 71 Drawing Sheets

U.S. PATENT DOCUMENTS

| | | | | |
|---|---|---|---|---|
| 6,312,174 | B1 | * | 11/2001 | Drynkin et al. ..... 400/120.16 |
| 6,332,680 | B1 | | 12/2001 | Ozawa |
| 6,473,382 | B1 | | 10/2002 | Tagawa et al. |

FOREIGN PATENT DOCUMENTS

| | | | | |
|---|---|---|---|---|
| JP | 01-232078 | A | | 9/1989 |
| JP | 05-161412 | A | | 6/1993 |
| JP | 05-162412 | A | | 6/1993 |
| JP | 05301413 | A | * | 11/1993 |
| JP | 08083457 | A | * | 3/1996 |
| JP | 09040061 | A | * | 2/1997 |
| JP | 9-71335 | A | | 3/1997 |
| JP | 09095021 | A | * | 4/1997 |
| JP | 9-136741 | A | | 5/1997 |
| JP | 9-201958 | A | | 8/1997 |
| JP | 10228702 | A | * | 8/1998 |
| JP | 01-232078 | A | | 9/1998 |
| JP | 10-264467 | A | | 10/1998 |
| JP | 2000173238 | A | * | 6/2000 |
| JP | 2000-191183 | A | | 7/2000 |
| JP | 2000344377 | A | * | 12/2000 |
| JP | 2001-48371 | A | | 2/2001 |
| JP | 2001058735 | A | * | 3/2001 |
| WO | WO-97/01798 | A1 | | 1/1997 |
| WO | WO-97/11850 | A1 | | 4/1997 |
| WO | WO-99/52713 | | | 10/1999 |

OTHER PUBLICATIONS

Machine translation of JP 10–228702 from Japanese Patent Office website.*

Machine translation of JP 2001–58735 from Japanese Patent Office website.*

Machine translation of JP2000–344377 from Japanese Patent Office website.*

Office Action from Japanese Appl.2001–165245.

European Search Report dated Oct. 16, 2003, Patent Appln. No. 01 122 573.7.

Office Action dated Jan. 10, 2006, in Japanese Patent Appl. 2001–321128.

Office Action dated Jan. 10, 2006, in Japanese Patent Appln. 2001–321128.

English translation of Office Action dated Aug. 4, 2005, in Japanese patent appln. no 2001–161816.

English translation of Japanese Office Action in counterpart application publn. no. JP 2000–327014, dated Sep. 27, 2005.

* cited by examiner

FIG. 6A
FIG. 6C
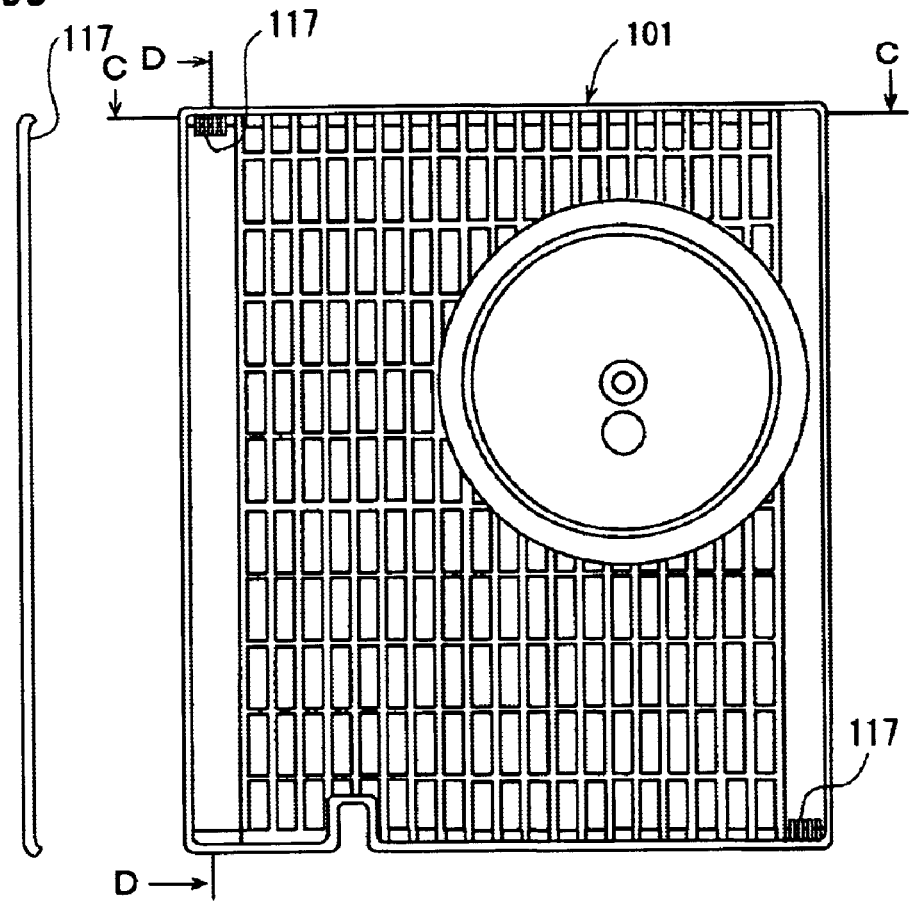
FIG. 6B
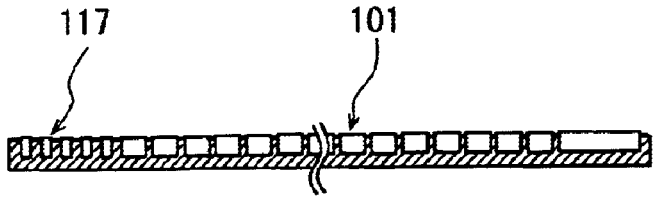

TRAY FOR TRANSFERRING RECORDING MEDIA, AND RECORDING APPARATUS

FIELD OF THE INVENTION

The present invention relates to a tray for transferring a recording medium to transfer the recording medium with a transfer mechanism in a recording apparatus and to print the recording medium when printing is performed on a label face of the circular shaped recording medium such as a CD-R using a recording apparatus such as an ink jet printer.

BACKGROUND OF THE INVENTION

Information recorded on a recording medium can be written into a predetermined area on a face opposed to a recording face of the circular shaped recording medium such as a CD-R. As an example of a recording apparatus for printing on the area, international patent application no. PCT/JP96/02833 discloses a recording apparatus in which the recording medium is set on the tray for transfer, the tray for transfer is transferred, and printing is performed. The recording medium is set in a shallow circular recess formed at a center part on a surface of the tray for transfer formed by a thin rectangular board of the tray for transfer, the tray for transfer holding the recording medium is transferred by a transfer roller, and printing is performed on the recording medium's surface using a recording head.

However, in a conventional recording apparatus, there is no mechanism for distinguishing the surface of the transfer tray from the back face of that tray, meaning that printing can be accidentally performed on the back face of the transfer tray when the surface and the back face of the transfer tray are inadvertently reversed and the transfer tray is erroneously transferred with the tray's faces in the reversed orientation.

As a result, the attendant waste causes the consumption of additional ink and such extra use causes ink to spill on the back face of the tray for transfer. The surface of the material of the rectangular transfer tray is uneven and some warping or deflection easily occurs in the tray. Recording precision diminishes due to this warping or deflection.

When the end of the transfer tray passes over the transfer roller, a driving roller abuts against the following roller, since the transfer tray is a rectangular board having a given thickness. This causes noise. Therefore, according to one aspect of the present invention, printing on a transfer tray is prevented, inferior print quality due to warping or deflection is reduced, and less noise arises as the tray is transferred by the transfer mechanism. Consequently, printing on a label face is efficiently carried out with high print quality and lower noise.

An ink jet type recording apparatus exists with a transfer tray holding a recording medium such as a CD-R. The transfer tray is inserted into a hand-feeder passage in a manner similar to an inflexible recording sheet like cardboard and the tray allows recording to be carried out on a label face of the recording medium.

The ink jet recording apparatus includes a carriage mounted on a recording head, which moves reciprocably in the main scanning direction, and a recording medium transferring mechanism for transferring the recording medium in the sub-scanning direction. The ink jet type recording apparatus records on recording paper fed from an auto feeder apparatus and also has a hand-feed passage for feeding cardboard, etc. by hand in place of the auto feeder apparatus. The ink jet type recording apparatus is capable of recording on the transfer tray that supports the recording media in the same manner as cardboard. When the transfer tray of such an ink jet type recording apparatus is inserted into the transfer passage by hand, it is difficult to determine the position of the tray accurately. Therefore, printing on the recording medium is performed at a position that is slightly off. This is because a positioning mark to be set when the transfer tray is set to an accurate position of the ink jet type recording apparatus or the transfer tray is not indicated on the ink jet type recording apparatus or the tray for transfer. Thus, recording is not carried out as expected.

For the user to set the transfer tray at the accurate position, it is necessary that the accurate position be maintained by repeatedly setting the tray, recording the accurate position in a memory, or otherwise indicating any marks.

Accordingly, the second object of the present invention is to provide a transfer tray which can easily be placed at an accurate position when a tray transferring a sheet to be recorded is loaded into an ink jet type recording apparatus.

In an ink jet type printer, paper or other recording media is fed from an auto sheet feeder or an inlet by hand and is sandwiched between a main driving paper feed roller and a follower roller. While the paper feed roller is rotating, pressure is applied to ink in a pressure generation chamber of the recording head and ink droplets are ejected from a nozzle opening causing images to be printed on the recording paper.

In the paper feed mechanism of the printer, paper is placed in the start position and the printing operation is performed with reference to this position. Therefore, it is necessary to position the leading edge of the paper with high precision. In a conventional device, the paper feed is stopped when the detected output from a light-emitted element changes in voltage according to whether or not the paper is present. By exceeding the value, the transfer of paper is stopped and the leading edge of the paper is moved forward.

FIG. 35 depicts an optical sensing element often used when the leading edge of paper precisely moves forward. A reverse V type slit is formed on the lower face of the optical sensor 722. A light-emitting diode 723 and a photo-diode 724, respectively, are provided on a slit facing each other. Light generated by the light emitted diode 723 is irradiated onto the recording paper 745, reflects off of the paper and is detected by the photo-diode 724.

FIG. 36 is a graph depicting the change in an output voltage of the photo-diode 724 when paper is fed from the left-hand to the right-hand side past the detector arrangement shown in FIG. 35. The graph shows a voltage value on the vertical axis and the amount of transferring paper counted by an optical encoder is shown on the horizontal axis.

FIG. 37A depicts the state where there is no paper and FIG. 37B shows the state where there is paper for the graph of FIG. 36. FIG. 37A shows a state prior to the transfer of the recording paper 745 to change of the optical sensor 722. That is, a state where the optical sensor 722 measures reflected light just from the structure of the paper feed passage (e.g., a paper guide board or paper feed roller). In contrast, FIG. 37B shows tho state where paper moves forward, the paper is positioned under the optical sensor 722, and the photo diode 724 receives only the light reflected from the paper.

Once the end of the recording paper 745 is within a range that can be detected by the optical sensor 722, the output voltage of the photo diode 724 goes up and exceeds a predetermined voltage value shown by the dotted line in FIG. 36 at a position depicted in FIG. 35. A count value in this case is indicated as CO.

However, it is difficult to detect the position accurately. This is because it is difficult to tell when the output of the photo diode 724 exceeds the predetermined value because that value depends on the type of paper inserted in the printer. As a result, the quality of the printed output for a particular printing medium will vary depending on the surface properties of that printing medium. Some examples of the printing media that can be used include high quality, coated, inkjet printer paper, rough surface papers, etc.

Recording papers used in conventional inkjet printers include thin paper such as standard paper or specific-use paper for high quality color printing, cardboard, and slightly thicker paper such as label paper which has adhesive material on one side. Therefore, the range of brightness by paper classification is not very large.

Recently, recording paper which is thicker than conventional cardboard has also been used in full color printing.

On the other hand, an optical disk recording medium capable of being written, such as CD-R (Compact Disk Recordable) or CD-RW (Compact Disk Rewritable), is widely used by individuals. Commercially, label printing is performed on a thin adhesive printing label.

If printing can be applied directly to an optical disk surface, it is both convenient and solves the problem arising where the label is removed.

To enable direct printing on an optical disk, a transfer tray made of polypropylene has been designed so as to hold the disk. The thickness of that transfer tray is about 2.5 mm.

There is a need to use a transfer tray to hold board paper or an optical disk in the paper feed mechanism of a printer when printing is performed on such a recording medium, it is not appropriate to use the auto sheet feeder as described, but rather, the medium is conveyed from an inlet using the hand feeder.

When such recording media are inserted into the feeder mechanism of the printer from the inlet, owing to the fact that these media may differ in thickness, problems may arise.

When the transfer tray holding the optical disk is transferred to a detection mechanism similar to the detection mechanism described in FIG. 35, 36, 37, the conditions in the printer may vary. FIG. 38 shows the relationship between the optical sensor 722 and the transfer tray 746. The transfer tray 746 is thicker than the general recording paper. Because of the thickness of the recording paper 745, light generated by the light emitted diode 723 is illuminated on the side of the transfer tray 746. Due to the influence of the beveled edge on the upper part of the transfer tray, light emitted by the light emitted diode 724 is reflected along the paper feeding passage. This reflection results in the diffusion of light, which cause a different behavior in the operation of the photo diode 724. Thus, the resulting operation of this example differs from the operation of the example shown in FIG. 36.

FIG. 39 shows a graph indicating output voltages of photo diode 724 when the transfer tray 746 is fed. Due to diffusion, output voltages increase slowly. But when the inputs are increased, accordingly the output increases in a concave manner. For example, when a transfer tray holding an optical disk is guided into the paper feed mechanism of a printer system, it is desirable to be able to control movement of the transfer tray so that the aforementioned end of the recording mechanism moves forward with precision and in a manner that does not depend on the type of recording medium used, even when the end of the recording medium is detected by using a reflection type optical sensor.

According to a third aspect of the present invention, the structure holding the recording medium can advance the end the recording medium with high precision and in a manner independent of the kind of recording medium used, even when the end of the recording medium is detected by using the reflection type optical sensor.

FIG. 40 is a perspective view showing the arrangement of an optical sensor 722 in a conventional ink jet printer, as well as aspects of the paper feed structure located inside the printer. In this example, an auto sheet feeder is attached to the printer for sending paper into the paper feed path. The structure for storage of the recording paper 745 is not shown in this example. The optical sensor 722 has detection elements as already discussed located on its bottom face. The sensor 722 is mounted between an auto sheet feeder (ASF) roller 750 driven by an ASF motor 711 and a feeder side roller 751 driven by a paper feed motor 712.

In this example, the ASF roller 750 does not start feeding recording paper 745. Thus, the recording paper is out of range for scanning with an optical sensor 722. Therefore, the optical sensor 722 detects reflected light only from the structure of the apparatus forming the paper feed path (although not shown, this includes the paper guide board or the feed side roller 751). Therefore, the output voltages in FIG. 36 represent voltages, Vn, measured when there is no paper.

The example shown in this Figure includes a photo sensor having a light-emitting diode and a photo-diode, and feeds paper along the print feed passage. In this configuration, the output voltage of the photo-diode is observed. FIG. 36 shows a diagram of the output voltage of the photo-diode 724 measured with respect to the count number, C0, and the values determining the location of paper for a particular configuration are shown in FIG. 35. In this arrangement, as shown in FIG. 36, the output voltage of the photo-diode stays at Vn, which signifies that the loaded paper is located outside of the range of the photo sensor. Once the end of the recording paper 745 is within the detection range of the optical sensor 722, the output of the sensor starts increasing with the voltage of the photo diode 724. Then, when the loaded paper is fully in range of the sensor, the voltage reaches the its highest value, V1. During this voltage change, the voltage passes a predetermined value set for determining the location of the loaded paper.

Then the paper continues feeding and the configuration changes to that shown in FIG. 41. The output voltage of the optical sensor 722 is V1 as shown in FIG. 36. The value V1 represents a voltage showing that the feed paper exists in all ranges.

In this manner, it is difficult to maintain high measuring precision. Thus, to improve the procedure, the applicant has developed a technology that more accurately moves the leading edge of paper forward at the same position even when paper having different brightness is used. (See Japanese Laid-open publication No. 9-136741). Differences in the value of a voltage between the state where there is no paper and where there is paper is all that is required to determine the position of the paper. In this prior art, the arrival of the leading edge of the paper is determined by using derivatives of particular voltage values and particular coefficients.

In the prior art, after the recording paper 745 is in the detection range of the optical sensor 722, the paper is moved forward. The recording paper 745 is then retracted from that position until the paper is not detected by the sensor.

When operating in this manner, it is inconvenient to mount the optical sensor 722 at the aforementioned position. For example, to retract the recording paper 745 from the position shown in FIG. 41 to the position shown in FIG. 40, the paper feed motor 712 must be rotated in the reverse direction and the ASF motor is synchronized to be rotated in a reverse direction, or the driving mechanism is released.

Consequently, the ASF roller 750 freewheels. After recording paper 745 separates from the feeder side roller 751, it is also necessary to retract the paper by reversing the ASF motor.

In the case where paper is supplied from the hand feeder inlet 751 another problem arises. This is because the apparatus has a mechanism to pull back additional fed paper after the recording paper 745 separates from the feed side roller 751. A separate simultaneous mechanism is required.

As described above, it is not desirable to drive two or more motors for withdrawing the paper because the operational control required for multiple motors becomes complicated.

Further, the arrangement of the optical sensor 722 may raise a problem with respect to the accuracy of the paper heading operation. As shown in FIG. 41, the actual position of the leading edge of the paper when the printing is actually performed is located ahead of a position of the recording paper 745. That is, at least the leading edge of the recording sheet 745 must be positioned ahead of the carriage 713 on which the recording head is mounted. If the position of the leading edge of the paper detected by the sensor is far from the position of the leading edge of the paper when the printing operation is actually performed, it is more likely that there may be an undesirable deviation in the paper feed or, in the worst case, a paper jam.

Accordingly a fourth object of the present invention is to perform accurately the operation of the paper feeding and reverse paper feeding as mentioned above by reviewing the placement of the optical sensor within the paper feeding path. Further, another object of the invention is to provide a technique which can achieve these operation using a motor control which is less complicated than a conventional motor control.

In addition, with printers today using several different kinds of recording paper, more accurate control has been required.

For example, in an ink jet type printer in which fine ink droplets are ejected from nozzles arranged on a recording head to record dots on a recording paper, the recording head does not contact the recording paper. A gap of approximately 0.6 mm must be left between the head and the paper.

Accordingly, so that the ink jet printer can produce dots having the desired diameter, the gap between the head and the recording paper must be kept constant even when different thicknesses of recording paper are used. For that reason, recent ink jet manufacturers have installed a mechanism for adjusting the gap between the head and the paper.

In the ink jet printer or the like, the recording paper is put on a flat plate (platen) which guides the paper while keeping the paper in a horizontal orientation, and printing is performed in a space above the platen by scanning the carriage on which the recording head is mounted. Accordingly, the gap adjustment mechanism regulates the gap between the nozzle opening and the platen, i.e., a paper gap, by moving the carriage up and down.

The recording media which the conventional ink jet printer can handle include thin paper having a thickness equal to or less than 6 mm such as normal paper, special purpose paper for high-quality color printing, and thick paper having a thickness between approximately 0.7 mm and 1.5 mm, such as an adhesive label sheet.

In order to allow direct printing onto an optical disc, a transferring tray made of polypropylene is used to hold the optical disc. The transferring tray has a thickness of approximately 2.5 mm and, therefore, a large adjustment for the paper gap is required. The printer, which is capable of printing on the optical disc, has a mechanism for manually setting the paper gap to compensate for the thickness of the transferring tray.

In the conventional apparatus, thin paper is fed by an automatic sheet feeder while thick paper is fed from a manual paper-feed slot. Thus, different kinds of paper move through different paper feed paths. Therefore, an erroneous setting of the paper hardly occurs. However, both the thick paper and the transferring tray, which can be treated as a piece of extremely thick paper, are fed through the same manual paper-feed slot. Therefore, it is likely that a user may select the incorrect paper gap.

Therefore, the fifth object of the present invention is to provide a printer which is capable of detecting an error in the gap setting, and which takes steps to resolve the problem by suggesting that the user reset the paper gap.

Generally, an ink-jet type recording apparatus is provided with a paper feed roller 1040 for feeding a recording medium P such as printing paper to a recording region 1051 where a recording head 1100 is located and a paper discharge roller 1010 is provided for discharging the paper that has been recorded in the printing region 1051. In this operation, the paper discharge roller 1010 includes a row of rollers arranged in the main scanning direction in the widthwise direction of the recording medium P at a position downstream in the sub-scanning direction of the recording region 1051 of the printing apparatus, that is, the feeding direction of the recording medium P. The paper discharge roller 1010 is made up of a paper discharge driving roller 1011 and a paper discharge following roller 1012. The paper discharge following roller 1012 may be a roller having teeth arranged on its periphery, and the teeth can be sharp and come into contact with the recording surface of the recording medium P. The roller is mounted in such a manner that the teeth are exposed both on the top and bottom, although this is not shown in FIG. 47. Further, at a position further downstream of the paper discharge roller 1010 in the sub-scanning direction, there is located a discharge roller 1060 which is rotated by the feeding force of the recording medium P. The term paper discharge following roller is used in the present description to describe the paper discharge following roller 1012 and the discharge roller 1060 shown in FIG. 47. Therefore, the paper discharge following roller represents either the paper discharge following roller 1012 and/or the discharge roller 1060.

By the way, it may occur that the ejection follower roller, which rotates as a result of contact with the recording medium, becomes slightly inclined during the transportation of the recording medium, to either the right or left from a position where the teeth are perpendicularly contact with the sheet of paper. When a change of angle (inclination) occurs, the ejection follower roller does not smoothly rotate. Therefore, the teeth of the ejection follower roller which are in contact with the recording media make fine marks or scratches on the printing surface of the recording medium, which reduces the quality of the recorded product.

Particularly, in cases where a sheet of recording media has a printing surface coated with a chemical, resin, or the like ("a coated sheet") is used as a recording medium, the printing surface of the coated sheet is so delicate that contact between the teeth and the sheet might make fine marks on the surface of the coated sheet even if the rotational direction of the ejection follower roller is parallel to the transporting direction of the recording medium (also referred to hereinafter as a "parallel position", when applicable). Accordingly, the contact of the teeth with the sheet should be prevented as much as possible.

If the teeth make contact with the coated sheet while the teeth are inclined away from a right angle, the coating layer peels slightly, forming raised areas around the aforementioned recesses (so-called "pickings"). If the pickings are formed on a high quality printing job like a picture, the quality of the final picture deteriorates.

Often, such peeling or pickings of the coating layer results from the reverse rotation of the ejection follower roller. For example, when printing on a continuous recording medium such as roll paper, a cutter, which cuts off the recording medium after printing, is placed downstream in the transporting direction from the ejection roller. In this case, it is necessary to feed back the roller paper by a certain amount upstream in the transporting direction. Accordingly, the rollers mentioned above are rotated in reverse. If any peeling or pickings are formed during the reverse rotation, this may have a large effect on the printing quality.

Furthermore, beyond the problems of peeling and pickings, depending on the purpose for the recording, it is convenient for a user to adjust the ejection follower roller such that it stays away from the surface of the recording media.

SUMMARY OF THE INVENTION

The present invention was made in view of the aformentioned drawbacks accompanying the conventional printing apparatus.

According to the first object of the present invention, printing on a tray for transfer is prevented, inferior print quality due to warp or deflection is reduced, and less noise occurs when the tray is transferred with the transfer device. Consequently, printing on the label face of a medium is efficiently carried out with high printing quality and lower noise.

A second object of the present invention is to provide a tray for transfer which can easily be placed into an accurate position when a tray transferring a sheet to be recorded is loaded into an ink jet type recording apparatus.

A third object of the present invention is to provide an initial set apparatus of the recording medium capable of stably advancing the end the recording medium with high precision independent of the kind of recording medium when the end of the recording medium is detected by using the reflection type optical sensor.

A fourth object of the present invention is to accurately perform paper feeding and reverse paper feeding as mentioned above by reviewing the position of the optical sensor within the paper feeding path.

A fifth object of the present invention is to provide a printer which is capable of detecting an erroneous gap setting made by a user and taking necessary steps to resolve the problem, such as making a suggestion to the user to reset the paper gap.

The above and other objects can be achieved by providing a transferring tray for a printing apparatus for printing on one major surface of a disc-shaped recording medium, where the printing apparatus includes a carriage having a printing head, which reciprocates in a main scanning direction, a transferring unit transferring the recording medium in a sub scanning direction, a detecting unit detecting the recording medium being transferred by the transferring unit, and a recording unit printing on the one major surface of the recording medium, which, according to the invention, includes:

a tray body having a rectangular plate shape made of a material which is not detected by the detecting unit;

a detected portion formed on either one of the two major surfaces of the tray body, this detected portion being detectable by the detecting unit; and a mounting portion having a mounting recess such that the one major surface of the recording medium comes up to substantially the same level as one of the major surfaces of the tray body when the recording medium is mounted on the transferring tray.

According to a second aspect of the invention, the tray body of the transferring tray includes rows of long grooves having plural convex portions and plural concave portions being arranged parallel to the sub scanning direction, wherein the plural convex portions on the one of the major surfaces form the respective plural concave portions on the other of the major surfaces, and each of the plural convex portions on the other of the major surfaces form the respective plural concave portions on the one of the major surfaces.

According to a third aspect of the invention, the transferring unit includes a driving roller and a following roller, and the thickness of the starting and end portions of the tray body gradually decrease toward the ends of the tray body.

According to a fourth aspect of the invention, the tray body has a hole in the mounting recess, this hole being smaller than the mounting recess, for use in removing the recording medium from the transferring tray.

According to a fifth aspect of the invention, the material of the tray body is black in color.

According to a sixth aspect of the invention, the tray body is made from piece of integrally molded plastic.

According to a seventh aspect of the invention, the objects can be achieved by providing a printing apparatus for printing on one major surface of a disc-shaped recording medium, which includes:

a carriage having a printing head, reciprocating in a main scanning direction;

a transferring unit transferring the recording medium in a sub scanning direction;

a detecting unit detecting the recording medium being transferred by the transferring unit;

a recording unit printing on the one major surface of the recording medium; and a transferring tray mounting the recording media thereon, the transferring tray including, a tray body having a rectangular plate shape which is made of a material that is not detected by the detecting unit, a portion on either one of two major surfaces of the tray body, which is detected by the detecting unit, and a mounting portion having a mounting recess such that the one major surface of the recording medium comes up to the substantially same level as one of the major surfaces of the tray body when the recording medium is mounted on the transferring tray.

According to an eighth aspect of the invention, an ejecting unit includes an ejection driving roller and an ejection follower roller, and the tray body of the transferring tray includes rows of long grooves having plural convex portions and plural concave portions being parallel to the sub scanning direction, and the plural convex portions on one of the major surfaces form the respective plural concave portions on the other of the major surfaces, each of the plural convex portions on the other of the major surfaces forming the respective plural concave portions on the one of the major surfaces, the convex portion being formed on a portion of the one of major surfaces of the tray body being in contact with the ejection follower roller, and the convex portion formed on the portion comes up to a substantially same level as the one major surface of the recording medium.

A ninth aspect of the invention provides a transferring tray for a printing apparatus for printing on one major surface of a recording medium, wherein the printing apparatus includes, a carriage having a printing head that reciprocates in a main scanning direction, a transferring unit that transfers the recording medium in a sub scanning direction, and a recording unit that prints on the one major surface of the recording medium, wherein the recording medium has a thin plate shape and is mounted on the transferring tray, the transferring tray is transferred, and the printing head prints on one major surface of the recording medium, and wherein, when the transferring tray is manually set to a predetermined position in a transferring path of the transferring unit, and the transferring tray is positioned according to an outline picture of an element of the printing apparatus drawn on the transferring tray.

According to a tenth aspect of the invention, the predetermined position is located where the outline picture, being of a size similar size to the element, overlaps with the element which hides the outline picture.

According to an eleventh aspect of the invention, the outline picture depicts the ejection follower roller of the transferring unit.

According to a twelfth aspect of the invention, the outline picture is drawn with substantially the same color as the color of the depicted element.

According to a thirteenth aspect of the invention, along with the outline picture, the transferring tray includes an arrow showing the direction for inserting the transferring tray into the printing apparatus.

According to a fourteenth aspect of the invention, the recording apparatus further includes a detecting unit which detects the recording medium being transferred by the transferring unit, and where the transferring tray is made of a material which is not detected by the detecting unit while the transferring tray further has a detectable portion on either one of two major surfaces of the tray body, being detectable by the detecting unit.

According to a fifteenth aspect of the invention, the transferring tray further includes a mounting portion having a mounting recess such that the one major surface of the recording medium comes up to substantially the same level as one of the major surfaces of the tray body when the recording medium is mounted on the transferring tray, and there is a detaching hole in the mounting recess which is smaller than the mounting recess.

According to a sixteenth aspect of the invention, the transferring tray further includes a first stopper making contact with the carriage when the printing head is closer to one of the major surfaces of the transferring tray than the predetermined distance, which prevents the printing head from scanning over the transferring tray.

According to a seventeenth aspect of the invention, the transferring tray further includes a second stopper making contact with the carriage which prevents the printing head from scanning over the transferring tray when the transferring tray is inserted into the printing apparatus in a direction other than a predetermined direction, irrespective of the distance between the printing head and the transferring tray, wherein the second stopper is positioned not to make contact with the carriage when the transferring tray is inserted into the printing apparatus in the predetermined direction and the printing head prints on the one major surface of the recording medium.

According to an eighteenth aspect of the invention, the recording apparatus further includes a starting end detecting unit having a lever which is biased to return to a standing orientation, this lever being pivoted so that it can protrude into the transferring path and be rotatable in the sub scanning direction, for detecting a starting end of the recording medium, and wherein the transferring tray further includes a protective portion having a shape such that the transferring tray is drawn out from the transferring path without rotating the lever in reverse after the transferring tray is inserted into the transferring path of the transferring unit while the one major surface faces the printing head.

According to a nineteenth aspect of the invention, the transferring tray is transferred as the recording medium, and the printing head prints on the one major surface of the recording medium having the plate shape.

According to a twentieth aspect of the invention, the printing apparatus further includes a detecting unit detecting the recording medium being transferred by the transferring unit, and wherein the transferring tray further comprises:

a tray body having a rectangular plate shape made of a material which is not detected by the detecting unit;

a region on either of the two major surfaces of the tray body which is detectable by the detecting unit; and a mounting portion having a mounting recess such that the one major surface of the recording medium comes up to substantially the same level as one of the major surfaces of the tray body when the recording medium is mounted on the transferring tray.

According to a twenty-first aspect of the invention, the tray body of the transferring tray includes a row of long grooves having plural convex portions and plural concave portions being arranged parallel to the sub scanning direction, and wherein the plural convex portions on one of the major surfaces form the respective plural concave portions on the other of the major surfaces, each of the plural convex portions on the other of the major surfaces forming the respective plural concave portions on one of the major surfaces.

According to a twenty-second aspect of the invention, the transferring unit includes a driving roller and a following roller, and the starting and end portions of the tray body gradually decrease in thickness toward an end of the tray body.

According to a twenty-third aspect of the invention, the tray body has a hole in the mounting recess for removing the recording medium from the transferring tray, which is smaller than the mounting recess.

According to a twenty-fourth aspect of the invention, the tray body is made of material that is black in color.

According to a twenty-fifth aspect of the invention, the tray body is made of plastic material formed in a single body.

According to a twenty-sixth aspect of the invention, the printing apparatus further contains a detecting unit that detects a recording medium which is transferred by the transferring unit, wherein the transferring tray further includes:

a tray body having a rectangular plate shape made of a material which is not detected by the detecting unit;

a detectable portion that is detected by the detecting unit; and the tray body has a mounting groove, on which the recording medium can be mounted so that a printing face of the recording medium is positioned at substantially the same plane as the plane of the recording medium mounting side when the recording medium is mounted.

According to a twenty-seventh aspect of the invention, the printing apparatus further includes:

an ejection unit having an ejection driving roller and an ejection follower roller having teeth; wherein:

the tray body has grooves on both sides of the tray body in the direction parallel to the sub scanning direction along which the transferring tray is transferred so that the tray body has a plurality of convex face regions and a plurality of concave face regions; and the grooves are formed such that one side of the back face of the convex face region becomes the concave face region, and one side of back face of the concave region becomes the convex face region, and a region that contacts the ejection following roller becomes the convex face region, and the convex face and a printing face of the recording media mounted on the convex face lie in substantially the same plane.

According to a twenty-eighth aspect of the invention, the printing apparatus records an image for one scan onto a recording medium by main scanning a printing head at a predetermined printing position in the sub scanning direction and records an image on one piece of a recording medium by performing a sub scanning while transferring the recording medium in the sub scanning direction after the end of the main scanning and repeating the main scanning and the sub scanning one after another; and the transferring unit is provided at both the upstream side of the printing position and the down stream side of the printing position along the sub scanning direction, and the transferring unit has first and second paper sending rollers that hold and transfer the recording medium, and the transferring unit can transfer the recording medium in either the upstream direction or the downstream direction of the sub scanning direction; and the printing apparatus further comprises:

a paper feeding unit provided on the upstream side of the sub scanning direction in the printing apparatus;

a detecting part provided at a position where the optical axis to be detected is positioned further downstream than the holding position of the second paper sending roller and second follower roller is provided at downstream side of the printing position; the detecting part outputting a voltage according to a reflected light amount of the object at the position and detecting the object by judging whether the detected voltage surpasses a predetermined threshold value (T0) at a default condition;

a recording unit for recording the value of the detected voltage detected by the detecting part; and a transferring control unit for transferring the recording medium for a predetermined distance downstream in the sub scanning direction so that the detection part can detect a tip of the recording medium; recording a detected voltage (T1) detected by the detecting part at the transferring position and at the same time transferring the recording medium to the upstream side in the sub scanning direction by the transferring unit; recording a detected voltage (T2) detected by the detecting part when there is no recording medium on the recording unit; calculating an average value (T0Vp) of the detected voltage (T1) and the detected voltage (T2); transferring the recording medium to the downstream side in the sub scanning direction by the transferring unit after modifying a predetermined threshold value for detecting the existence of the object to the average value (T0Vp) calculated from the default threshold value (T0); and setting the recording medium to an initial position referring to a point where the voltage detected by the detecting part reaches the average value (T0Vp).

According to a twenty-ninth aspect of the invention, the printing apparatus further comprises:

a second detection part provided at a position more upstream than the holding position of the first paper sending roller and first follower roller that is upstream of the printing position, which detects the presence of the recording medium at the position; and a third detection part provided at a position between the second detecting part and the paper feeding unit in the sub scanning direction, which detects the presence of the recording medium at the position According to a thirtieth aspect of the invention, the printing apparatus further comprises:

an initial setting unit for the recording medium, the initial setting unit includes the transferring unit, which can transfer the recording medium upstream and downstream of the transferring passage, an optical sensor, a recording unit, and a calculating unit; wherein:

the optical sensor changes an output voltage according to the object;

the recording unit stores the predetermined voltage value, which is previously determined;

the transferring unit transfers the recording medium for a predetermined distance from the time when the output voltage value of the optical sensor exceeds the predetermined voltage value while transferring the recording medium so that the object of the optical sensor becomes the recording medium only;

the recording unit records an output voltage value of the optical sensor in the condition as a first measurement value;

the transferring unit further transfers the recording medium in the reverse direction toward the downstream side of the transferring passage in order to remove the recording medium from an area that can be detected by the optical sensor;

the recording unit records an output voltage value of the optical sensor in the condition as a second measurement value;

the calculation unit calculates an average value of the first measurement value and the second measurement value; and the transferring unit transfers the recording medium on the upstream side of the transferring passage and transfers the recording medium for a predetermined amount referring to a position which is to be an average value calculated by the calculation to perform initial setting of the recording medium.

According to a thirty-first aspect of the invention, the optical sensor has a light-emitting element and a light-receiving element, and the optical sensor detects an existence of the object by catching reflected light that is emitted from the light-emitting element which is then reflected off of an object with the light-receiving element.

According to a thirty-second aspect of the invention, the transferring tray, on which an optical disc is mounted, can be moved inside the paper passage of the printing apparatus by the transferring unit.

According to a thirty-third aspect of the invention, the transferring unit comprises a structure for shifting the recording medium by driving a motor with motor driving control unit; and the printing apparatus further comprising an optical sensor; and the printing apparatus performing both forward and backward shifting of the recording medium, which is entered into the detection range of the optical sensor, using a structure for shifting the recording medium; and detecting a light amount at the forward shifted position and the backward shifted position of the recording medium; and controlling shifting of the recording medium with the motor driving control unit based on the detection results; and a structure for shifting the recording medium including a roller driven by the motor; and the optical sensor is arranged closer to the recording medium ejection side than a position of a structure that performs the shifting of the recording medium in the recording medium passage of the printer apparatus.

According to a thirty-fourth aspect of the invention, the transferring unit comprises a structure for sending the recording medium by driving a motor with a motor driving control unit; and the printing apparatus further contains an optical sensor; and the printing apparatus sends the recording medium forward and backward, shifting the recording medium into the detection range of the optical sensor, using a structure for shifting the recording medium and detecting a light amount at the forward shifted position and the backward shifted position of the recording medium and controlling a sending of the recording medium with the motor driving control unit based on the detection results; and a structure for shifting the recording medium, which includes a roller driven by the motor and a notched roller that is pushed against the roller, the notched roller holding the recording medium together with the roller and shifting the recording medium; and an optical axis of the optical sensor is closer to the recording medium ejection side than a center position of the notched roller in the recording medium passage.

According to a thirty-fifth aspect of the invention, the transferring unit comprises a structure for shifting the recording medium by driving a motor with motor driving control unit; and the printing apparatus further comprising an optical sensor; and the printing apparatus performing forward and backward shifting of the recording medium, which enters into the detection range of the optical sensor; and detecting a light amount at the forward shifted position and the backward shifted position of the recording medium; and controlling the movement of the recording medium with the motor driving control unit based on the detection results; and a structure for shifting the recording medium which includes a roller driven by the motor and a plurality of notched rollers which are pushed against the roller, the notched rollers holding the recording medium together with the roller and shifting the recording medium; and the optical sensor is arranged between the plurality of notched rollers in the paper width direction of the recording medium.

According to a thirty-sixth aspect of the invention, the printing apparatus is a printer for performing printing by scanning a printing head; and a structure for shifting the recording medium that includes two rollers, which are driven synchronously by the same motor through a power transmission mechanism; and the scanning operation of the printing head is performed at the position between the two rollers in the recording medium passage.

According to a thirty-seventh aspect of the invention, the printing apparatus performs a printing operation by driving a shifting motor of the recording medium with a motor driving control unit that shifts the recording medium in a sub scanning direction and that drives a carriage motor to move a carriage, on which the printing head is mounted, in a main scanning direction; and the motor driving control unit has:

a current detecting unit for detecting the consumption current value of the carriage motor;

a judging unit for judging the type of the recording medium installed in the printing apparatus by obtaining information about a detected current value; and the judging unit determines that the recording medium has experienced a failure when the consumption current value detected by the current detecting unit exceeds a predetermined value during the process when the consumption current value of the carriage motor is detected while the recording medium is shifted along a main scanning direction, along which the carriage moves, by a shifting motor of the recording medium and moves the carriage to a predetermined position on the recording media.

According to a thirty-eighth aspect of the invention, the printing apparatus moves the transferring tray, which has the thin-plate shaped recording medium mounted on it, in a recording medium passage of the printing apparatus with a shifting motor; and the printing apparatus has a gap adjusting unit for setting the size of the gap between the printing head and a platen by moving the carriage up and down according to the type of the recording medium; and a convex part, which has a predetermined height relative to a height of the printing head, is provided on the carriage; and the convex part contacts a side face of edge of the recording medium when the carriage scans in the condition where the recording medium, which has a thickness larger than the thickness of the type of the recording medium set by the gap adjusting unit, is positioned under the main scanning line.

According to a thirty-ninth aspect of the invention, the motor driving control unit stops driving of the motor when the judging unit determines that the recording medium has experienced a failure.

According to a fortieth aspect of the invention, the printing apparatus further comprises:

a screen display unit that can rewrite information, which is to be displayed in a screen, desirably by a display control unit; and the display control unit controls the screen display unit such that the screen display unit displays information for suggesting resetting the gap adjusting unit to the size of the gap that is appropriate for the recording medium mounted in the printer when the judging unit determines that the recording medium has a failure.

BRIEF DESCRIPTION OF THE DRAWINGS

1B is a side cross sectional view taken along line A–B shown in FIG. 1A.

FIG. 5A is a top plan view of the tray's surface, FIG. 5B is a side elevational view.

FIGS. 6A to 6C show the tray for transfer according to the present invention. FIG. 6A is a plan view of the tray's back face. FIG. 6B is a front cross sectional view of taken along line C—C. FIG. 6C is a cross sectional view taken along line D—D.

DETAILED DESCRIPTION OF THE INVENTION

The present invention will now be described with reference to the preferred embodiments, which do not limit the scope of the present invention, but only exemplify the invention. All of the features and the combinations thereof described in the preferred embodiments are not necessarily essential to the invention.

Figure 1A:
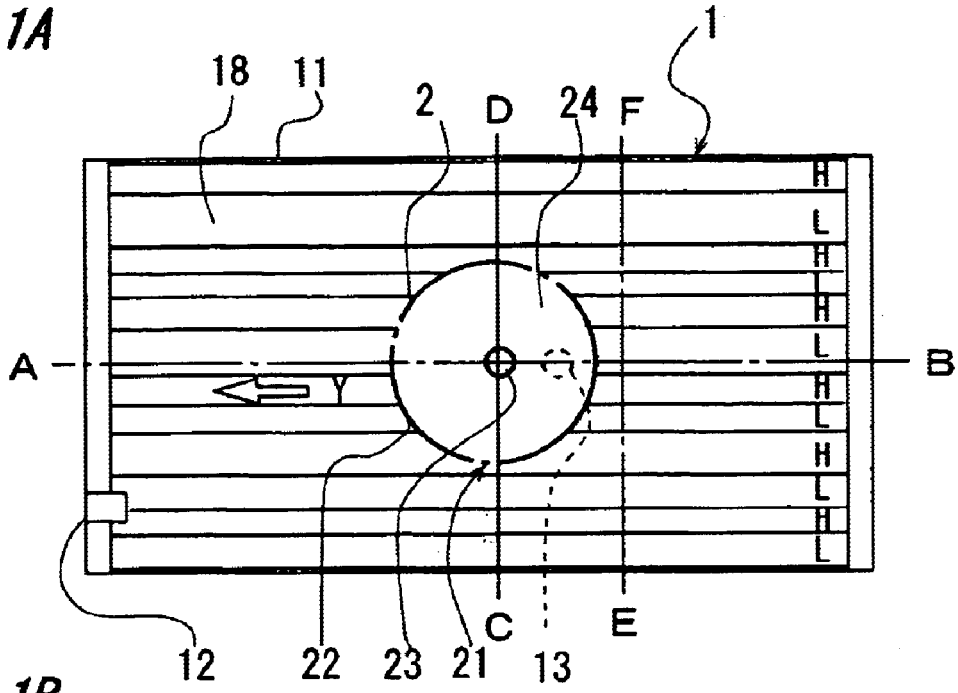
FIG. 1A is a top plan view of a tray for transferring a recording medium according to the present invention. FIG.
Figure 1B:
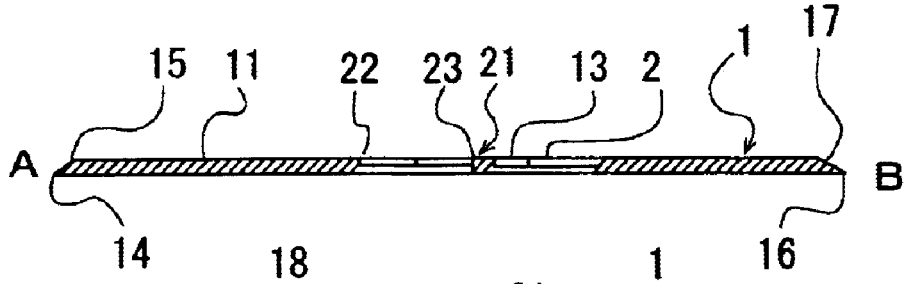
FIG. 1C is a front cross sectional view showing the transferring tray according to the invention taken along line C–D of FIG. 1A.
FIG. 1D is a front cross sectional view taken along line F–E of FIG. 1A.
Figure 1C:
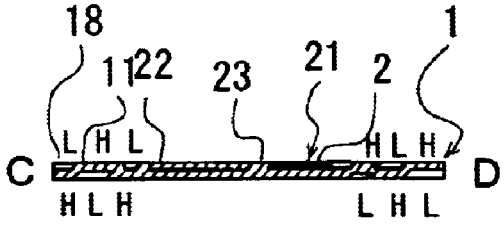
Figure 1D:
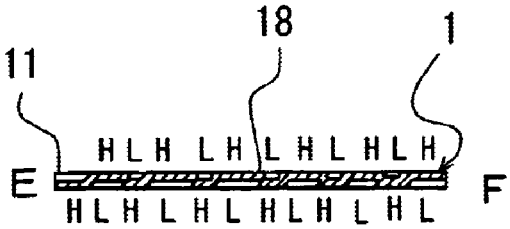

FIG. 1A is a plan view of a tray for transmitting according to the present invention. FIG. 1B is a cross sectional view of taken along line A–B shown in FIG. 1A. FIG. 1D is a cross sectional view of taken along line F–E of FIG. 1A. A construction of a tray for transmission 1 will be explained with reference to FIG. 1B.

The tray for transfer 1 is made up of a tray body 11 with a rectangular shape and a part to be detected 12. A fitting part or receptacle 21 having a circular groove 23 that in size is substantially equivalent to the outer edge of a recording medium 2 and a fixing part 23, which is a circular convex part, fitted to a hole at a center of the recording medium 2 is located almost at the center. The recording medium 2 is set to the fitting part 21. The recording medium 2 is fitted to the fixing part 23 and is set to the tray body 11. When the recording medium 2 is set into the fitting part 21, the depth of the circular groove 22 is set to a depth such that the height of a printing face of the recording medium 2 is almost equal to the height of a flat face for the tray body 11. As a result, the tray for transfer 1, into which the recording medium 2 is set, can be transferred and printing can be applied to a label face 24 of the recording medium 2. It is possible that the recording medium 2 can be fitted into the circular groove 22 and fixed without the fixing part 23 of the fitting part 21. However, in order to set the recording medium 2 into the tray for transfer 1 with high precision it is further preferable that the fixing part 23 be provided and the fixing part 23 is fitted to the hole at the center. The circular groove 22 has a hole 13 for facilitating removal of the recording medium. After the recording medium 2 is set into the fitting part 21 and printing onto the label face 24 of the recording medium 2 has finished, it is easy to remove the recording medium 2 from the fixing part 23 by pushing the recording medium 2 up from the back side of the fitting part 21 through the hole 13 as the recording medium 2 is being removed from the fitting part 21. Therefore, the efficiency of printing on the label face 24 of the recording medium 2 is improved.

As shown in FIG. 1B, the shape of the end 14 of the tray body 11 where a start point of transfer and a also the shape at the end 15 are such that the thickness of the tray body 11 continuously decreases approaching each end of the tray body 11. A shape between an end 16 of the tray body 11 where a terminal point of transfer and a portion around the end 17 is a shape such as a shape of the end 14 and the portion 15. As a result, noise, which occurs when the tray 1 is transferred, can be reduced. This will be described in greater detail in connection with the relationship of the tray 1 to a recording apparatus 50.

The tray 11 is made of a black plastic material and can be integrally formed with a plurality of long grooves 18 on both faces of the tray 11 so that a plurality of convex shaped areas H and a plurality of recess shaped areas L are arranged parallel to the sub scanning direction. Each of the cross sectional views of FIGS. 1C and 1D show the layout of the grooves 18. The grooves 18 are formed so that the opposite side of each of the convex shaped areas H on one face is a recess shaped area L and the opposite side of each recess shaped area L on one face side is a convex shaped area H. This way, the rigidity of the tray body 11 to resist warp or deflection is high Further, inferior print quality caused by warp or deflection of the tray 1 can be avoided.

Figure 2:
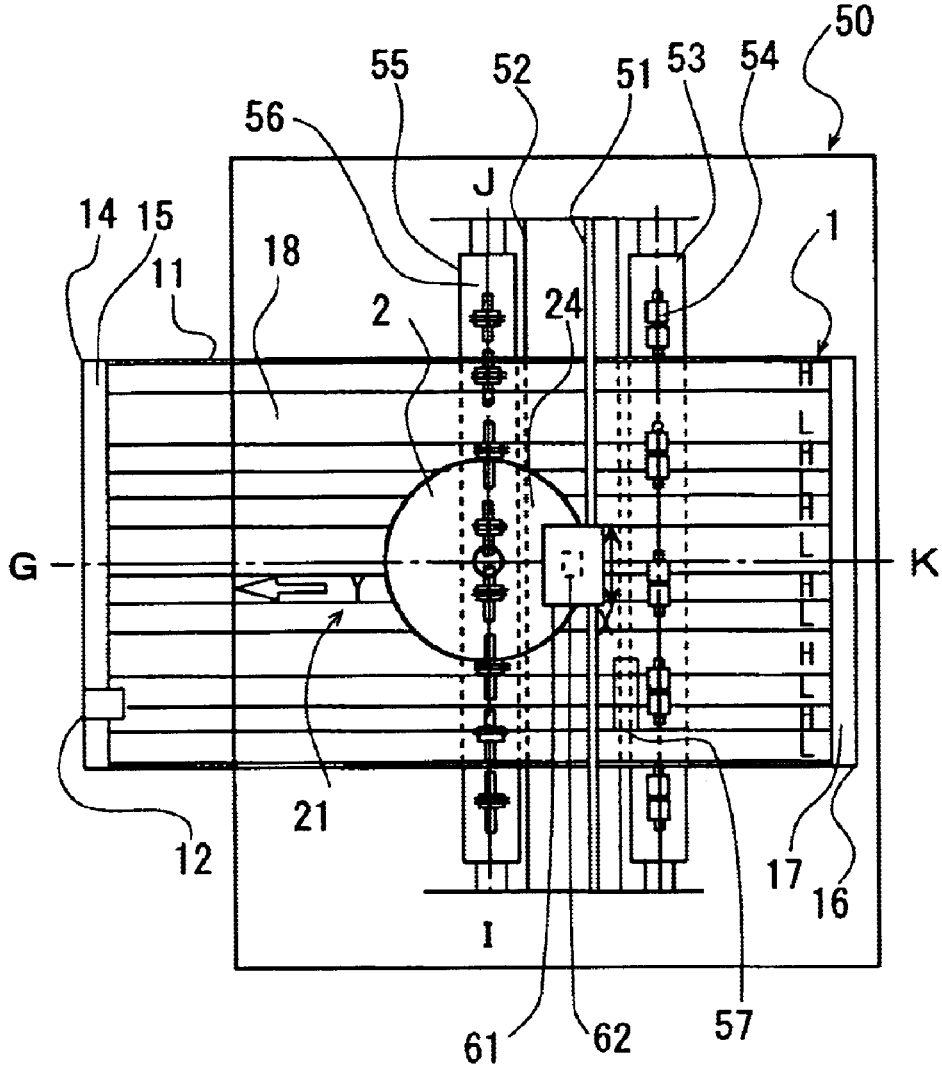
FIG. 2 is a top plan view showing the transferring tray relative to the recording apparatus according to the present invention.

FIG. 2 is a top plan view showing tray 1 in relation to the recording apparatus 50 according to the present invention. A carriage 61, supported by a carriage guide axis 51, for moving in a main scanning direction X, and a platen 52 are provided in the recording apparatus 50. A recording head 62 ejecting ink on the recording material is mounted on the carriage 61. The printing task is carried out by ejecting ink from the recording head 62 while the carriage 61 is transferred in the main scanning direction X and, in the sub scanning direction Y, the material to be recorded is transferred between the carriage 61 and the platen 52. A transfer driving roller 53 and a transfer following roller 54 are provided as a recording sheet transfer mechanism for transferring the material to be recorded in the sub scanning direction Y. The roller 53 is rotationally controlled by applying a rotational driving force using a device such as a stepping motor and the sheet to be recorded is transferred in the sub scanning direction by rotation of the roller 53. The roller 54 is preferably made up of several individual rollers, and each of those rollers is forced against the roller 53. When the material to be recorded is transferred by rotation of the roller, the roller 54 is in contact with the material to be recorded and rotated in accordance with transfer of the material to be recorded.

On the other hand, a discharge driving roller 55 and a discharge sub roller 56 are provided as a mechanism for discharging the printed sheet to be recorded. The roller 55 is rotationally controlled by a source of rotation driving force such as the stepping motor. The sheet to be recorded is shifted in the sub scanning direction Y. The roller 56 is also can be made up of several smaller rollers and each has teeth on the edge. The roller 56 is a roller with sharp teeth arranged so that the tip of each tooth is in contact with a point on the printing screen of the sheet to be recorded. Each of the rollers 56 is forced against the roller 55 with less force than the force exerted by the roller 54. When the sheet to be recorded is shifted by the rotation of roller 55, the roller 56 is contacted with the sheet to be recorded and rotated in accordance with the shifting of the sheet to be recorded. A detecting mechanism for the material to be recorded 57 for detecting an end of the material to be recorded is provided in the recording apparatus 50. The detecting mechanism 57 detects a transfer position of the material to be recorded in the sub scanning direction Y. The printing on a predetermined position is then performed. In FIG. 2, the material to be recorded is the tray 1, however, a feeding mechanism including a feeding tray and a feeding roller (not shown) are provided in the recording apparatus 50. This way, printing on recording paper can be performed. Recording paper such as normal paper or photo paper can be used as the material to be recorded.

The tray 1 onto which the recording media 2 is set is used as the material to be recorded. In the recording apparatus 50 like the above constitution, the relation of the tray 1 to the recording apparatus 50 when the printing task on the label face 24 of the recording media 2 is performed will be described in FIG. 3.

In the present embodiment, light is emitted by the light-producing element onto the material to be recorded. The detecting mechanism 57 detects the material to be recorded by detecting the reflected light. The tray 11 is formed from black plastic material and can be integrally formed. The detecting mechanism 57 does not detect the material to be recorded because tray 11 is black in color, which color has a low light reflection ratio. In contract, the part to be detected 12, which is located around the end 15 of the face of the tray 11, has a high reflection ratio and can be detected by the detecting mechanism 57.

By designing the tray 1 in this manner, the only part to be detected 12 of the tray 1 is detected by the detecting mechanism 57 as the material to be recorded. In the case where it is erroneously intended to print on the back side of the tray 1, the tray 1 is not detected by the detecting mechanism 57 and printing is not performed. This way, it is possible to prevent erroneous printing on the tray 1 itself and to efficiently print on the label face 24 of the recording medium 2.

Figure 3A:
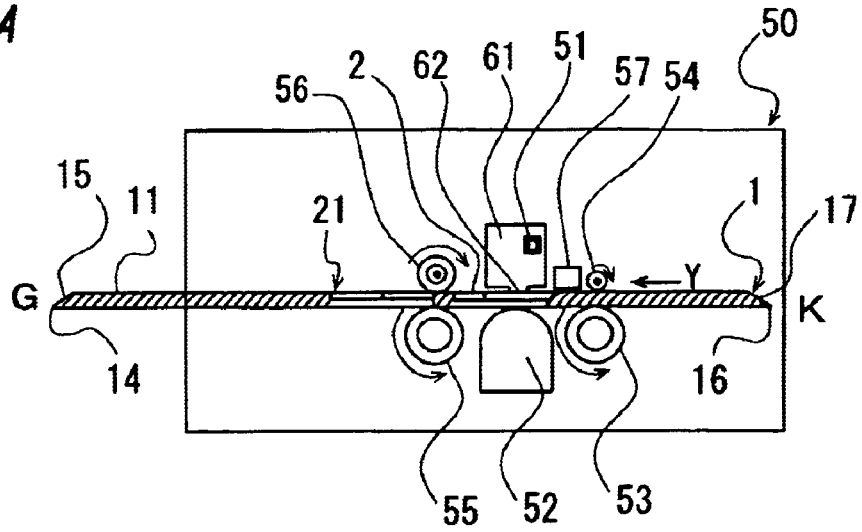
FIG. 3A is a side cross sectional view taken along line K–G in FIG. 2 showing the transferring tray 1 relative to the recording apparatus.

FIG. 3A is a cross sectional view taken along line K–G in FIG. 2 showing the tray 1 in relation to the recording apparatus 50.

The end 14 of the tray 11 which is the start point for transfer of the tray 1 is sandwiched between roller 55 and roller 56 so that roller 56 is pushed up.

The thickness of the tray body 11 decreases toward the end 15. The load applied to the roller 54 and the roller 56 decreases when the tray 1 is sandwiched therebetween so that the tray 1 gradually pushes up the roller 54 and the roller 56. As a result, it becomes possible to transfer the tray 1 more smoothly.

After printing on the label face 24 of the recording medium 2, the end 16 of the tray body 11, which is the terminal point of transfer of the tray 1, is passed from between the roller 53 and the roller 54 forced against the roller 53 and then passes from between the roller 55 and the roller 56 forced against the roller 55. The tray 1 is then discharged from the recording apparatus 50. When the tray 1 is passed from between the roller 53 and the roller 54 forced against the roller 53 and further passed from between the roller 55 and the roller 56 pressed against the roller 55, noise, which occurs because of the contact of the roller 53 to the roller 54 and contact of the roller 55 to the roller 56, is reduced. Consequently, printing can be performed with less noise.

Figure 3B:
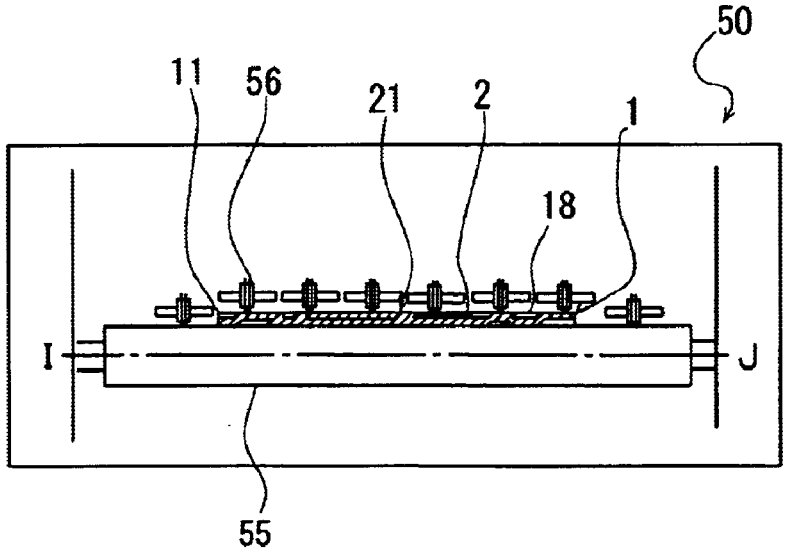
FIG. 3B is a front cross sectional view taken along a line J–I shown in FIG. 2, which shows the tray relative to the recording apparatus.

FIG. 3B is a cross sectional view taken along a line J–I shown in FIG. 2, which shows the tray 1 in relation to the recording apparatus 50. In a case where the long groove 18 of the tray body 11 is formed so that each roller passing on the recording medium 2 among the multiple rollers 54, and contacts the recess shaped area L; the roller is mounted over the recording medium 2 when the roller is passed on the recording medium 2. The recording medium 2 is set into the fitting part 21 of the tray 1. The recess shaped area L is formed by the long groove 18 at the side of the fitting face to which the recording medium 2 is set in the tray body 11. The recording medium 2 is tilted by mounting over the roller and this leads to inferior print quality, or the recording medium 2 is hooked over the teeth of the roller with teeth in the case where the roller has teeth and so there is the probability that the roller 56 will be broken. To prevent this, as shown in FIG. 3B, the long groove 18 of the tray body 11 is formed so that each roller passing on the recording medium 2 among the multiple rollers 56 and the rollers 54 is in contact with the recess shaped area L; the roller is mounted over the recording medium 2 when the roller rolls on the recording medium 2. Consequently, it is possible to print with high precision.

The tray 1 in the present embodiment can print on the label face 24 of the recording medium efficiently, with high quality, and low noise.

In another embodiment, tray 1 is formed without the plurality of long grooves 18 on the tray body 11. In still another embodiment, although the manufacturing cost of the tray body 11 can be reduced by omitting the grooves 18 from the tray body 11, the rigidity resisting warp or deflection of the tray body 11 is reduced. Therefore, it is preferable to use a material in which little warp or deflection of the tray body 11 occurs.

Further, as another embodiment, it is possible to use the recording apparatus 50 without the tray 1 according to the present invention. Of course, it is possible to implement the present invention even with the roller 56 in the recording apparatus 50 being a following roller besides a roller with teeth. The tray body 11 is integrally formed and is made from black plastic material and can also be formed from other material such as bristol board, or in several separate pieces. Further, the color of the tray body 11 is not limited to black.

According to the present invention, it is possible to prevent erroneous printing on the tray, to avoid a reduction in print quality caused by warp or deflection of the tray 1, and printing on the label face of the recording medium can be carried out efficiently, with high print quality, and low noise. All this results from using the tray for transfer described herein, and so noise caused when the tray 1 is transferred is reduced.

Next, another embodiment of the present invention will be described. In this present embodiment, all or just some of the aspects of the invention shown in FIGS. 1 to 3 may be provided.

Figure 4:
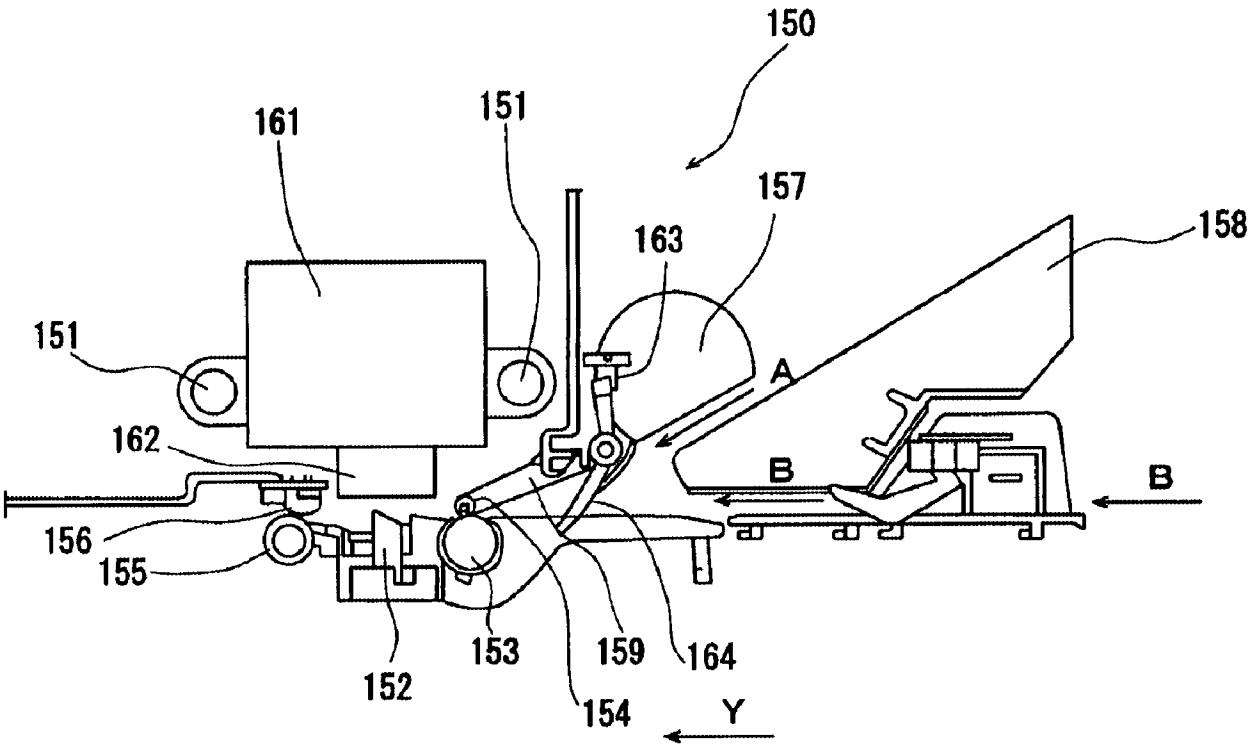
FIG. 4 is a side elevational view showing a main part of an ink jet typed recording apparatus capable of transferring a tray for holding a material to be recorded.

FIG. 4 is a side view showing a main part of an ink jet type recording apparatus having a construction which can transfer a tray for transfer a material to be recorded.

An ink jet type recording apparatus 150 has a carriage 161, supported by two carriage guide shafts 151, for moving in a main scanning direction as a recording mechanism records on the material. A recording head 162, mounted on carriage 161, ejects ink onto the recording medium.

A platen 152 that determines the gap is provided. The platen 152 faces the recording head 162 and the gap is located between a face of the recording head 162 and the material to be recorded. Printing is carried out by ejecting ink from the recording head 162 while the carriage 161 is transferred in the main scanning direction and, in the sub scanning direction Y and the material to be recorded is transferred between the carriage 161 and the platen 152.

This arrangement includes a sheet feeder tray 158 capable of feeding material to be recorded, such as normal paper or photo paper, and the tray 158 has an auto sheet feeder (ASF) to automatically feed the sheet to be recorded. The ASF is an auto sheet mechanism having a sheet feeder roller 157 provided to the sheet feeder tray 158 and a separating element (not shown). The roller 157 is rotationally controlled by applying rotational driving force from a driver such as a stepping motor and has a cross sectional face shaped like a "D". When multiple sheets to be recorded on the tray 158 are fed by the rotational driving force of the roller 157 and friction resistance of the separating element, the multiple sheets are not fed at once and a single sheet is automatically fed accurately.

The sheet to be recorded with a predetermined volume is intermittently transferred toward the downstream of the sub scanning direction Y by a recording sheet transfer means. The sheet is automatically fed by the ASF in the direction shown by the arrow labeled "A". The recording sheet transfer mechanism is located downstream of the sub scanning direction Y from the roller 157. The downstream portion in the sub scanning direction Y is the side to be recorded.

A transfer driving roller 153 and a transfer following roller 154 are provided as the recording sheet transfer mechanism for transferring the sheet to be recorded in the sub scanning direction Y. The transfer driving roller 153 is rotationally controlled by a stepping motor and a sheet to be recorded is transferred in the sub scanning direction by rotation of the roller 153. A carriage 161, supported by a carriage guide axis 151, for moving in a main scanning direction X, and a platen 152 are provided in the recording apparatus 150. The roller 154 is supported by a transfer following roller holder 159 of multiple and each holder 159 is forced to the roller 153. When the sheet to be recorded is transferred by rotation of the roller 153, the roller 154 is rotated following transfer of the sheet to be recorded while the roller 154 maintains contact with the sheet to be recorded.

A sheet detector 163 which can be of the type known in the prior art is located between the roller 157 and the roller 153. The sheet detector 163 has a lever 164 that is self-biased so that it returns to a given position and the lever 164 is supported in a state where the lever 164 projects into a transfer passage of the sheet to be recorded so that the lever 164 can be rotated only in the recording sheet transfer direction. The sheet detector 163 is designed so that the lever 164 is rotated by pushing a tip of the lever 164, thereby the sheet to be recorded is detected. The sheet detector 163 detects a start end position and a terminal position of the sheet to be recorded fed by the roller 157. The recording area is determined based on the detected position and recording is carried out.

On the other hand, a discharge driving roller 155 and a discharge sub roller 156 are provided as a mechanism for discharging the recorded sheet. The roller 155 is rotationally controlled by the stepping motor and, by rotation of the roller 155, and the sheet to be recorded is sent out in the sub scanning direction Y. The roller 156 has a plurality of teeth arranged around its edge. The roller 156 is a roller with teeth in acute shape so that a tip of each tooth is contacted at a point on the recording face of the sheet to be recorded. Each of the roller 156 of multiple is forced to the roller 155. When the sheet to be recorded is sent out by rotation of roller 155, the roller 156 is contacted with the sheet to be recorded and rotated accordance with sent out the sheet to be recorded.

The recording apparatus 150 has a sheet feeder passage shown with the arrow labeled "B" for feeding the sheet to be recorded or the tray for transfer of the present invention other than the sheet feeder passage by the ASF as described above (the passage is shown by the arrow A). The recording sheet made from material such as bristol board has low flexibility.

The recording apparatus 150 is designed so that recording on the recording sheet fed from the sheet feeder passage can be carried out in a similar manner to sheets that were fed from the ASF.

When a transfer tray 101 is set to a predetermined position, the tray for transfer 101 is inserted into the sheet feeder passage to be set to the predetermined position in a state where the roller 154 is separate from the roller 153. The recording apparatus 150 has a transfer following roller release mechanism (not shown) for changing to the separating state and for recovering a state where the roller 154 is forced against roller 153*d*. after the tray 101 is set to the predetermined position.

Figure 5A:
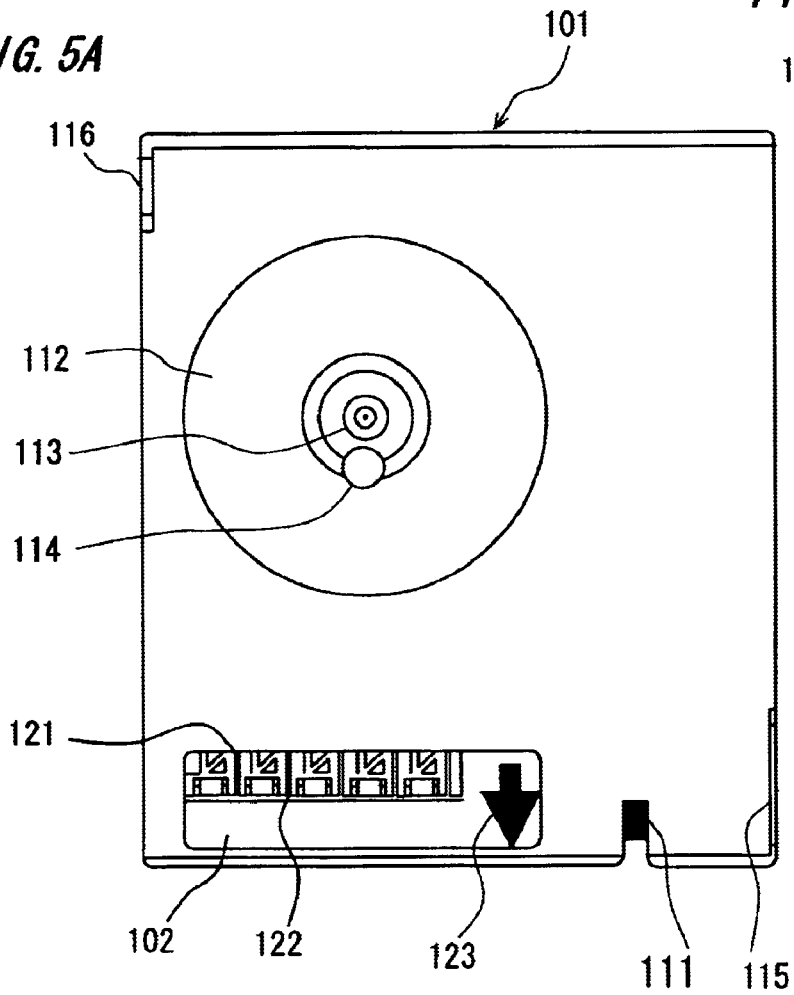
FIGS. 5A and 5B show a tray for transfer according to the present invention.
Figure 5B:
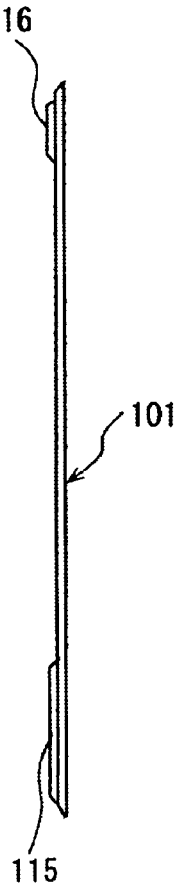
Figure 5C:
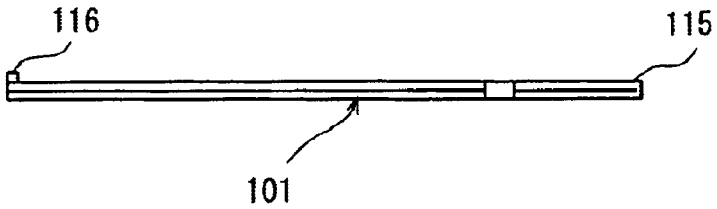
FIG. 5C is a front elevational view.

FIGS. 5A and 5B show a tray for transfer according to the present invention. FIG. 5A is a flat view of the surface, FIG. 5B is a side view, and FIG. 5C is a front view.

The tray for transfer 101 is a rectangular thin plate made of a resin substance such as plastic by injection formation. In the present embodiment, the tray 101 is made of the resin member, which is black in color and cannot be detected with an optical sensor. A part to be detected 111 is designed to have a high optical reflection ratio and can be detected by the sensor that detects the tray for transfer. It is designed so that a stack of thin sheets to be recorded set on the tray for transfer can be recognized by detecting the part to be detected 111 with the sensor.

A circular groove 112 is formed on a surface of the tray 101 and a convex part 113 around center of the circular groove 112. A thin typed sheet to be recorded such as a CD-R is set to the circular groove 112. A hole 114 to take off the sheet as shown in FIGS. 5A and 5B is formed on the circular groove 112. It is possible to easily take off the sheet by pushing up the CD-R from the back side of the tray 101 through the hole 114 when the sheet to be recorded set to the circular groove 112 is taken off.

A first stopper 115 and a second stopper 116 are formed on a surface of the tray 101 as shown in the figure drawing. The stopper 115 and the stopper 116 will be described later.

A label 102 is stuck on a surface of the tray 101. An outline 121, a guide line 122 and an arrow 123 are displayed on the label 102. The outline 121 is designed to represent the roller 154 and the holder in an actual size. The outline 121 becomes marked when the tray 101 is inserted into the sheet feeder passage and is set to the predetermined position to be set. The tray 101 can accurately and easily be set to the predetermined position by inserting the tray 101 into the sheet feeder passage and matching the outline 121 with the roller 154 and the holder 159. The task of matching the outline 121 with the roller 154 and the holder 159 becomes easier by overlaying the roller face of the roller 154 on the guide line 122.

An arrow 123 shows the direction that the tray 101 should be inserted into the sheet feeder passage. Since a direction inserting the tray into the sheet feeder passage is shown, the probability of inserting the tray 101 in an erroneous direction is reduced.

The outline 121, the guide line 122, and the arrow 123 are not displayed by sticking the label 102 as the present embodiment. The printing task may be performed on the tray 101. The guide line 122 may not be provided. The outline 121 is not limited to the roller 154 and the holder 159. The outline 121 may represent any suitable element that is part of the recording apparatus 150. The outline 121 is easily recognized if the outline 121 is colored as the almost same color as color of constitution element of the recording apparatus 150 shown by the outline 121.

FIGS. 6A to 6C shows the tray for transfer 101 according to the present invention. FIG. 6A is a plan view of the back face. FIG. 6B is a cross sectional view along line C—C. FIG. 6C is a cross sectional view along line D—D.

A plurality of ribs are respectively formed in a vertical direction and a horizontal direction on a back face of the tray 101. Because the ribs can reduce warp or deflection of the tray 101, sufficient strength and precision can be obtained.

A protection part of mechanism detecting sheet start end 117 is formed on the tray. The protection part 117 forms an inclined surface with a plurality of ribs shown in the drawing. After the front face and the back face of the tray 101 reverse and the tray 101 is inserted, the inclined surface is formed at a step portion where the lever 164 of the sheet detector 163 slides when the tray 101 is pulled out. In the present embodiment, the inclined surface is formed at the step portion of the rib formed at an end of the tray 101.

Due to the slanted face, after the front face and the back face of the tray 101 reverse and the tray 101 is inserted, the lever 164 of the sheet detector 163 is caught at the step portion of the rib formed at the end of the tray 101 when the tray 101 is pulled out. This prevents rotation of the lever 164 in a direction opposed to a rotatable direction due to the lever's one-way catch. Thereby, the probability of breaking the lever 164 can be reduced. Since the protection part 117 is formed at centered position with respect to a substantially proximal point of the tray 101 as center of symmetry 101, it can be kept from catching on the lever 164 at the step portion without relation of direction inserting the tray 101.

Figure 7:
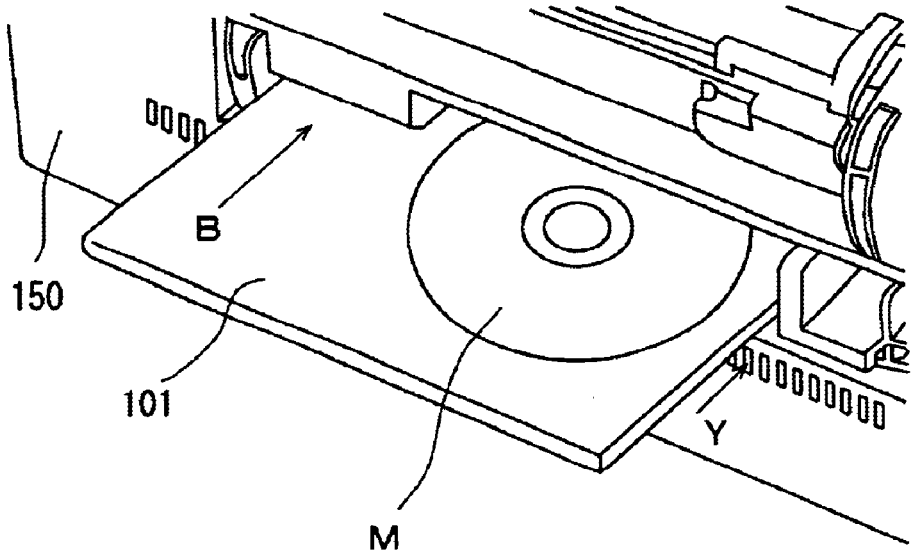
FIG. 7 is a perspective view showing a state where the tray for transfer of the present invention is inserted into a sheet feeder passage provided at the back side of the ink jet type recording apparatus.

FIG. 7 is a perspective view showing a state where the tray for transfer 101 of the present invention is inserted from a sheet feeder passage provided at the back side of the ink jet typed recording apparatus 150.

In a state where a CD-R (depicted at Letter M) as a thin typed sheet to be recorded is set to the tray 101, the tray 101 is inserted into the sheet feeder passage and is set to a predetermined position.

Figure 8:
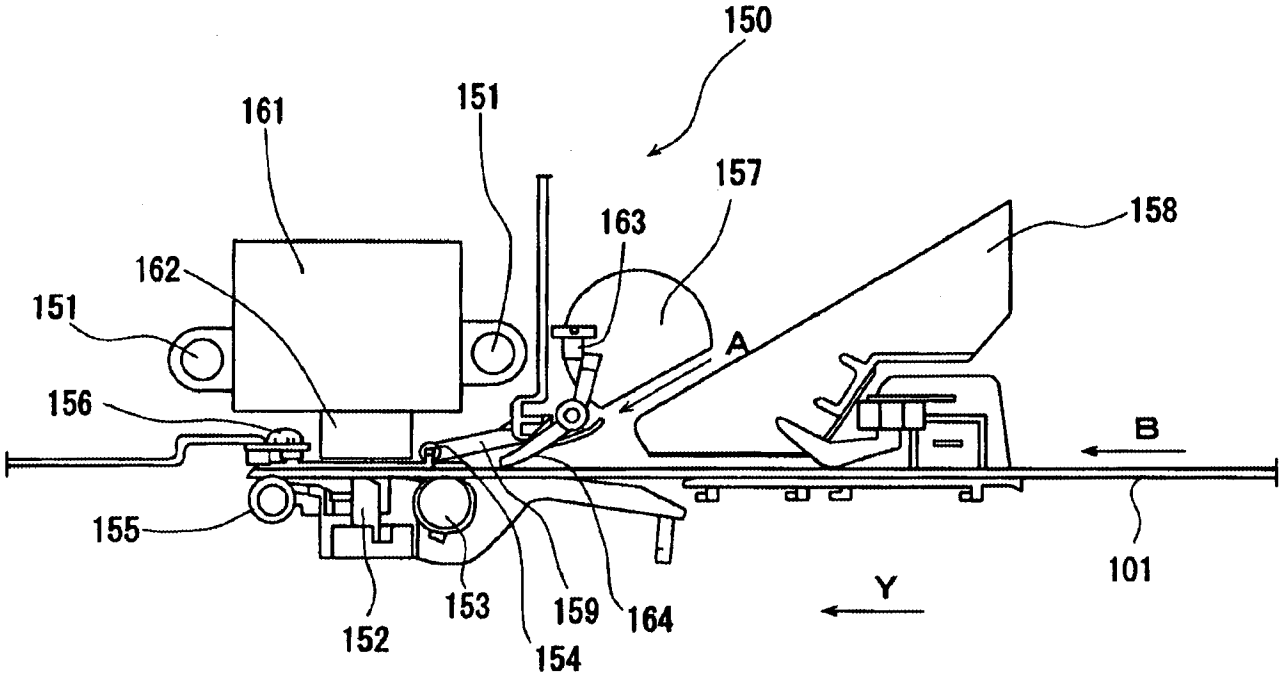
FIG. 8 is a perspective view showing a main part of a state where the tray for transfer of the present invention is inserted into a sheet feeder passage provided at the back side of the ink jet type recording apparatus.

FIG. 8 is a perspective view showing a main part of a state where the tray for transfer 101 of the present invention is inserted from a sheet feeder passage provided at the back side of the ink jet typed recording apparatus 150.

The tray 101 is inserted into the sheet feeder passage according to the arrow direction shown with the letter B and is set to a predetermined position. A distal portion of the tray 101 rotates the lever 164 of the sheet detector 163 projecting into the transfer passage. The tray 101 is transferred in the sub scanning direction similar to the recording paper by rotation of the roller 153 in the sub scanning direction Y in a state where the tray 101 is pushed on by a force of roller 154. Ink is jetted from the recording head 162 mounted on the carriage 161 reciprocating in the main scanning direction while the CD-R set to the tray 101 is intermittently transferred in the sub scanning direction Y. The printing task is performed on the surface.

When the printing task on the CD-R is performed, two carriage guide shafts 151 are moved upward and downward.

The carriage 151 is arranged at an upper position because of the thickness of the tray 101 so that a gap between the surface of the CD-R and the head face becomes appropriate for the thickness of the material being recorded upon by a mechanism (not shown) to adjust the size of the gap between a head face of the recording head 162 and a recording face of the sheet to be recorded. The roller 156 does not make contact with the sheet to be recorded during a discharge following roller release mechanism (not shown) because roller 156 is at a high position to prevent damage to the surface of the CD-R by the sharp teeth of the roller 156.

Figure 9:
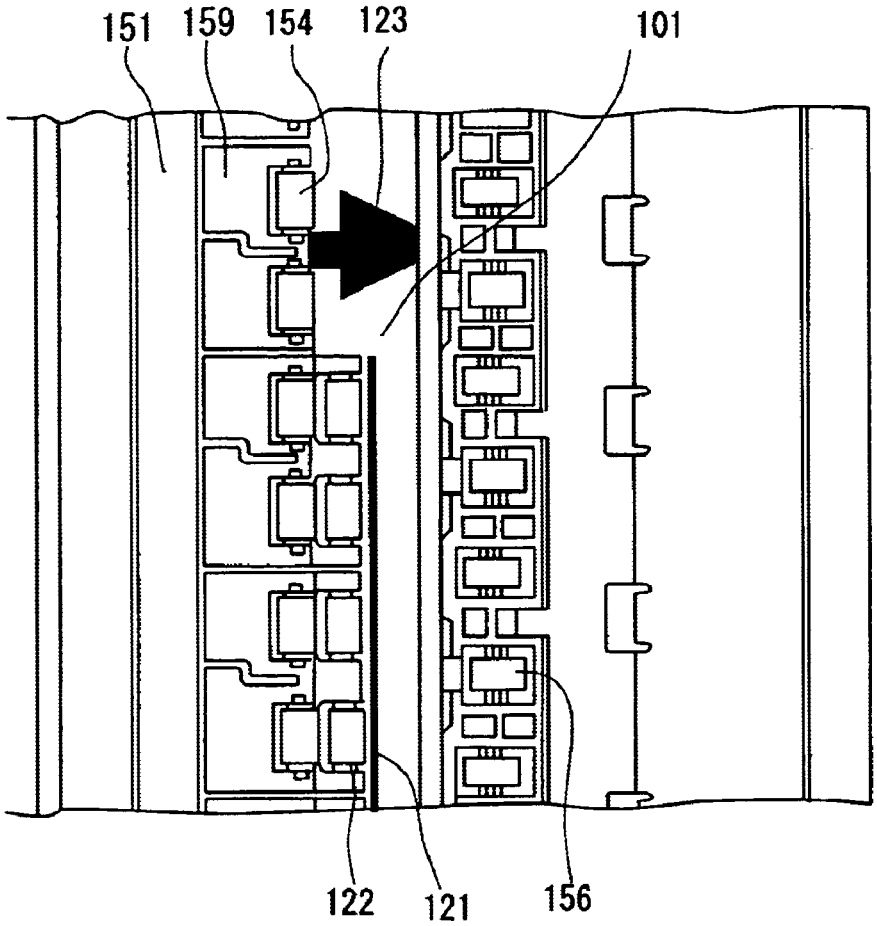
FIG. 9 is a top plan view showing a state before the tray for transfer is set to a predetermined position that is used when the tray for transfer according to the present invention is inserted into the sheet feeder passage of the ink jet type recording apparatus.
Figure 10:
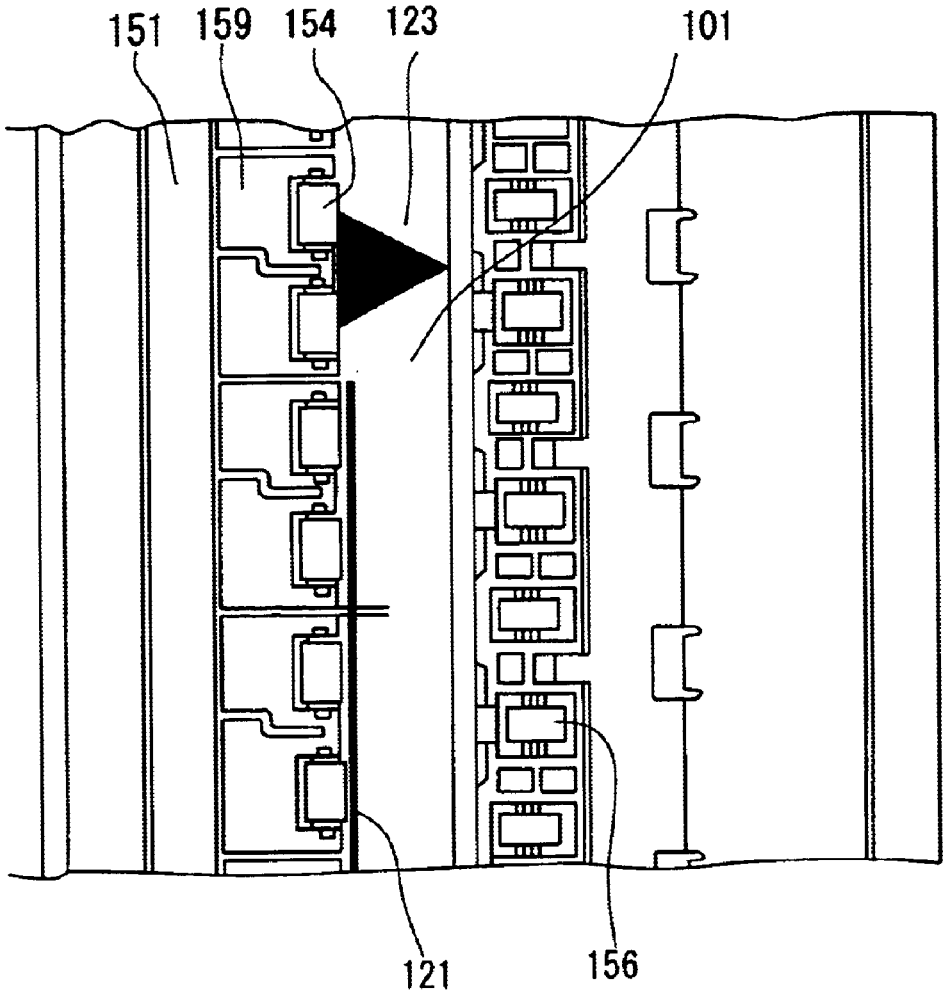
FIG. 10 is a top plan view showing a state after the tray for transfer is set to a predetermined position that is used when the tray for transfer according to the present invention is inserted into the sheet feeder passage of the ink jet type recording apparatus.

FIG. 9 is a plan view showing a state before the tray for transfer is set to a predetermined position to be set after the tray for transfer is inserted into the sheet feeder passage of the ink jet type recording apparatus. FIG. 10 is a plan view showing a state after the tray for transfer is set to a predetermined position to be set after the tray for transfer is inserted into the sheet feeder passage of the ink jet typed recording apparatus.

The tray 101 is inserted into the sheet feeder passage in a direction shown with the arrow 123 as shown in FIG. 9. The position of the outline 121, the position of the roller 154 and the position of the holder 159 are confirmed respectively. The outline 121, the roller 154 and the holder 159 are aligned as shown in FIG. 10. The tray 101 can easily be set to an accurate position by matching the guide line 122 with a roller face of the roller 154.

Figure 11:
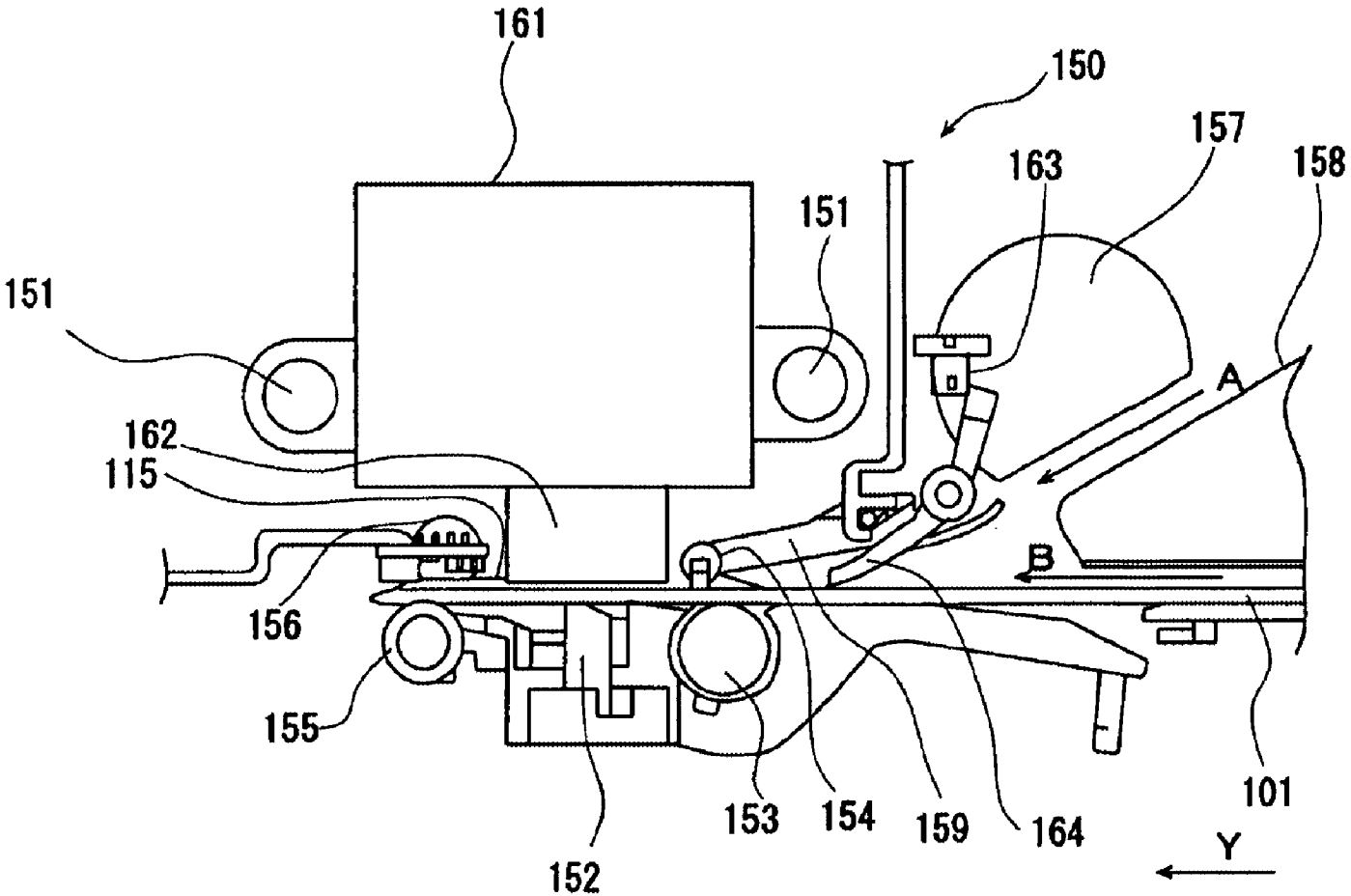
FIG. 11 is a side elevational view of a main part of a recording apparatus showing a state where the recording head contacts with the first stopper of the tray for transfer according to the present invention.

FIG. 11 is a side view of a main part showing a state where the recording head 162 makes contact with the first stopper 115 of the tray for transfer 101 according to the present invention.

When printing is performed on a CD-R, the carriage 151 is arranged at an upper position for thickness of the tray 101 so that the paper gap (PG) between the surface of the CD-R and the head face becomes appropriate in view of the recording medium thickness by the mechanism moving two carriage guide shafts 151 to upper and lower directions.

As aforementioned, when the printing task on the CD-R has been performed regardless of whether the gap is incorrect set, there is the probability that this causes inferior print quality or the recording head 162 to become dirty due to ink stains. In some cases, there is the probability that contact between the head face and the surface of the tray 101 causes the tray 101 to be stained or the head face to be damaged.

The stopper.115 is formed on the tray 101 to prevent the printing task from executing if the carriage 151 is not in the upper position.

when the gap between the surface of the CD-R and the head face is below a predetermined PG, the side face of the recording head makes contact with the stopper 115. The recording head 162 is prevented from scanning the tray 101. Since there is a probability that the recording head 162 is damaged in a case where the stopper 115 directly makes contact with the recording head 162, it is preferable that a wall to protect the recording head 162 is formed on the carriage 161 and the wall is makes contact with the stopper 115.

The discharge following roller release mechanism arranging the roller 156 at the upper position is designed so as to operate together with the mechanism moving two carriage guide shafts 151 to upper and lower directions, to prevent the sharp teeth of the roller 156 from damaging the surface of the CD-R. Therefore, it is also possible to prevent the contact of the roller 156 from causing damage to the screen face of the CD-R by the stopper 115.

When the tray 101 is inserted from a direction that is different from the predetermined direction, that is, when an erroneous insertion is made, the stopper 116 prevents the recording head 162 from scanning on the tray 101 without regard to the gap that is set.

Similar to the stopper 115, the side face of the recording head 162 is kept from contacting the stopper 116 and the recording head 162 is scanned on the tray 101. Therefore, the stopper 116 is formed so as to have a higher height than the height of the stopper 115.

Figure 12:
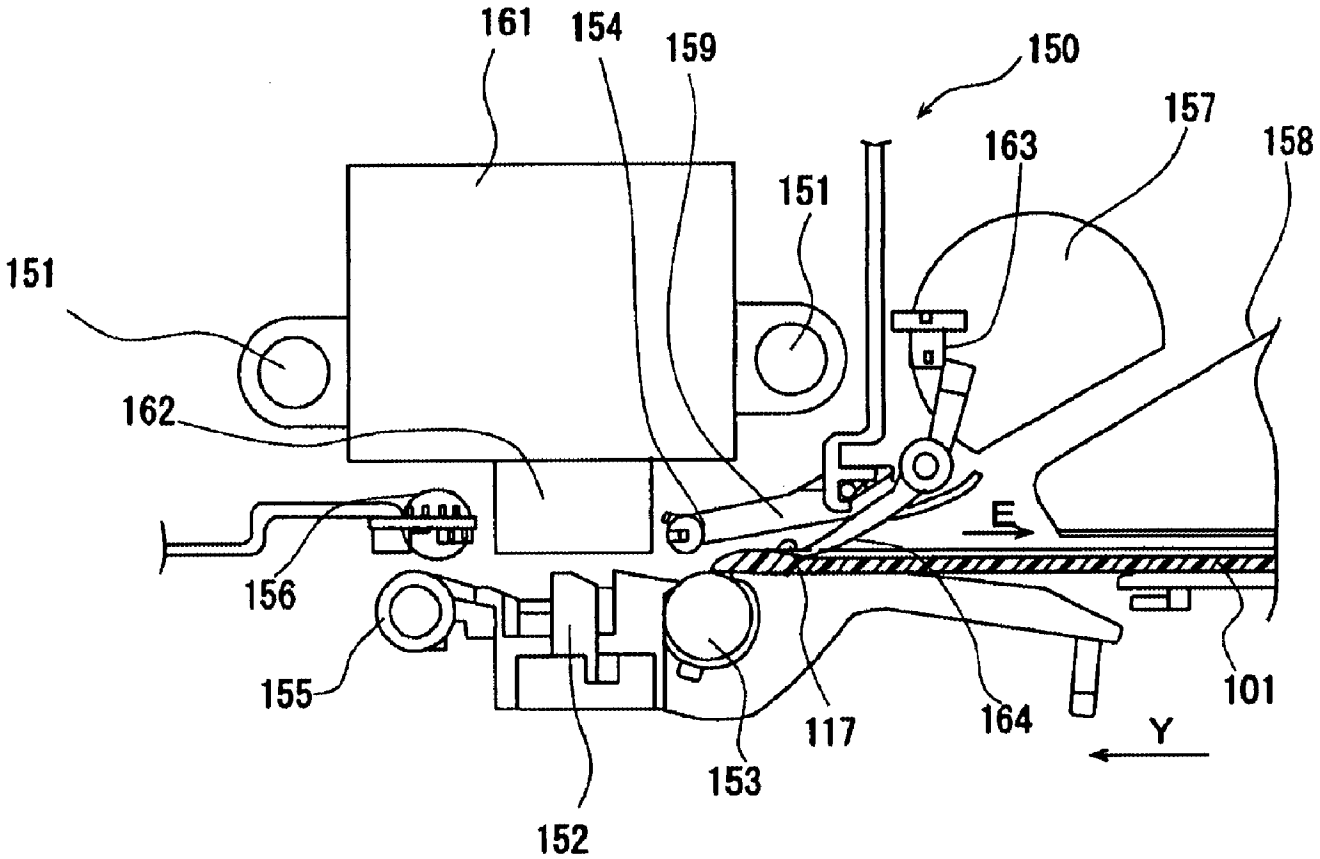
FIG. 12 is a side elevational view of a main part showing a state where the lever is in contact with the protection part of a mechanism detecting the sheet start end of the tray for transfer according to the present invention.

FIG. 12 is a side view of a main part showing a state where the lever 164 is making contact with the protection part of the mechanism detecting the sheet start end 117 of the tray for transfer 101 according to the present invention.

As aforementioned, the protection 117 forms the inclined surface at the step portion of the rib formed at an end of the tray 101. Due to the inclined surface, after the front face and the back face of the tray 101 reverse and the tray 101 is inserted, the lever 164 of the sheet detector 163 can be prevented from catching at the step portion of the rib formed at the end of the tray 101 when the tray 101 is pulled out in a direction shown with the arrow labeled E. The lever's catch prevents the lever 164 from rotating in a direction opposed to a rotatable direction. As a result, the probability of breaking the lever 164 is reduced.

As another embodiment, a shape of the circular groove 112 is a shape so that, for example, an IC card can be set. Thereby, it is also possible to print on a surface of the IC card. Further, the sheet to be recorded is not limited to the CD-R or IC card.

It becomes possible to print on various sheets to be recorded by changing the shape of the circular groove 112 so that a thin typed sheet to be printed can be set.

According to the present invention, it is possible easily set the transfer tray to an accurate position to be set when the tray transferring the sheet to be recorded is set to an ink jet typed recording apparatus.

Next, further another embodiment of the present invention will be described. In the present embodiment, when the tray for transfer, as aforementioned, is manually set to a predetermined position in the passage transferring the sheet to be recorded using the mechanism for transferring the material to be recorded, the tray for transfer is set to the position to be set based on the outer contour-design of the constitution element in the recording apparatus displayed on the tray for transfer.

Figure 13:
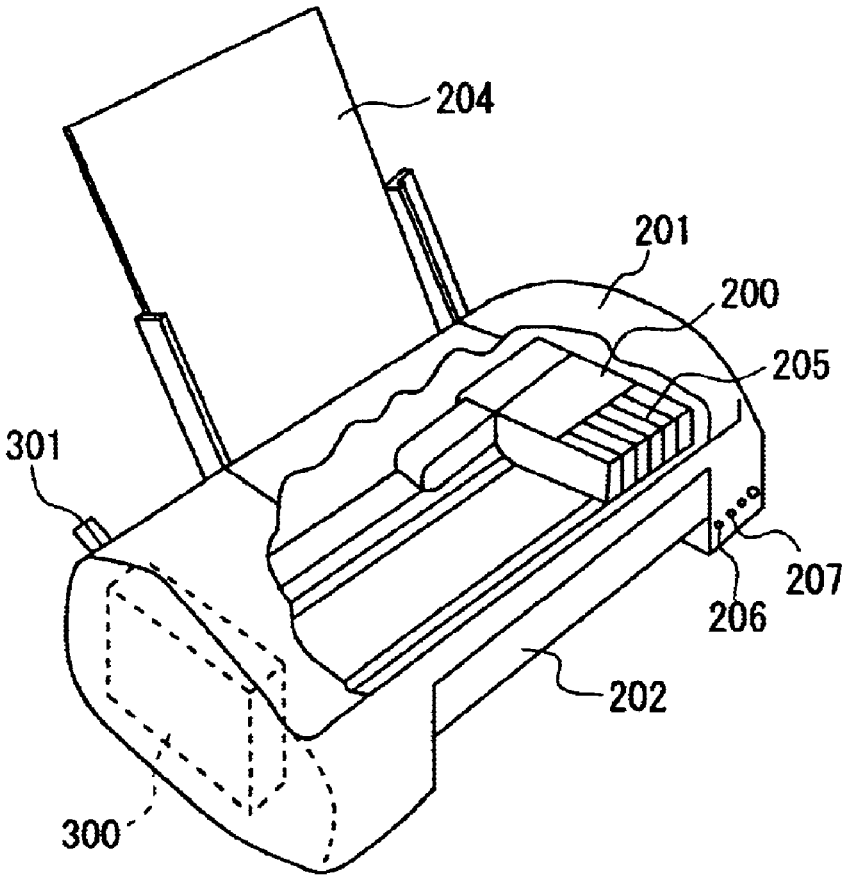
FIG. 13 is a perspective view showing an ink jet type printer to which the present invention is applied, seen from the front.
Figure 14:
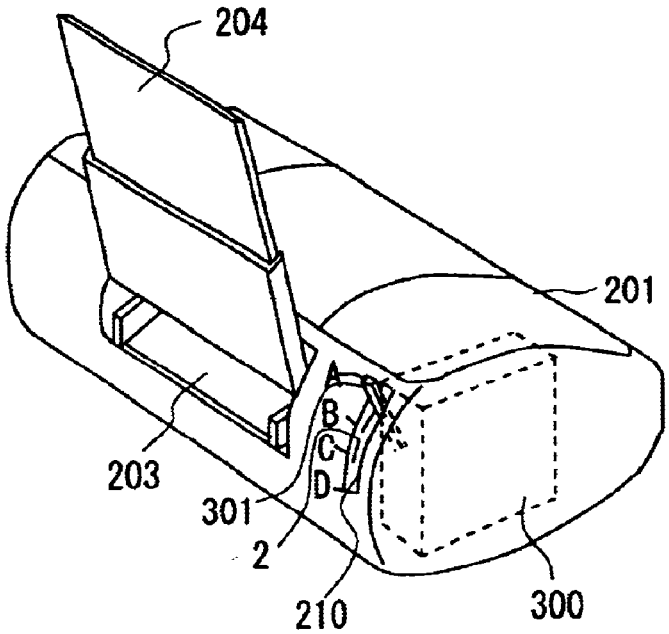
FIG. 14 is a perspective view showing an ink jet type printer to which the present invention is applied, seen from the back.

In an ink jet typed printer shown in FIGS. 13 and 14, within the body 201 is an ink jet typed recording head 200, a carriage mechanism (not shown), an auto feeder (not shown), a sheet feeder mechanism by hand, and a sheet transfer mechanism including a mechanism initially setting record sheet etc. as characterization of the present invention. A discharge outlet 202 is provided on a front face of the body 201 and a feeder inlet 203 by hand is provided on a back face of the body 201. A tray for the auto feeder 204 is provided at the upper side of the inlet 203 of the back face. An adjust lever 301 is placed at the side of the inlet 203 which projects from the body 201. The adjustment lever 301 is used to switch the paper gap according to the thickness of the recording medium and separates the center point for the roller transferring paper of the following roller.

Recording paper fed to the tray 204 is automatically transferred by, for example, the auto sheet feeder and recording paper is sandwiched at the center point of a driving roller or transferring paper roller (not shown) or a following roller (not shown), and is further transferred and then discharged from the outlet 202. Recording paper fed to the inlet 203 by hand is sandwiched at the center point of the driving roller and the following roller, is transferred and is discharged from the outlet 202 similar to recording paper fed to the tray 204.

Plain paper, special purpose paper, recommended OHP sheet, glossy print paper, coated paper, coated film, label sheet, and a post card can be used as recording paper fed from the tray 204. Cardboard and extremely thick cardboard (this category includes the tray for holding data discs like CR-R's), that is, difficult-to-bend sheets besides the above each paper can be used as recording paper fed by hand.

The adjust lever 301 slides in increments along a slit 210 in the direction shown by the arrow. The slit 210 is linearly oriented to the body 201. It is possible to switch the paper gap and to separate the center point for the transferring paper roller of the following roller. Switching of the paper gap adjusts the ink jet typed recording head 200 so that a distance between the paper face and a nozzle opening face of an ink jet typed recording head 200, that is, the paper gap is almost constant to keep printing precise despite varied thicknesses of the recording paper.

Separation of the following roller is effected by applying pressure to the following roller to push the following roller to the roller transferring paper or to release the pressure for separating the following roller from the driving roller in order that recording paper is sandwiched between the driving roller and the following roller or the recording paper is pulled out from between the driving roller and the following roller. The adjustment lever 301 to adjust these mechanisms in multiple stages is reciprocably movable in the direction of the arrow shown and a position can be determined at positions A, B, C, and D in stages. When the adjustment lever 301 is at position A, this is the setting to use when printing on recording paper with normal thickness, that is, plain paper. When the adjustment lever 301 is at position B, this is the setting to use when printing on recording paper with a slightly greater thickness, that is, cardboard. When the adjustment lever 301 is at position C, this is the setting to use when printing on recording paper with which is extremely thick, that is, extremely thick cardboard including the tray for information recording disk. When the adjustment lever 301 is at position D, the roller 302 is separated from the roller 303.

Figure 15:
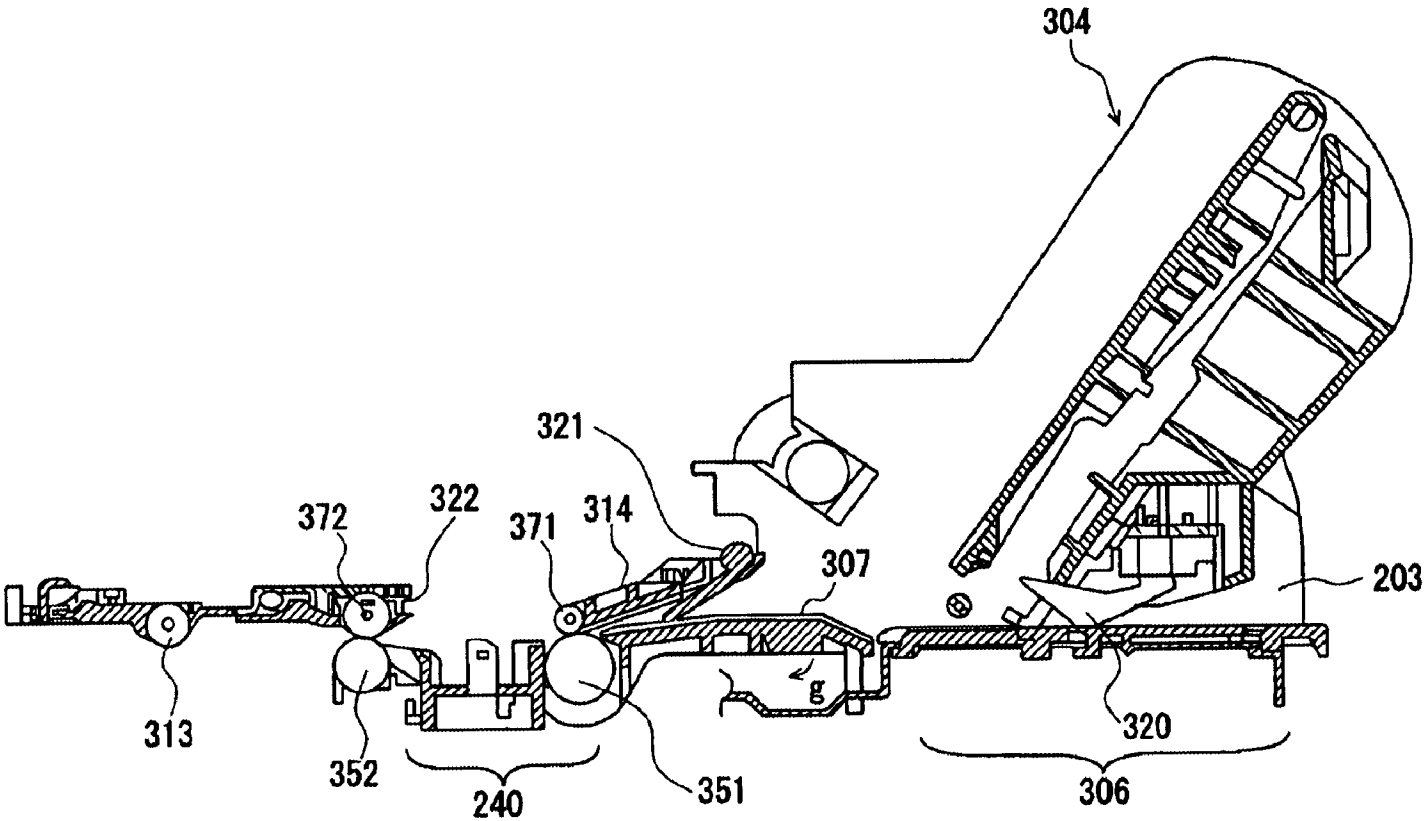
FIG. 15 is a side cross-sectional viewing depicting a complete image of a sheet transfer mechanism, including a sheet feeder mechanism fed by hand and located in the body of the ink jet type printer shown in FIGS. 13 and 14.

FIG. 15 shows a whole image of a sheet transfer mechanism including a sheet feeder mechanism by hand in the body 201 in the ink jet typed printer shown in FIGS. 13 and 14.

As shown in FIG. 15, a sheet transfer mechanism is comprised of the inlet 203 located at the back face of the aforementioned body 201, an auto sheet feeder (ASF) unit 304 provided at the upper part of the inlet 203, a paper guide stage by hand 306, a movable stage 307, and a print stage 240 for printing, at an upper part, by being reciprocated with a print head (and carriage, not shown) in an orthogonal direction to the same drawing. The movable stage 307 is gradually tilted and directed to a paper discharge side as shown in the figure drawing when plain paper is fed from the auto sheet feeder (ASF) unit 304 and the movable stage 307 is recessed at the lower side as shown at arrow G and obtains the flat sheet feeder passage when cardboard is guided by hand.

The sheet transfer mechanism has a sheet feed roller (Main) 351 provided at the upper side of the print stage 240 and a following roller 371 thereof; a discharge roller (sub) 352 provided at the lower side of the print stage 240 and a discharge star-wheel roller 372, which is the following roller thereof; a discharge star-wheel roller 313 provided at the lower side from the roller 352 and the roller 372. An upper guide plate is also provided at the upper part of the movable stage 307. The guide plate is forced to the lower part by a spring.

The sheet transfer mechanism has three detectors composed of a detector by hand 320 provided around lower side of the inlet 203, a paper detector 321 provided at the upper part of the above movable stage 307, and a tip detector (Optical sensor) 322 provided at the slightly lower side of the center point of the roller 372 and the roller 352 so that an optical axis is placed on it. Although all of these detectors are sensors of two values detecting whether or not there is paper, the detector 320 and the detector 321 respectively are mechanical contact point typed switches. Tips of switch knobs are respectively placed in the transfer passage so that the tips are projected. The knobs detect whether or not there is paper when passing paper makes contact with the tips. In contrast, the detector 322 is a reflection typed optical sensor similar to a description of the prior art.

Figure 16:
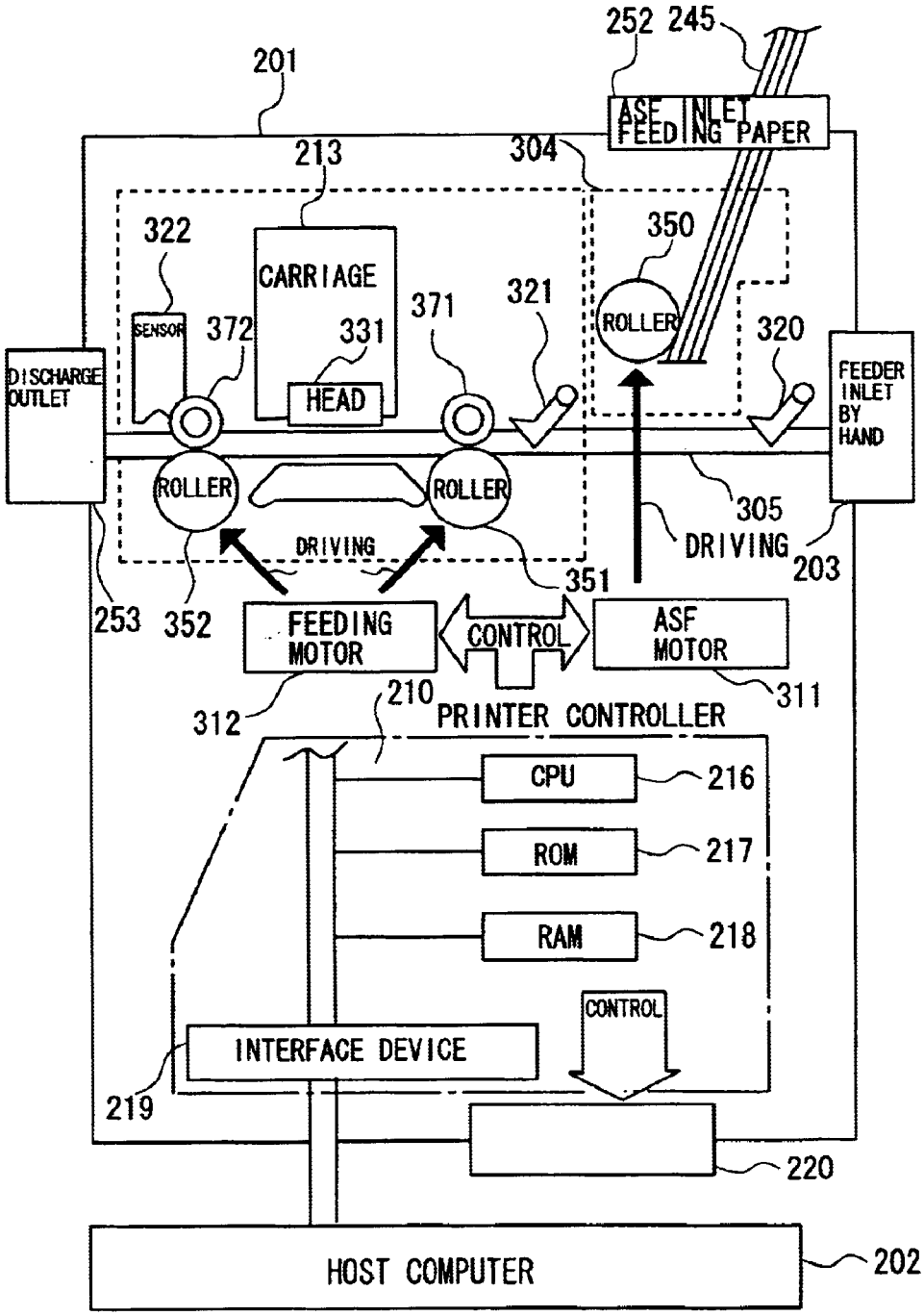
FIG. 16 is a schematic diagram showing the arrangement of an ink jet printer controller having the sheet transfer mechanism used in the present invention and the transfer passage.

FIG. 16 is a diagram showing an ink jet printer controller having the sheet transfer mechanism to be applied for the present invention in relation to the transfer passage.

In the printer 201, a CPU 216, a ROM 217, and a RAM 218 operating as a main storage unit are connected via a bus to totally control each unit. A print controller 210 (Controller 210 is shown with circular projected line), which is a control mechanism of a computer component is made up of these components.

Printer command data sent from a host computer 202 is transmitted from an interface unit 219 to the print controller 210 via a bus. The print controller 210 controls the recording head 200, which actually performs the printing operation by jetting ink; and performs driving control of an ASF motor 311, feeding a cut sheet 245 from a feeding motor 312 for feeding at the printing operation or the unit 304 to a transfer passage 305.

Two rollers to transfer paper during print operation, that is, the sheet feed roller 351 and the sheet discharge roller 352 are located in the passage 305. The roller 351 and the roller 352 are driven by the motor 312 and are synchronously rotated via teeth (not shown). The roller 371 and the roller 372 are provided on the upper parts of the roller 351 and the roller 352 respectively. A spring mechanism (not shown) respectively forces to the roller 351 and the roller 352. Recording paper is sandwiched between the roller 372 and the roller 352 and between the roller 371 and the roller 351. Recording paper is moved along the passage 305 in this manner.

In FIG. 16, the roller 372 is simplified and illustrated similar to the following roller. The carriage 213 is movable in the main scanning direction in printing is arranged at the upper side of the print stage 240 between the roller 351 and the roller 352 supported by a guide rail (not shown).

An initial positioning of a recording medium of the present embodiment will be described referring to FIGS. 17A to 18C and flowcharts of FIGS. 19 to 21 below.

A user who intends to print on card board or a CDR set to a CDR tray lifts the roller 371 from the roller 351 by setting the adjustment lever 301 to the position D. In this state, cardboard or the CDR try is inserted from the inlet 203.

Next, the user moves the adjustment lever 301 to the position B in a case of cardboard and moves the adjustment lever 301 to the position C in a case of the CDR try.

A sheet feed button of a panel switch unit 220 (See FIG. 16) is pushed. The position of the adjustment lever 301 is kept at the position D (That is, the adjustment lever 301 is not moved back to the position B or the position C) and the discharge button is pushed. In this case, an error occurs and the error light 206 for an erroneous display 206 blinks (See FIG. 13).

As aforementioned, the adjustment lever 301 is moved back to the position B or the position C. Sequence of a distal portion in the present embodiment is performed by pushing the discharge button of the panel switch unit 220. Here, a description will be explained by describing a case where cardboard is fed by hand as an example.

The present embodiment is characterized in that distal detection is performed for a recording medium fed by hand twice and then the distal portion is set. On the other hand, a state where there is paper or a state where there is no paper is respectively detected once and intermediate potentials of both are deemed as detection thresholds of a detector as mentioned later. Sequential explaining will be made below.

In sequence of distal portion in the present embodiment, a detection value (Threshold value) T0, that is, there is paper of default in the detector 322 is kept to reset to a lower value, which can absolutely detect paper etc. substantially.

Figure 17A:
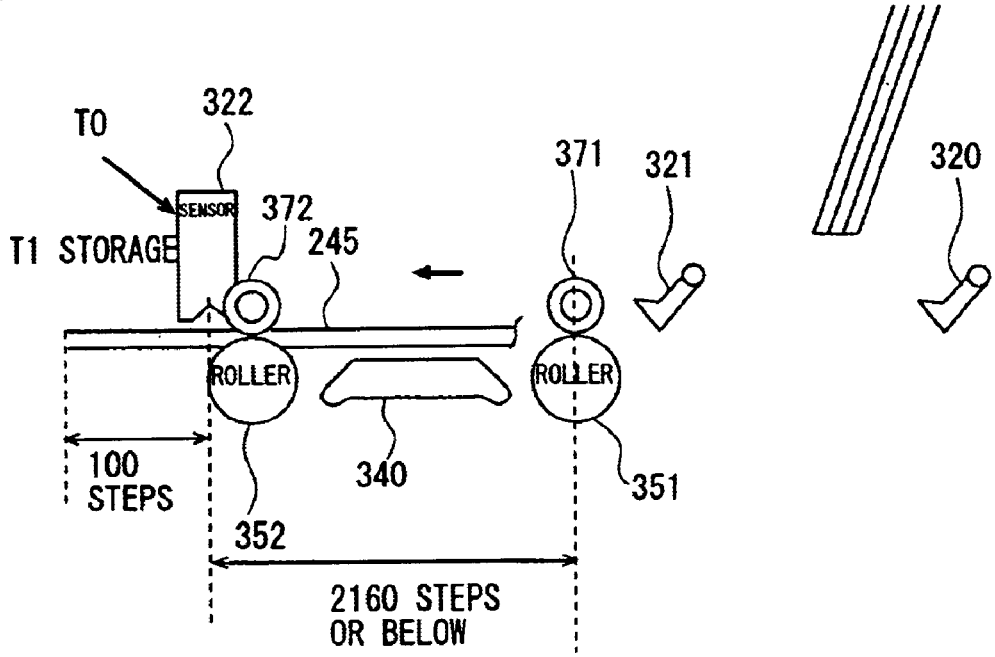
FIG. 17A shows the status of the recording medium detected by an optical sensor detecting reflected light.

In this state, as shown in FIG. 17A, board 245 is transferred to the lower side for 100 driving steps from the center of the detector 322. A detection value T1 of the detector 322 at this time is stored into the RAM etc.

Figure 17B:
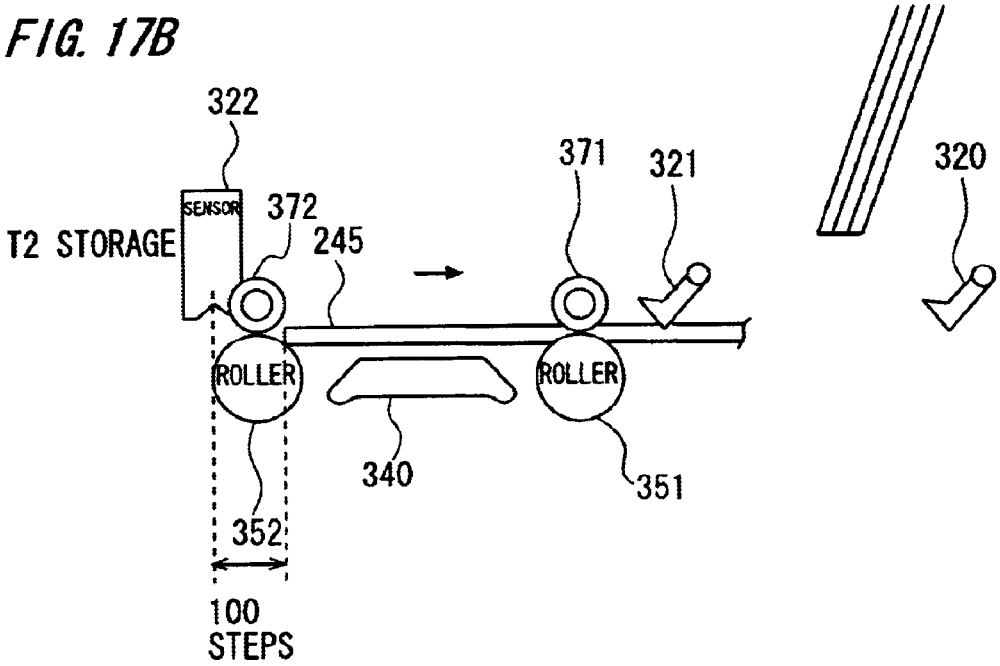
FIG. 17B shows a status of the recording medium not detected by an optical sensor that detects reflected light.

Next, as shown in FIG. 17B, board 245 is moved back to the upper side for 100 driving steps from the center of the detector 322. A detection value T2 of the detector 322 in a state where there is no paper is stored into the RAM etc.

Figure 18A:
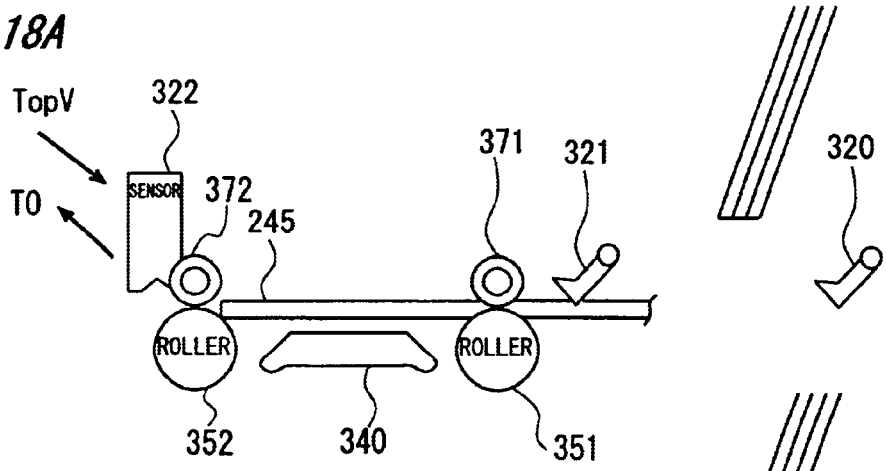
FIG. 18A is a schematic diagram depicting a process of changing a detection value of a detector consisting of reflection-type optical sensors.

As shown in FIG. 18A an average of each detection value stored into T1 and T2, Top V=(T1+T2)/2, is obtained by calculation. The detection value (threshold) in which there is paper is changed from TO of the default to the average Top V. FIGS. 17A and 17B respectively show an operation in which a value for change in the detector 322 to the detecting end.

Figure 18B:
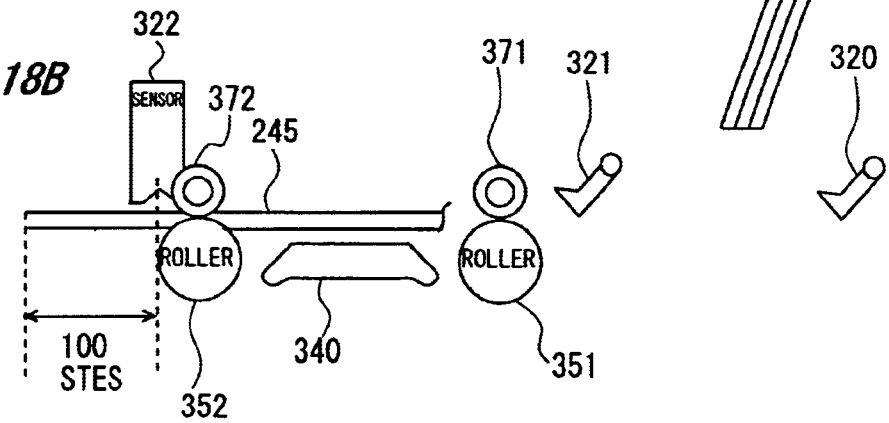
FIG. 18B shows the state where a leading edge of a recording medium is detected by a change in voltage.

Next, as shown in FIG. 18B, the detector 322 detects that there is paper from Top V and then the board sheet 245 is fed out up to a position downstream by one hundred driving steps from the center of the leading edge detector 322. Here, an initial value [+960] of a PF counter is set to forward the end portion to an original point.

In a printer of the present embodiment for which the initialization method of the recording medium of the present invention is applied, sequence of cardboard seek is performed. In the printer of the present embodiment, the PG (Paper gap) can be adjusted in three stages according to the kind (thickness) of recording medium as mentioned above. If the user erroneously sets the adjustment lever to the above position A regardless of feeding an extremely thick recording medium, for example, the CDR tray, the PG will be set to a narrow interval for plain paper. If this error is disregarded and the carriage is mainly scanned with a normal printing speed, the equipment may break due to a collision between the carriage and the CDR. When the carriage is moved to almost the center of a recording area with a low speed, a determination is performed based on a movement step position or a detected current value. As a result of this, when cardboard is detected, this is a sequence to inform the printer to enlarge the PG (paper gap). Detail is omitted here.

Figure 18C:
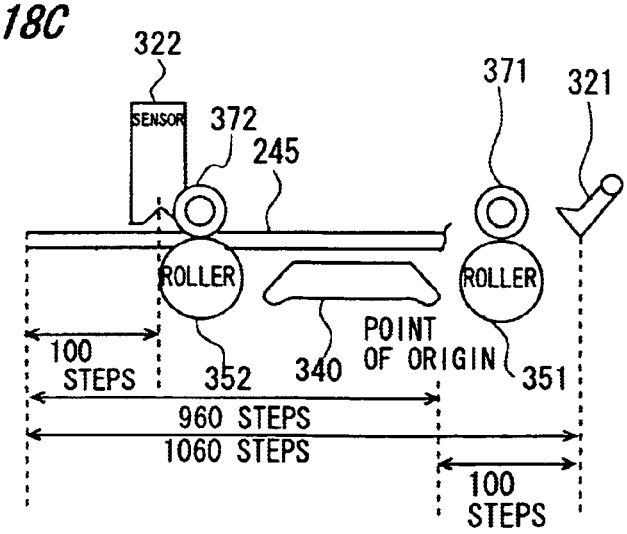
FIG. 18C is a diagram for explaining the operation of the heading operation.

FIG. 18C shows a diagram representing the procedure to determine the point of origin in sequence from FIG. 18B. In this diagram, a positive step is set to the left along the direction of feeding a cardboard 245. In this process, while setting a value of +960 in the PF counter, the position of the cardboard 245 shifted back 1060 steps. Then, the cardboard is forwarded 100 steps. At this point, the left end of the cardboard is defined as the origin. This process prevents a gear from experiencing undesirable backlash.

Figure 19:
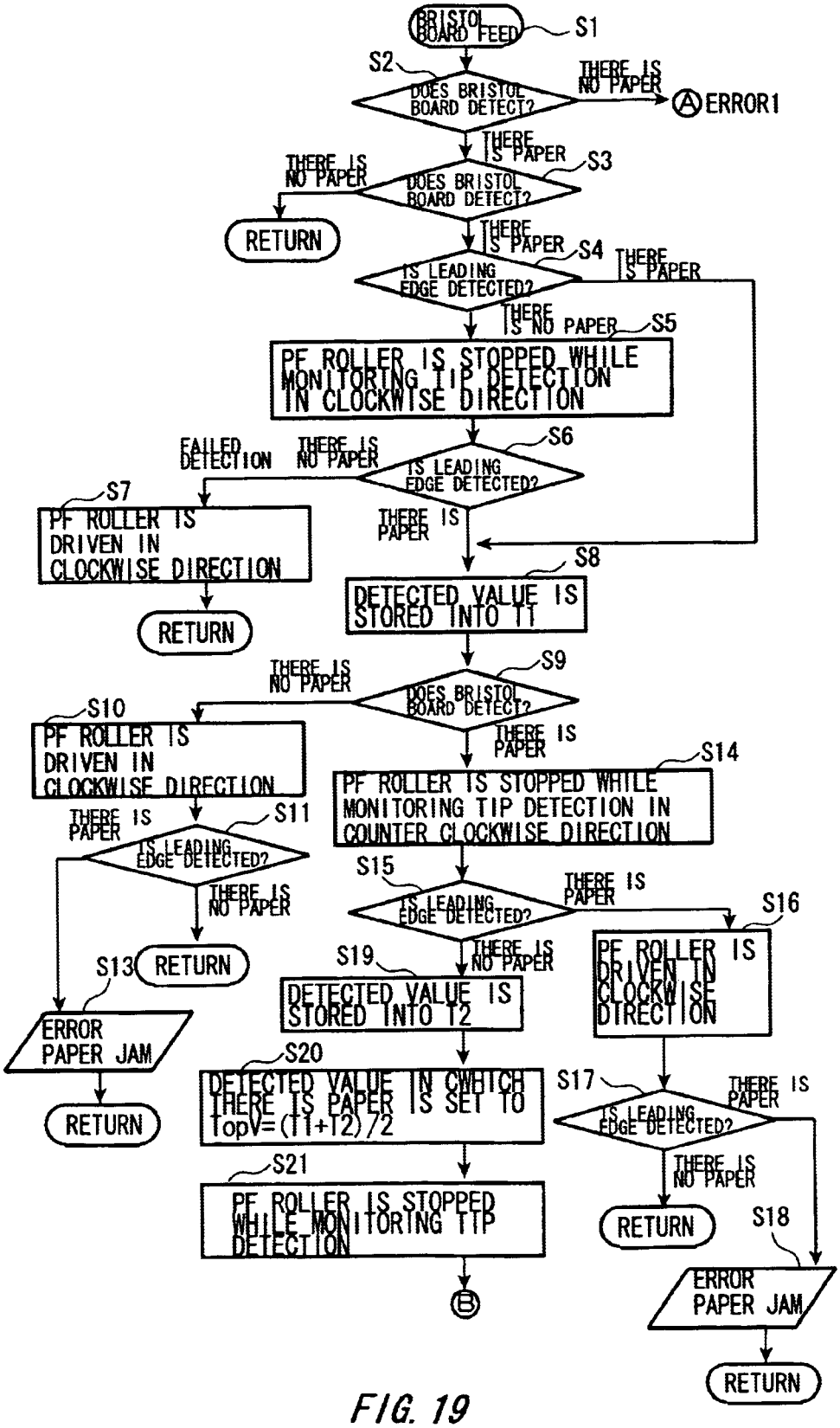
FIG. 19 is a flowchart showing various steps in the paper heading operation of the ink jet printer.

As shown in FIG. 19, when the user feeds board paper (S1) and pushes the feed button, whether or not the board is detected by the detector 321 is judged (S2). When board paper is not detected by the detector 321 (there is no paper, which is represented by a "No" in S2), error processing (ERROR1) is performed. There is an error if the detector 321 does not detect board paper regardless of whether the paper was inserted from the inlet 203.

Figure 20:
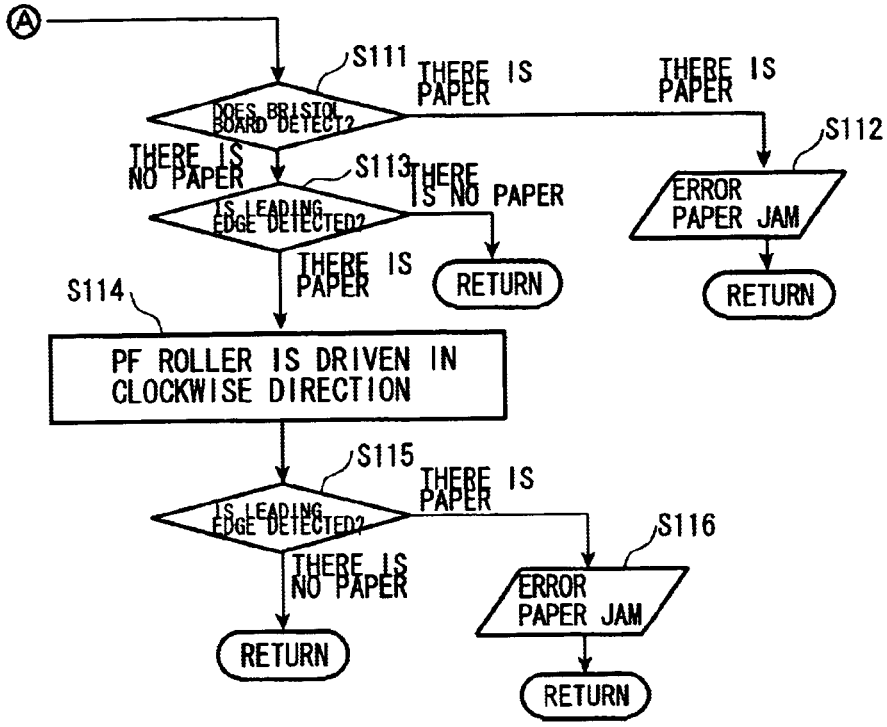
FIG. 20 is a flowchart showing steps in the paper heading operation of the ink jet printer.

As shown in FIG. 20, whether or not board is detected by the detector 320 is judged (S111). When board paper is detected by the manual feeding detector 320 (there is paper, which is represented by a "Yes" in S111), it is considered that a paper jam has occurred between the detector 320 and the detector 321. Error processing is performed (S112) and RETURN is executed. When board paper is not detected by the detector 320 (there is no paper, which is represented by a "No" in S111) board paper is not detected by both the detector 321 and the detector 320 even though the user inserted the board paper from the inlet 203. In this case, very short paper is assumed to have been inserted. Further, it is judged whether or not board paper is detected by the detector 322 (S113).

When the board paper is detected (there is paper) by the detector 322 ("Yes" in S113), a PF roller (Motor 312) is rotated with a minimum speed in a forward direction, the motor 312 is rotated up to driving step 2700 steps (S114), here the PF roller is stopped, and whether or not board paper is detected by the detector 322 is judged (S115). Again, if the board paper is not detected by the detector 322, that is, "No Paper" is judged ("No" in S115), then the operation turns to RETURN mode and it becomes a state in which the printer waits for the next command. When the leading edge of the paper is detected ("Yes" in S115), error processing is performed because of a paper jam (S116) and then the operation goes to RETURN mode. In this case, the user takes paper that caused the jam out of the printer and may try to print again.

Referring again to FIG. 19, when board paper is detected by the detector 321 (there is paper, which is represented by a "Yes" in S2), whether or not board paper is detected by the detector as shown in FIG. 17 (S3). If no board paper is detected by the detector 320 ("No" in S3), the operation changes to RETURN mode and then the control system waits for the next command. When the board paper is detected by the manual feed detector 320 (there is paper, which is represented by a "Yes" in S3), next, it is judged whether or not board paper is detected by the detector (S4). The leading edge detector 322 does not detect the board paper ("No" in S4), the PF roller (roller 351 and roller 352) is rotated with the minimum speed in the forward direction (paper feed motor 312) while the detector 322 monitors end detection. When the end is not detected, the motor 312 is rotated up to driving step maximum 2160 steps and the PF roller stops.

When the detector 322 detects that there is paper while end detection is monitored, the PF roller is stopped in 100 steps ahead (S5). Driving step 2160 shows a value below 2160 steps in a driving step of a distance from a center point NP1 of the roller 351 and the roller 371 to a detection point DT of the detector 322. When paper is transferred from the NP1 to DT and paper does not reach DT, it is preferable that the processing is considered as error.

In S4 when the leading edge detector 322 detects the board paper ("Yes" in S4), it is considered that board paper reaches to the tip of detection point of the detector 322 only insertion by user. Therefore, since a state shown in FIG. 17 A is achieved, a routine goes to S8 without transfer of paper (S5 and S6 are jumped). In step 5, when the detector 322 detects that there is paper during monitoring end detection, the PF roller is stopped in 100 steps ahead. This is because a state shown in FIG. 17A is achieved by transferring paper.

on the other hand, when the sheet feed motor 312 is rotated from the detection point DT of the detector 322 to the during step 2160 steps ("No" in S6), it is judged as failure of the detector 322. Then PF roller (motor 312) is rotated with a minimum speed in the forward direction. Then the motor 312 is rotated up to driving step 17000 steps and the PF roller is stopped at the step (S7) and RETURN is executed and waits for the next command. Driving step 17000 steps is volume transferring paper capable of sending out paper in A4 size in transfer lower direction. Processing is changed to error processing as failure of the detector 322 and paper is sent out.

on the other hand, when end detection occurs ("Yes" in S6), a detection value of the detector 322 is stored, for example, in a second storage area (T1) provided on the RAM 218. whether there is board paper or not is judged by the detector 321 (S9). When board paper is not detected by the detector 321 (there is no paper, which is represented by a "No" in S9), paper is fed out as the paper is judged to be extremely short. In this state, to execute sequence of transfer end, when short board paper is moved back to the upper side, these destruction probably occur since the detector 321 or the detector 320 is a mechanical connection point switch and the switch is set in a state where the switch is tilted at the low side.

Then, PF roller (paper feed motor 312) is rotated in forward direction at a minimum speed and the paper feed motor 312 is rotated up to the driving step 17000 steps (S10) and, then the PF roller is stopped. Here again, it is judged whether the leading edge detector 322 detects the board paper (S11). If the leading edge detector 322 does not detect the board paper (no paper, which is represented by a "No" in S11), it is considered that the short paper can be discharged out completely by driving of 17000 steps. Then the operation goes to RETURN and waits for the next command to return to the original sequence (not the present sequence). If a leading edge of the paper is detected ("Yes" in S11), error processing is performed (S13) on account of a paper jam caused by the short paper during driving of 17000 steps.

On the other hand, if the paper detector 321 detects the board paper("Yes" in S9), the PF roller (paper feed motor 312) is rotated at the minimum speed in a reverse direction while edge detection is monitored. The motor 312 is rotated from 2160 steps at maximum driving step or no paper of the detector 322 to 100 steps. The PF roller is stopped at the step (S14). After that, further it is judged whether the leading edge detector 322 detects the board paper. If the paper is detected ("Yes" in S15), the PF roller (paper feed motor 312) is rotated at the minimum speed in the forward direction, the motor 312 is rotated up to driving step 17000 steps (S16), the PF roller is stopped, and whether or not board paper is detected by the detector 322 is judged at the step (S17).

If the detector 322 does not detect the board paper (no paper, which is represented by a "No" in S17), RETURN is executed and the printer waits for the next command. If the paper is detected ("Yes" in S17), error operation is performed as it is considered that a paper jam has occurred (S18), and then RETURN is executed.

On the other hand, when no detection is made at S15 ("No" in S15), the detection value of the leading edge detector 322 is stored in a second storage region (T2) on a RAM 218 (S19).

In the present embodiment, the average value TopV is deemed as detection value (threshold value) in which there is paper by the detector 322 (S20). The average value of the detection values stored in T1 and T2 is obtained by calculation. It is characterized that the detector 322 is modified to consider the detection value (threshold value) in which there is paper as the average value.

Then, the PF roller (paper feed motor 312) is rotated in the forward direction at the minimum speed while leading edge detection is monitored. The paper feed motor 312 is rotated by 100 steps from either the maximum driving step 2160 steps or the detector 322 detects "There is paper" (there is paper detected from TopV) and then the PF roller is stopped. A value of +960 is set to a PF counter (S21). Thereby, a state transferring board paper becomes the same as a state of FIG. 17A. However, in FIG. 17A, the detection value (threshold value) at which the detector 322 determines that the paper exists is the default detection value (threshold value) T0, which is the lowest value at which the detector can absolutely detect paper or the like, whereas in FIG. 18B, the paper detection is performed at TopV. The reason why it is set for rotation by 100 steps from either the maximum driving step 2160 steps or when the detector 322 detects "There is paper" (there is paper detected from TopV) is because that is sufficient to achieve the status shown in FIG. 18B as described for S5. It is for the first time here when the PF counter is set to a value of +960 to feed paper to a reference position (original point) where the leading edge is transferred.

Figure 21:
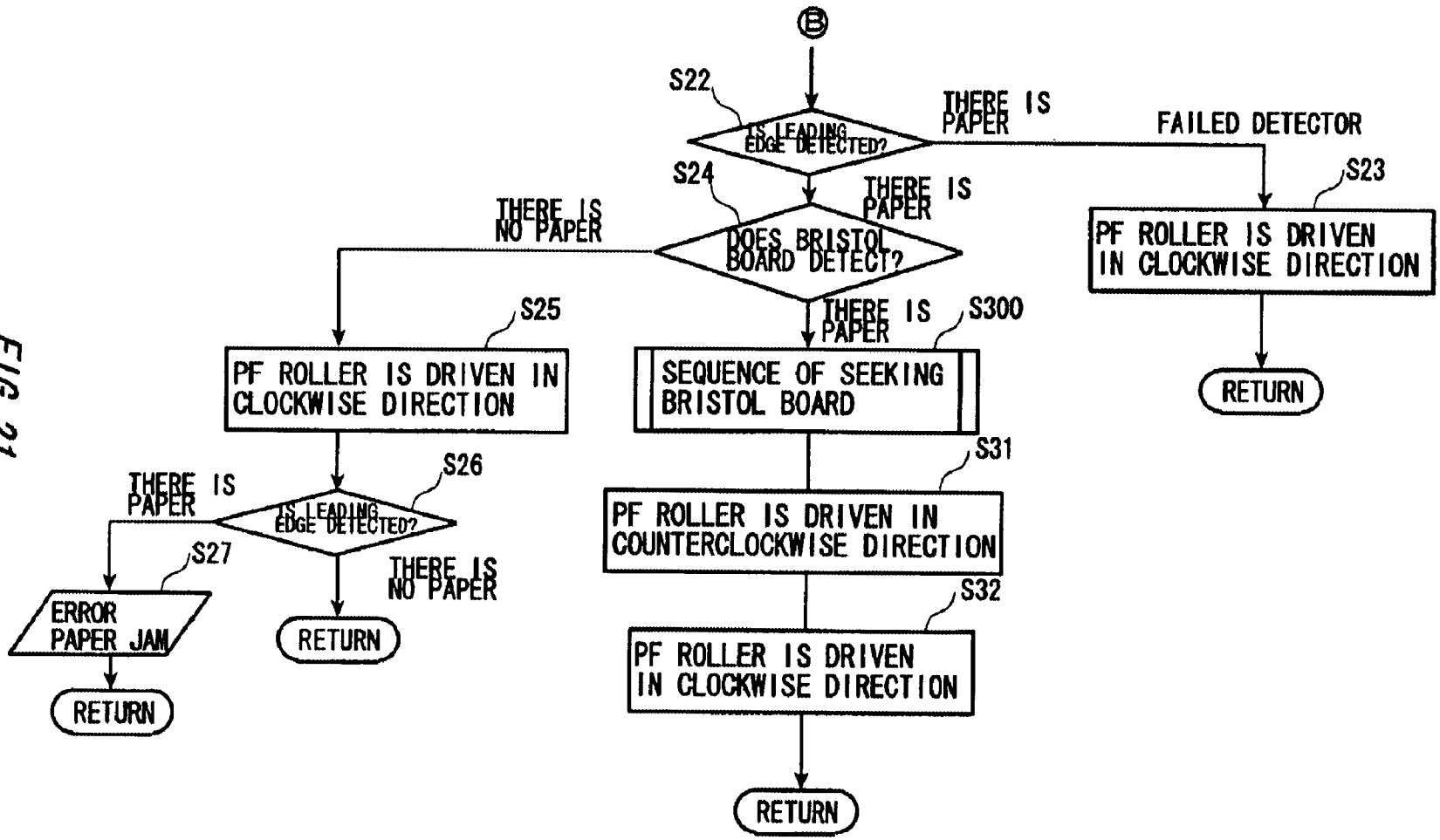
FIG. 21 is a flowchart showing steps in the paper heading operation of the ink jet printer.

Thereafter, as shown in FIG. 21, it is judged whether the leading edge detector 322 detects the board paper (S22). If there is no detection ("No" in S22), it is judged as a failure of the detector, the PF roller (paper feed motor 312) is rotated in forward direction at the minimum speed and then the motor 312 is continued to rotate up to the driving step 17000 steps. Then the PF roller is stopped (S23) and RETURN is executed and waits for the next command. On the other hand, if a paper is detected in ("Yes" in S22), then it is judged whether the paper detector 321 detects the board paper (S24). If no board paper is detected by the detector 321 ("No" in S24), then the PF roller (paper feed motor 312) is rotated at the minimum speed in the forward direction and the paper feed motor 312 is driven up to 17000 driving steps and then the PF roller is stopped (S25). Again, it is judged if the leading edge detector 322 detects the board paper (S26).

If no paper is detected ("No" in S26), RETURN is executed and the operation waits for the next command. IF a detection is made ("Yes" in S26), an error operation is performed as a paper jam or the like is assumed to have occurred (S27), then RETURN is executed. On the other hand, when the board paper is detected at S24 ("Yes" in S24), the afore-described sequence for the thick paper is performed (S300). After that, PF roller (paper feed motor 312) is rotated in the reverse direction at the minimum speed, and the driving step 1060 steps is driven (S31). As mentioned above, the value of +960 is previously set to the PF counter in S21. The reason why driving up to driving step 1060 steps in reverse direction is that a 100 steps back from reference position (original point) is performed and, thereafter, 100 steps forward is accomplished to set the reference position (original point) so that the backlash can be avoided.

Then the PF roller (paper feed motor 312) is rotated at the maximum speed in the forward direction and the PF roller is driven until the PF counter reaches zero steps (S32). Owing to the operation, the leading edge of the board paper is transferred to the original point. Then RETURN is executed and the system waits for the next command.

In the present embodiment, three detectors monitor the transferring status of the recording medium. In a case where a normal operation is doubtful, since processing proceeds appropriately to discharge the medium or error processing occurs, a leading edge of the recording medium can efficiently be transferred. Both a state that there is the recording medium and there is no the recording medium are detected, and an intermediate potential of the both is considered as a detection value of the detector described below. Thereby, end detection can be carried out regularly with high accuracy regardless of the kind or thickness of the recording medium.

In the present invention, the detection voltage according to the receiving amount is detected in a state where there is the recording medium and there is no recording medium by using a detector composed of a reflection typed optical sensor once. Since a tip position of the recording medium is detected considering both intermediate potential as the detection threshold, tip detection can be accomplished with high accuracy. Since the recording medium is set to the initial position, the tip is set to the initial position with high precision not depending on the kind of recording medium or thickness, and it is possible to transfer the tip to the initial position.

Still another embodiment will be described below. In the present embodiment, when the tray for transfer in FIGS. 4 to 12 is manually set to a predetermined position of a passage transferring a recording material to the recorded of a mechanism transferring the recording medium to be recorded, the tray for transfer is set to the position based on an outer view of constitution elements of the recording apparatus displayed on the tray for transfer.

Figure 22:
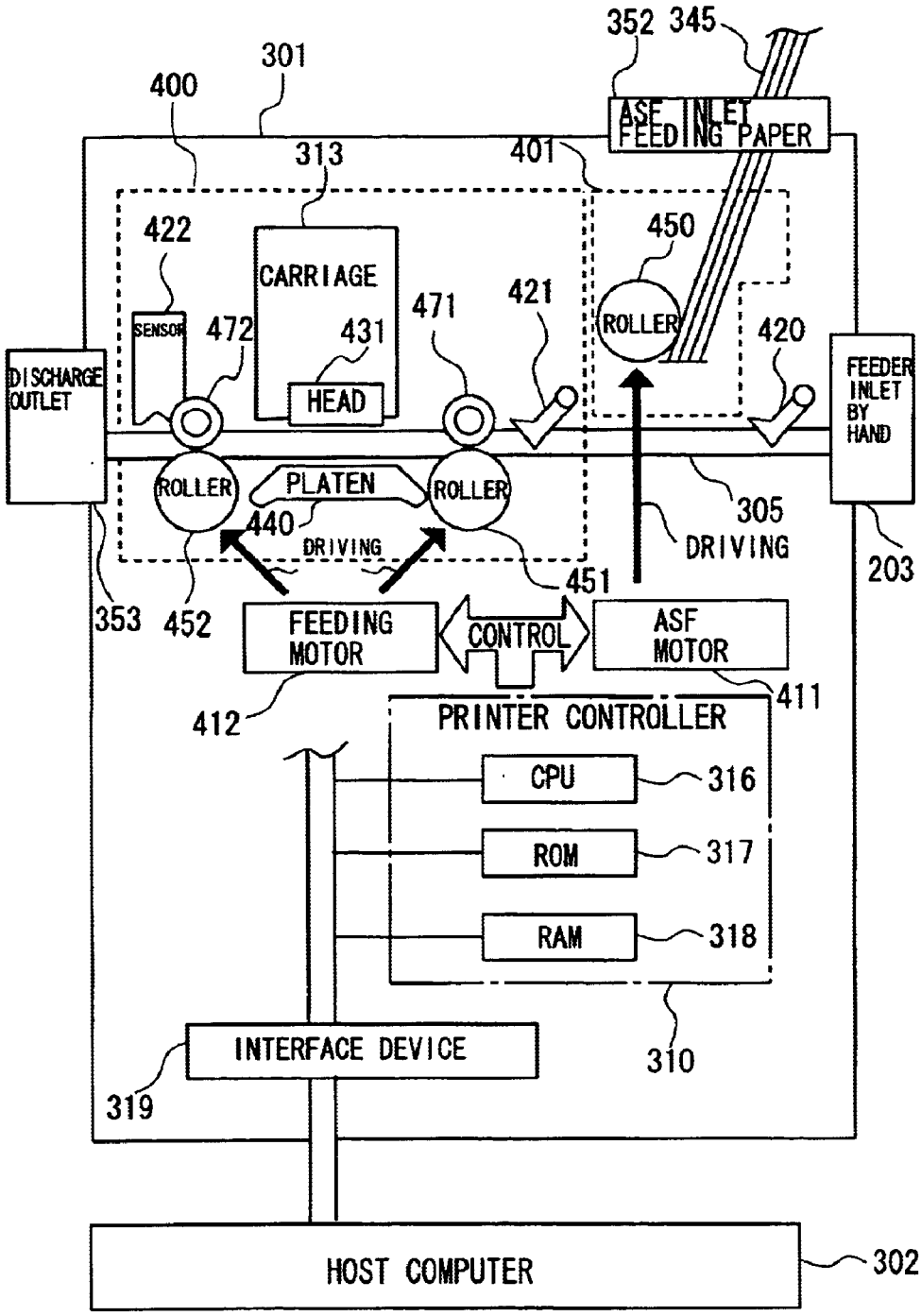
FIG. 22 is a schematic diagram showing printer hardware, including hardware arranged along a paper feed path in the printer.

FIG. 22 is a diagram for explaining the relationship of the control mechanism and the paper feed path of the printer 301 according to the invention.

For the purpose of controlling a printer 301, the printer 301 includes Central Processing Unit (CPU) 316, Read Only Memory (ROM) 317, Random Access Memory (RAM) 318 and the Printer controller 310. These elements are, through interface device 319, connected to a host computer 302 along a bus. The bus is a path allowing transmission of information between particular points. In this figure, the Printer controller 310 is shown as a dashed line.

Printing instructions from the host computer 302 are sent to the controller 310 through the interface device 319 along the bus. The controller 310 controls various embodiments in the printer 301. Such examples include the recording head 431 for controlling ink emission in the printing process, the paper feeding motor 412 for feeding paper with the printer 301 during printing process, the ASF (Auto Sheet Feeder) motor 411 for transferring cut sheet 345 into paper feed passage 305, etc.

Figure 23:
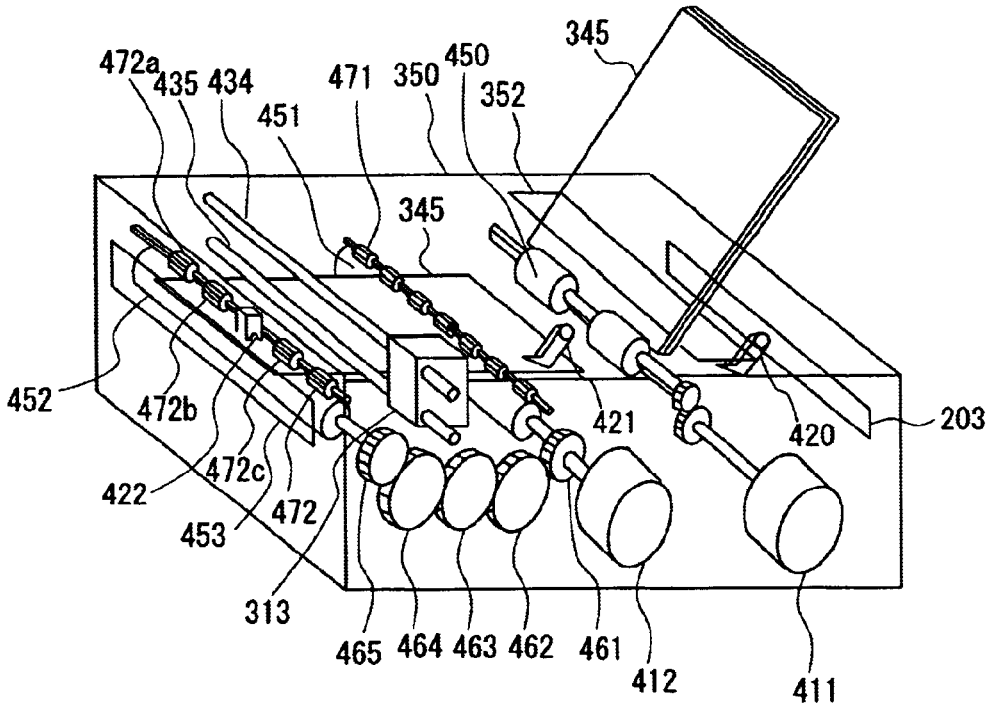
FIG. 23 is a perspective view showing an arrangement of optical sensors in the printer.

FIG. 22 shows a perspective view showing the configuration of embodiments located in the area near print feed passage 305. FIG. 23 shows a portion of feeding paper in two regions shown by dashed lines.

The inlet 203 to feed thick recording paper is provided on the back face of the printer body 350. An ASF inlet 352 is opened to feed thin recording paper 345 put in a stacker and placed at an upper part of the body 350 in a paper feed path by an ASF roller 450.

In the paper feed path, two rollers, a feeder side roller 451 and a send-out side roller 452 to transfer paper during printing are provided. Two rollers 451 and 452 are driven by a transfer motor 412 and are synchronized with each other via gears 461 to 462. From upper parts of the rollers 451 and 452 multiple of a star-wheel roller 451 with a small diameter to a star-wheel roller 472 with a small diameter (a to d)/engaged with respective rollers to be operated are respectively arranged at respective free points. And are forced to respective rollers by the spring mechanism. Recording paper is sandwiched by all of the star-wheeled rollers and is transferred in the paper feed path.

A carriage 313 movable in the main scanning direction in printing is arranged at the upper side of a platen 440 between the two rollers 451 and 452 by two guide rails 434 and 435. Sensors 420 to 422 are provided in the paper feed path. The sensor by hand 420 and a paper end sensor 421 are mechanisms which detect the paper by physical connection. Tips of switch knobs are projected in the paper feed path.

In this way, paper is detected. Only knobs of the sensors 420 and 421 are illustrated in each figure.

On the other hand, the sensor 422 is an optical sensor comprised of a light emitted diode and a photo diode. The optical sensor 422 is provided on the upper side of the roller 452, and between the roller 472*b* and the roller 472C.

That is, the optical sensor 422 is arranged between the roller 472*b* and the roller 472C in a direction of paper width of recording paper 345. The optical sensor 422 is extremely close to the roller 452 or the center point of each of the rollers 472*a* to 472*d* and the optical sensor 422 is provided at the front side of the printer.

Figure 24:
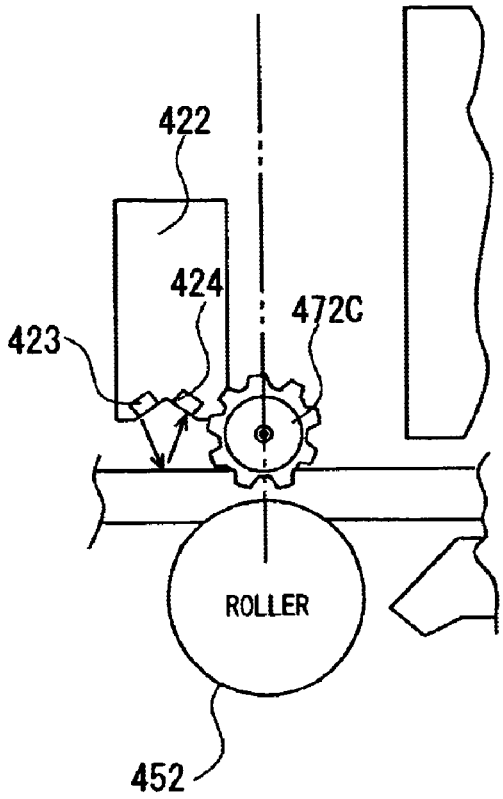
FIG. 24 is a schematic view for explaining an actual arrangement of the optical sensors in the printer.

As shown in FIG. 24, it is preferable that the optical sensor 422 is provided so that an optical axis of the diode 423 and the diode 424 is at the paper discharge side of the paper feed path from the center point (nipple point) of the star wheel roller 472 (roller 472C in FIG. 24). This is because the recording paper 345 is passed through the center point of the roller 472 and the recording paper 345 can sufficiently be stable after it is sandwiched by the rollers 472 (and roller 452).

Next, paper detection by the optical sensor 422 in relation to motor control by the controller 310 will be described.

Figure 25:
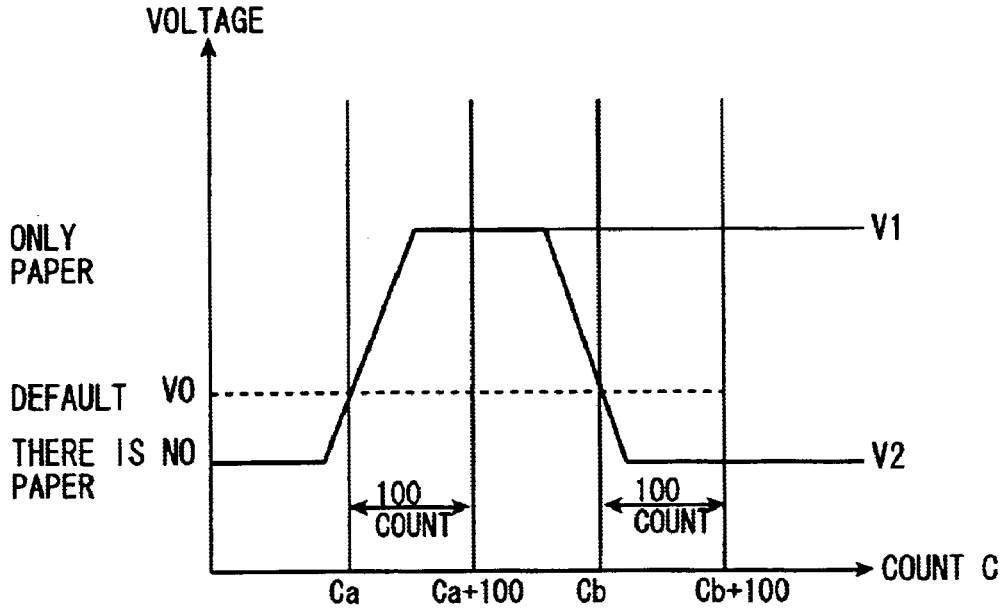
FIG. 25 is a graph for explaining a relationship of an output voltage and a motor control when using the optical sensors.

FIG. 25 shows a graph of an output voltage change of the photo diode 424 of the optical sensor 422. The vertical axis in the graph is a voltage value and the horizontal axis is the amount of paper (the counted value counted by an optical encoder or the like) shown at the horizontal axis. It is a value in which an absolute value is added regardless of whether a motor is rotated in the forward direction or in the reverse direction.

When recording paper 345 is transferred by the ASF rollers 450, the paper end sensor 421 detects this. The controller 310 operates the motor 412 to rotate in the reverse direction and recording paper 345 is transferred to the optical sensor 422. When the end of recording paper 345 is passed under the optical sensor 422, output of the diode 424 is changed from Vn to V1. In this way, the controller 310 exceeds a voltage value V0 stored as a predetermined value. The controller 310 rotates a motor for 100 counts from a count value Ca of the encoder in the forward direction and stops the motor (position of recording paper 345). The controller 310 obtains a voltage value V1 at this time.

Figure 26:
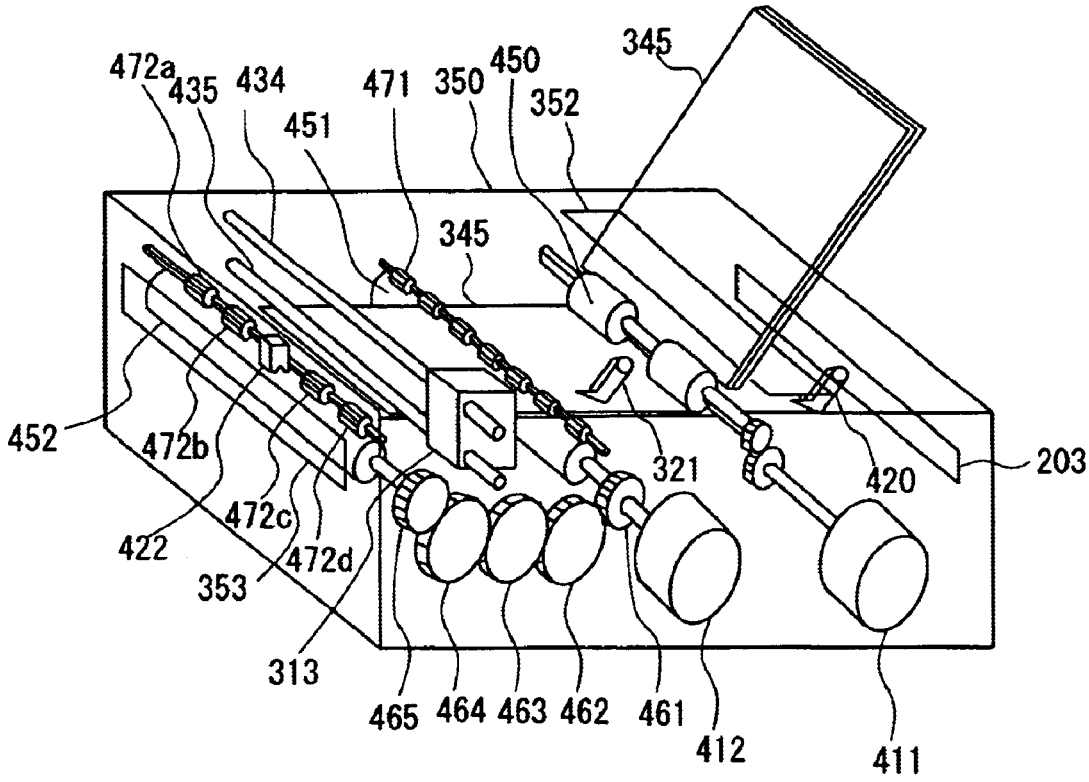
FIG. 26 is a perspective view illustrating the arrangement of optical sensors in the printer.

Next, the print controller 310 rotates the motor 412 in the reverse direction and pulls back the recording paper 345. During the pulling back of the paper, if a value of output voltage of the diode 424 dips below the predetermined voltage value V0, the print controller 310 rotates the motor in the reverse direction by 100 counts from the counted value Cb of the encoder and then it is stopped. At this time, recording paper 345 may separate from the roller 345 once, recording paper 345 is sandwiched by the roller 451 rotating in synchronization with the roller 452. Thereby, recording paper 345 is transferred without any problems by only the driving of one motor 412 (Position of recording paper 345 is transferred without any problems by only driving of one motor 412 (Position of recording paper 345 shown in FIG. 26). The controller 310 obtains a voltage value V2 at that time.

The obtained voltage values V1 and V2 are processed in accordance with a predetermined algorithm and used for head transfer. An average value of V1 and V2 is obtained and, again, the motor 412 is rotated in the forward direction. It can be considered that the end of recording paper 345 reaches directly below the optical sensor 422. The end is transferred ahead of a predetermined (paper is fed forward or moved back) and set to the predetermined position. Like this, it is considered that the values are used.

In the present invention, the optical sensor is arranged directly below the roller at the front side of the printer from the discharge roller and, the roller and a sensor to detect paper of driving are very closely arranged. Therefore, it becomes possible to transfer the end of the paper with high precision and without the influence of the warp of paper.

The sheet feed roller and discharge roller move in synchronization with each other by gears. By a design like this, it becomes possible to transfer the end of the paper and to pull the paper back.

Since the optical sensor is provided so that the optical axis is at the send-out side of the paper (sheet) transfer passage from the center point, end detection of recording paper can be done reliably.

Still another embodiment will be described below. When the tray for transfer is manually set to a predetermined position of a recording transfer passage in a mechanism for transferring the recording, the position of the transfer tray is set to the predetermined position based on an outline view of a constitution element in the recording apparatus displayed on the tray for transfer.

Figure 27:
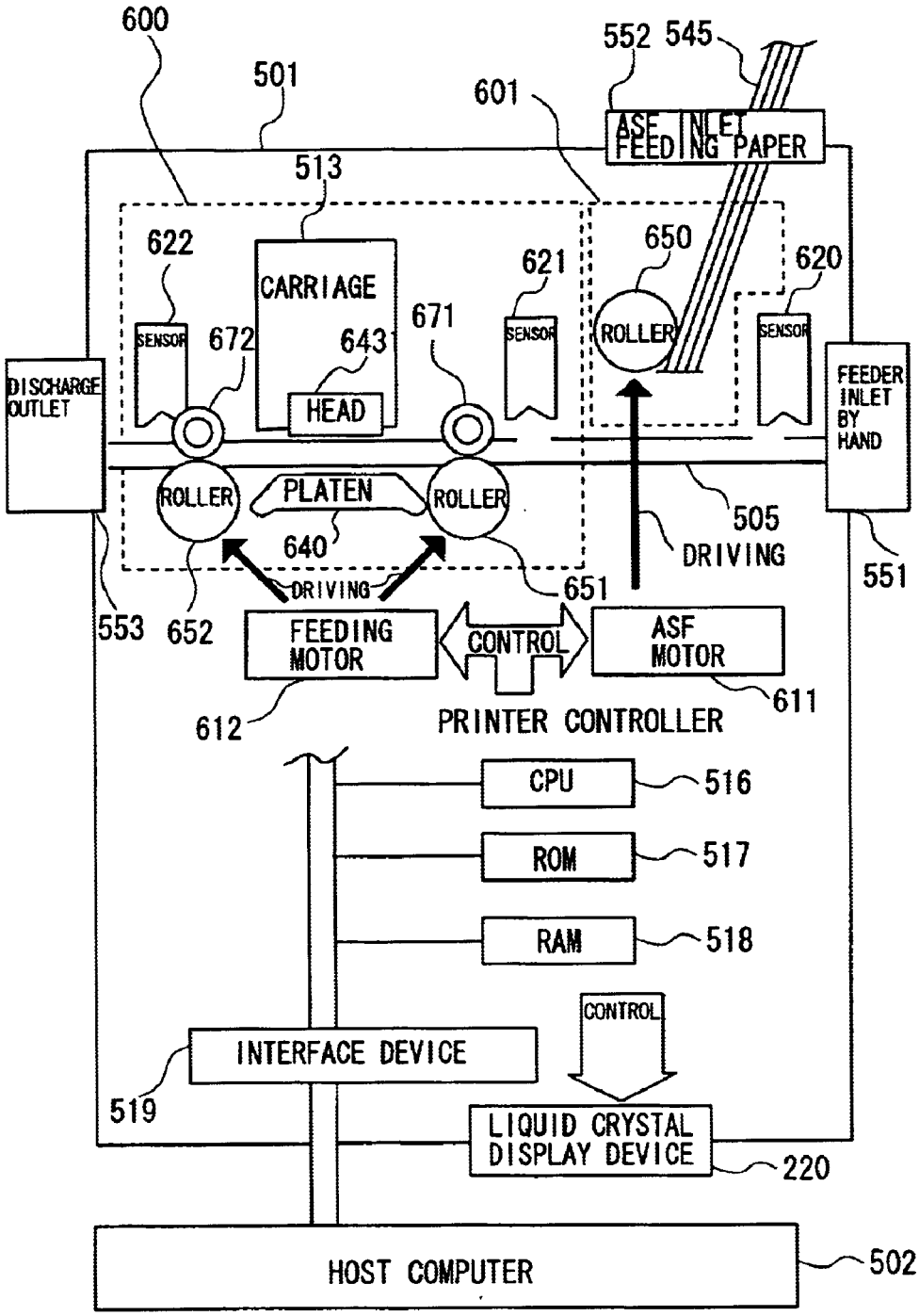
FIG. 27 is a schematic diagram showing the printer hardware according to another embodiment of the invention.

FIG. 27 is a diagram showing a design of a control mechanism and a paper feed path of the ink jet printer 501 for which the present invention is applied.

For the purpose of controlling all functions in a printer 501, the printer 501 includes the Central Processing Unit (CPU) 516, Read Only Memory (ROM) 517, Random Access Memory (RAM) 518, and the Printer controller 310. These elements are connected to a host computer 302 along a bus through interface device 319. In FIG. 27, the Printer controller 510 is shown as a dashed line.

Printing instructions from the host computer 502 are sent to the controller 510 through the interface device 519 along the bus. The controller 510 controls various embodiments in the printer 501. Such examples include the recording head 631 for controlling ink emission in the printing process, the paper feeding motor 612 for feeding paper with the printer 501 during printing process, the ASF (Auto Sheet Feeder) motor 611 for transferring cut sheet 545 into paper feed passage 505, etc.

Figure 28:
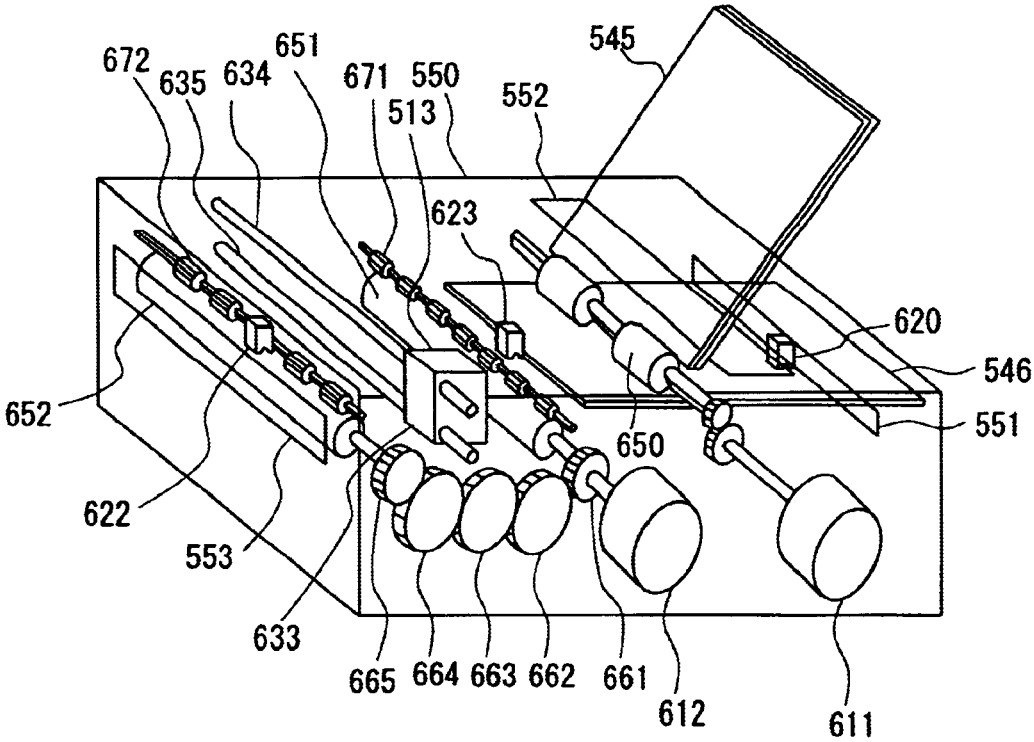
FIG. 28 is a perspective view showing the main components surrounding the paper feed path of the printer.

FIG. 28 is a perspective view illustrating the positional relationship of each constitution part arranged around the sheet transfer passage 505. In FIG. 28, the only part relating to paper transfer in the printer body 50 is drawn with a phantom line.

The inlet 551 to feed thick recording paper or the transfer tray 546 is provided on a back face of the printer body 550 since the thin recording paper 546 stored in the sheet holder and placed at the upper part of the body 550 is transferred in the paper feed path by the ASF roller 650 when the ASF inlet 552 is opened.

Figure 30:
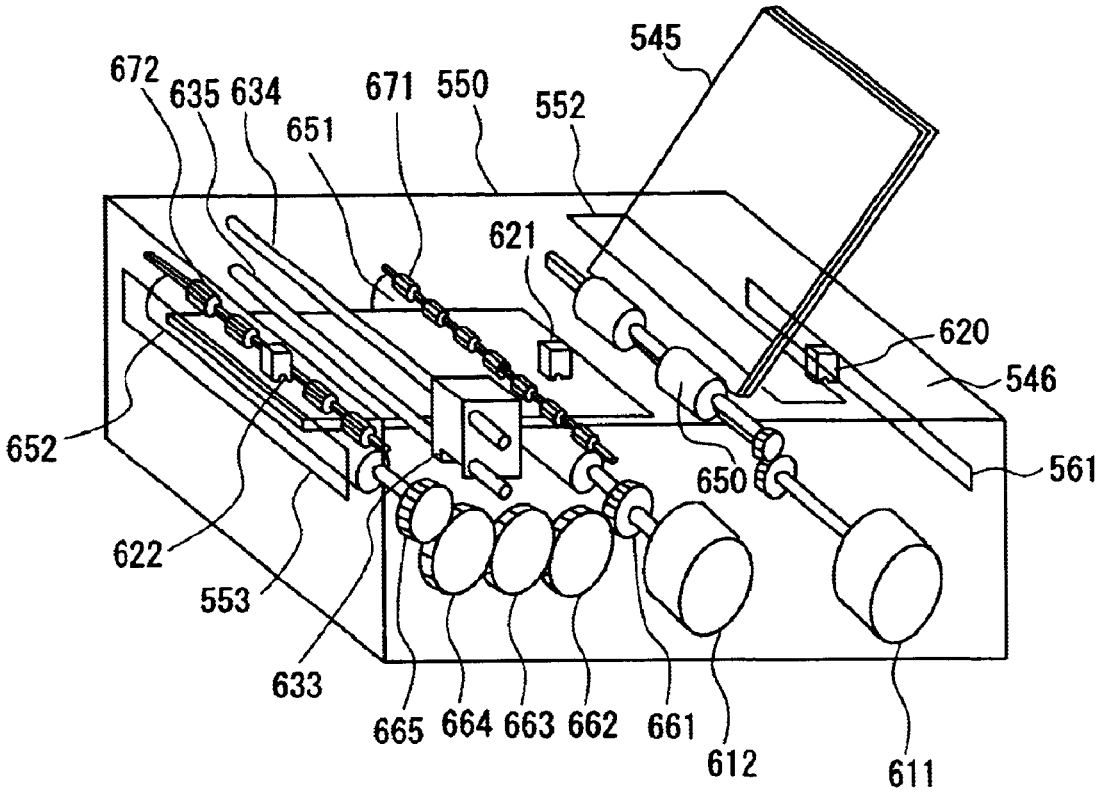
FIG. 30 is a perspective view showing the state where the transferring tray is fed to a position below the main scanning line shown in FIG. 28.

A couple of rollers for performing the paper feed operation during the printing, i.e., a paper feed roller 651 and a paper discharge roller 652 are disposed in the paper feed path. These two rollers 651 and 652 are driven by a paper feed motor 612 to rotate via gears 661 through 665 in synchronization with each other. From a top of the rollers 651 and 652, a group of pinions 671 and 672 are mounted on a free-rotating axis and forced toward the respective roller by a spring mechanism not shown. A recording sheet is sandwiched by the group of pinions and rollers and conveyed in the paper feed path as shown in FIG. 30.

A carriage 513 is supported by a couple of guide rails 634 and 635 in an upper area of the platen 640 arranged between the two rollers 651 and 652 shown in FIG. 27 and moves along in the main scanning direction during the printing operation.

Sensors 620 through 622 each having a light emitting element and a light receiving element are located on the bottom of reverse-V shaped notches formed in the paper feed path. With these sensors 620 through 622, the light emitting element emits a light beam toward an object and the light receiving element receives the reflected light, so that the existence of the object can be detected by detecting a change in output voltage of the light receiving element caused by a change in the reflective index of the object under the sensor.

Figure 29:
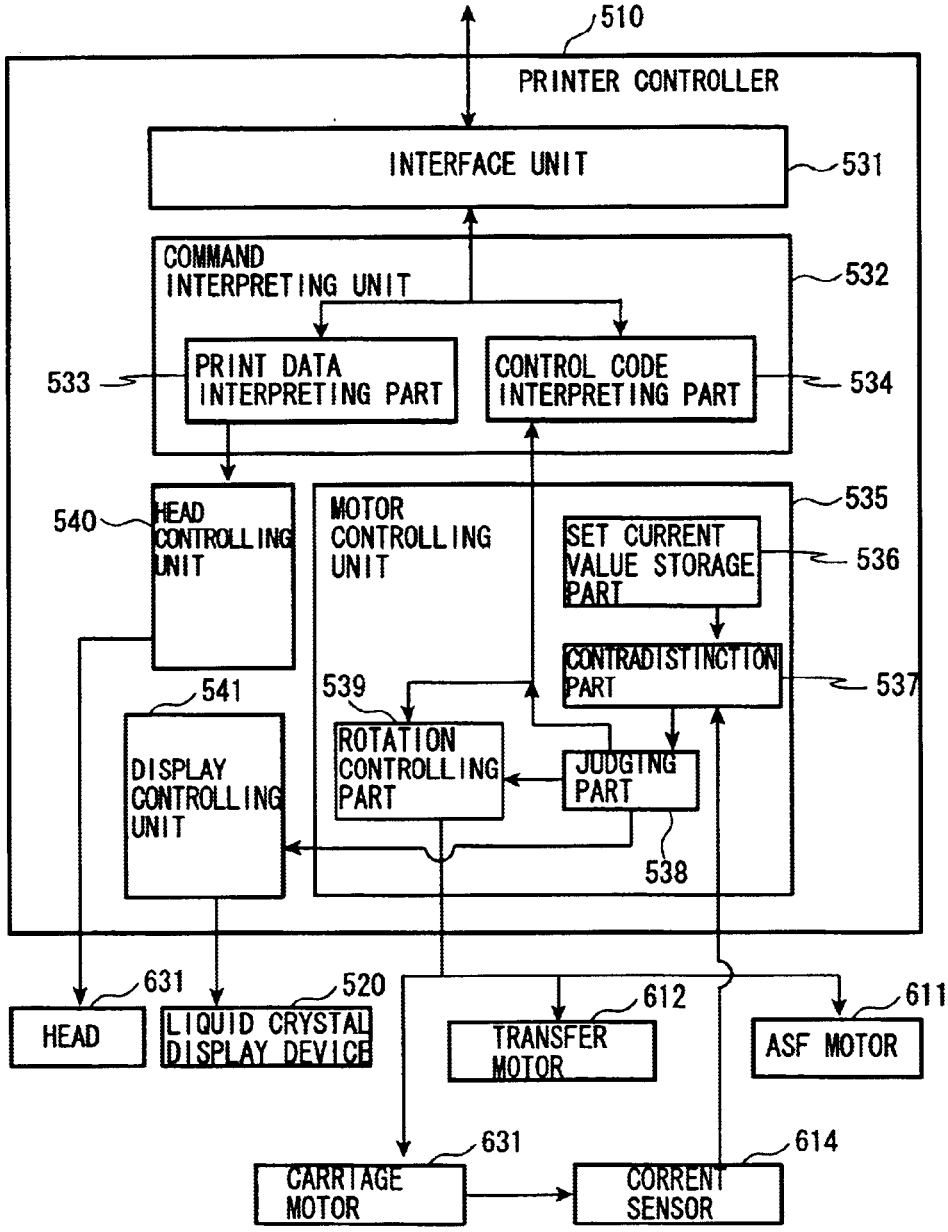
FIG. 29 is a block diagram showing the components of the print controller.

FIG. 29 is a block diagram showing the contents of a function in which a printer controller is included. A print command sent from a host computer is transmitted to a command interpreting unit 532. Print data and control code respectively are interpreted. In a normal print operation, an ASF motor 611, which is hardware, a transfer motor 612 and a carriage motor 613 are driven by a rotation controlling part 539 of a motor controlling unit 535 in accordance with a control content interpreted with a control code interpreting part.

On the other hand, image data in which a bit map is imaged are transmitted to a head controlling unit 540 and a recording head 631 is driven based on the data.

In the motor controlling unit 535, data of a slightly higher current value (e.g. 400 mA) is stored compared with a consumption current value when the carriage motor 613 is operated without a special load. An actual consumption current value is continually detected by the current sensor 614 during driving the carriage motor 613 and the value is supplied to a contradistinction part 537 as digital information.

The contradistinction part 537 compares a set current value (400 mA) with the actual detected current value. When the actual measured value is higher than the set value, this is transmitted to judging part 538. The judging part 538 judges whether the recording paper put into a printer is suited to a set paper gap by the following procedure and a processing is performed according to a judgment content.

FIG. 30 is a perspective showing a state where recording paper (transfer tray 546 in an example) is set at a print start position. Since the end of the recording paper is transferred with the sensors 620 to 622, printing is accomplished at an accurate position on the optical disk, which is set to the transfer tray. The details are omitted here.

In the present embodiment, a main feature is that the transfer tray 546, is provided under a main scan line on which the carriage 513 moves.

Figure 31A:
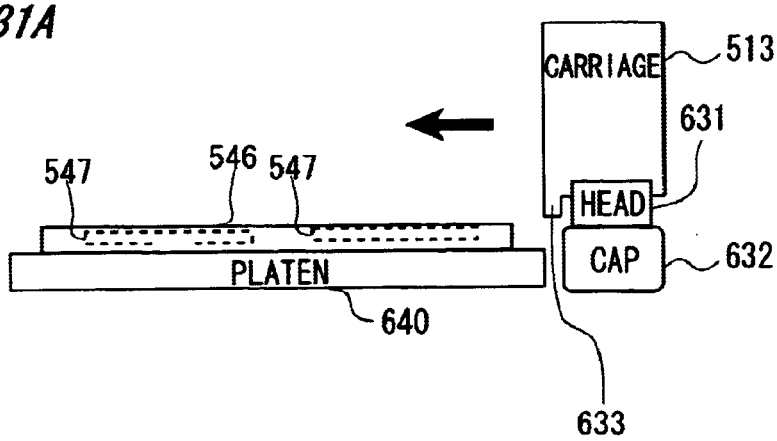
FIG. 31A is a diagram showing a confirmation operation of the thickness of the recording sheet.
Figure 31B:
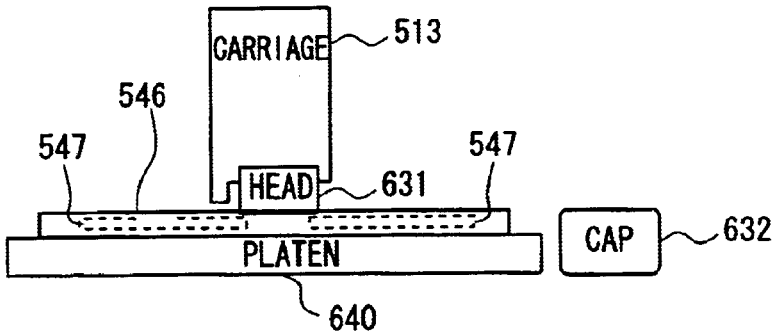
FIG. 31B shows the state where the suitability of the sheet is confirmed.

FIGS. 31A and 31B are views from the front of recording paper and a carriage on which the recording head is mounted.

FIG. 31A shows a state where the carriage is at, namely, home position and the recording head 631 is protected from drying by a cap 632. FIG. 31B shows a state where the paper thickness is confirmed prior to printing execution.

The confirmation operation is performed by moving the carriage 631 to a predetermined position on the recording paper. The controller 510 controlling each part of a print engine 600 (shown by surrounding with a projected line) controls the number of digits similar to the control at the time of normal printing operation, drives the carriage motor 613 (FIG. 29), and mainly scans the carriage in the direction of the arrow in FIG. 31A. For example, when print control is used to control width of paper in A4 size with where figures is performed, scan is performed to 40 figures.

When the paper gap of the printer is correctly set by the user at this time, the carriage is smoothly moved as shown in FIG. 31B. In contrast, when the paper gap is incorrectly set, a projection 633 provided on the side face of the carriage 513 is caught at the recording paper.

Figure 32A:
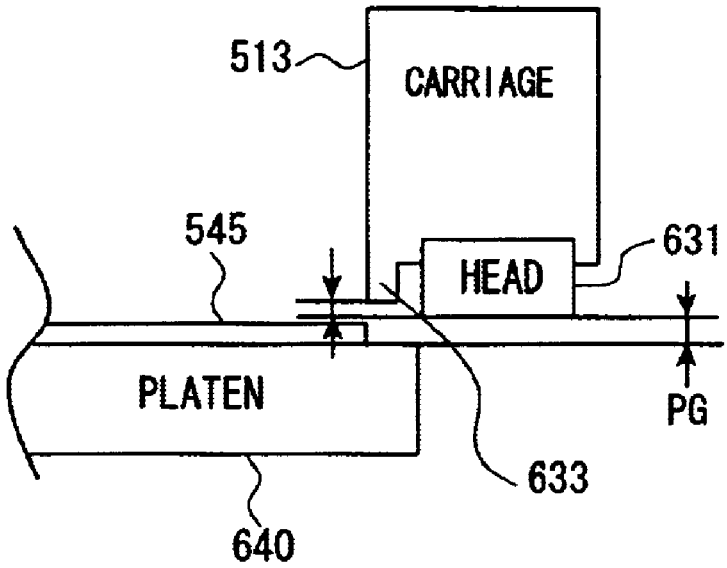
FIGS. 32A and 32B are side views illustrating the relationship between the size of the paper gap and the thickness of the paper. Each part shown in FIG. 31 is enlarged.
Figure 32B:
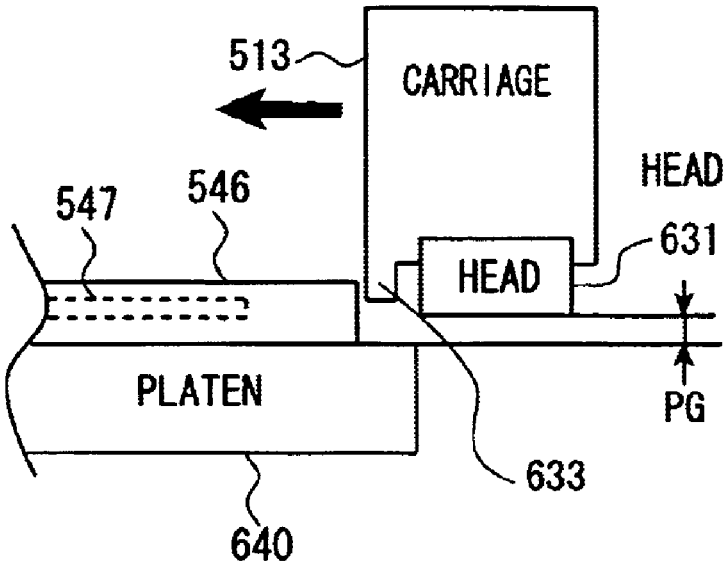

FIGS. 32A and 32B are views for explaining a relation between a size of a set paper gap and a thickness of paper. Each part shown in FIG. 31 is enlarged. In FIG. 32A, recording paper 545 is mounted on the platen 640, and the FIG. 32A shows a state where the paper gap (the value shown PG in figure) which is adjusted to thin paper is set. In FIG. 32B, the paper gap is set to thin paper, however, a state where the transfer tray 546 is mounted on the platen 640 is actually shown.

Figure 33:
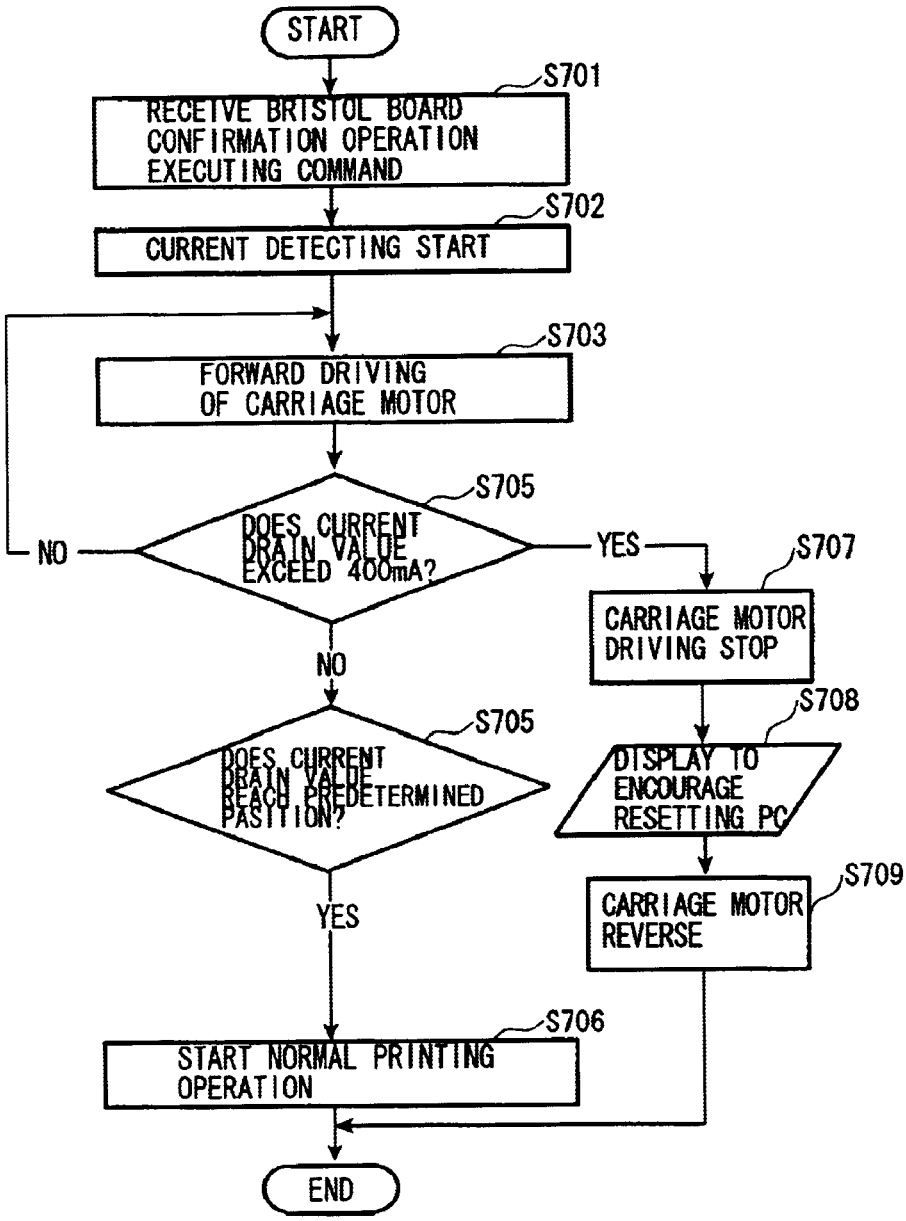
FIG. 33 is a flowchart explaining a control process in the motor controlling unit when the thickness of paper is confirmed in a state shown in FIG. 31A or a state shown in FIG. 32B.

FIG. 33 is a flow chart explaining a procedure in the motor controlling unit 535 when the thickness of paper is confirmed in a state shown in FIG. 31A or a state shown in FIG. 32B.

For example, in a state shown in FIG. 31, paper thickness confirmation operation is instructed prior to print command (S701 in FIG. 33) and the rotation controlling part 539 drives the carriage 613 and starts to move the carriage motor 613 in the direction of the arrow. At that time, the current sensor 614 monitors consumption current of the carriage motor 613 (S702 and S703). In this case, the consumption current value in the carriage motor 613 also does not exceed 400 mA ("NO" in S704). The carriage reaches a position shown in FIG. 31B, it is judged that there is no unsuitable paper, and the judging part 538 instructs the rotation controlling part 539 to perform normal print operation ("YES" in S705, S706).

On the other hand, in a situation like that depicted by FIG. 32B where the carriage 13 is moved in the direction of the arrow, the carriage-motor 613 receives a high load and the consumption current is abruptly increased for a short time. When the consumption current value detected by the current sensor 614 exceeds a predetermined value (400 mA), the contradistinction part 537 informs the judging part 538 of it ("YES" in S704). The judging part 53B judges that the paper is unsuitable and instructs the carriage motor 613 to stop (S707).

Since the judging part 538 encourages the user to reset the paper gap, the judging part 538 informs the display controlling unit 541 of the problem and a warning message is displayed on a liquid crystal display device 520 of the printer 501 (S708). The carriage motor 613 is rotated in an opposite direction by a rotation controlling part 539 and the carriage 513 is instructed to return to a home position.

At this time, if a host computer 502 is connected to the printer 501 that is capable of communicating in two ways, the judging part 538 may inform the host computer of that the paper gap is unsuitable for the recording paper. The host computer 502 displays a warning message via a function of a printer driver.

These procedures are repeated again when the user of the printer resets the paper gap in response to this process performed by the printer for responding to the unsuitability of the paper (S701 to S706).

Figure 34A:
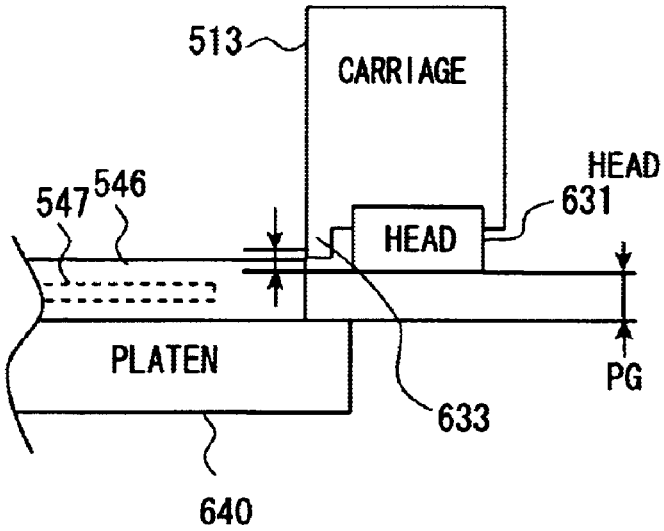
FIGS. 34A and 34B are side views illustrating why the projection has a predetermined margin for the recording head.

FIG. 34A is a view explaining why the projection 633 has a predetermined margin for the recording head 631.

In the embodiment, a transfer tray 546 embeds with the optical disk 547 therein to house the optical disk 547. A print face of the optical disk 547 is positioned at a lower position than the height of an end face of the transfer tray 546. If a bottom of the projection 633 is positioned at the same height as an opening face of each ink nozzle, the projection 633 is caught an end face of the transfer tray 546 except that the paper gap is set so that a distance from the nozzle to the print face is too far. The bottom of the projection 633 of the carriage 513 is offset at the slight upper side than a bottom face of the recording head 631.

Figure 34B:
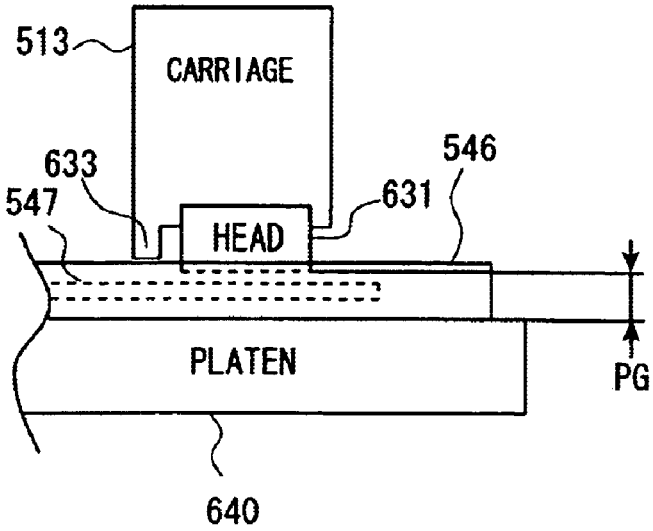
Figure 35:
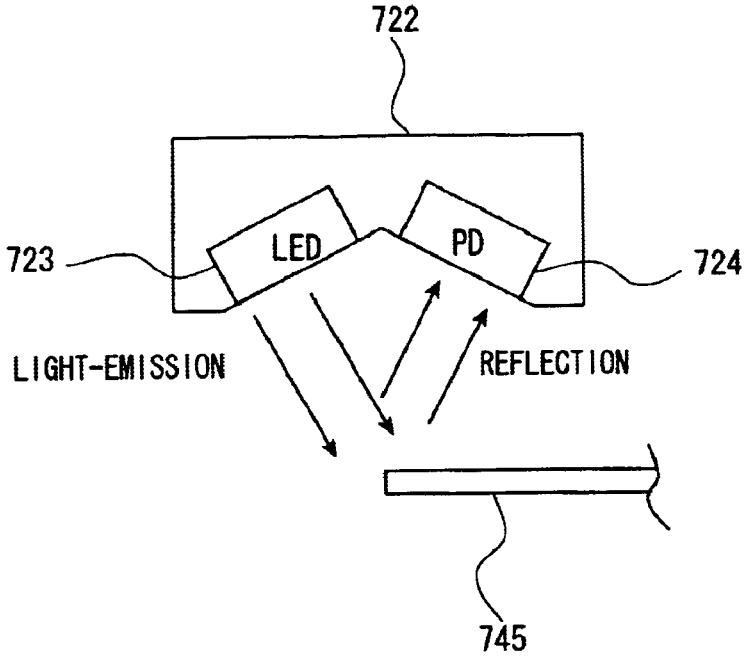
PRIOR ART FIG. 35
FIG. 35 shows an optical sensing element used when the leading edge of paper is precisely advanced.
Figure 36:
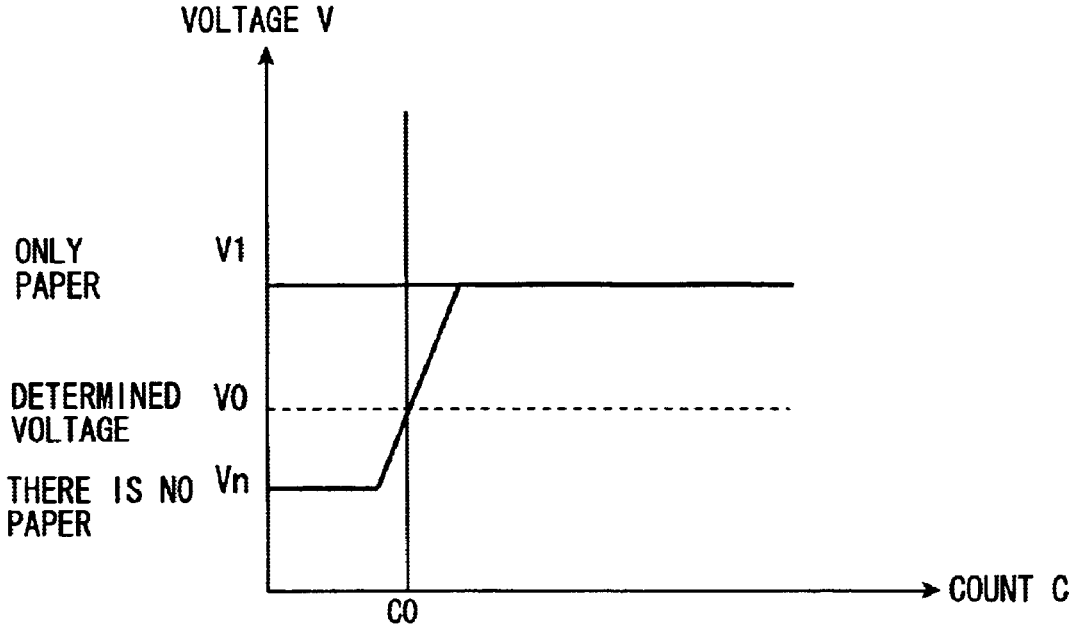
PRIOR ART FIG. 36
FIG. 36 is a graph showing change of an output voltage of the photo diode when paper is fed from the left-hand to the right-hand side in FIG. 35.
Figure 37A:
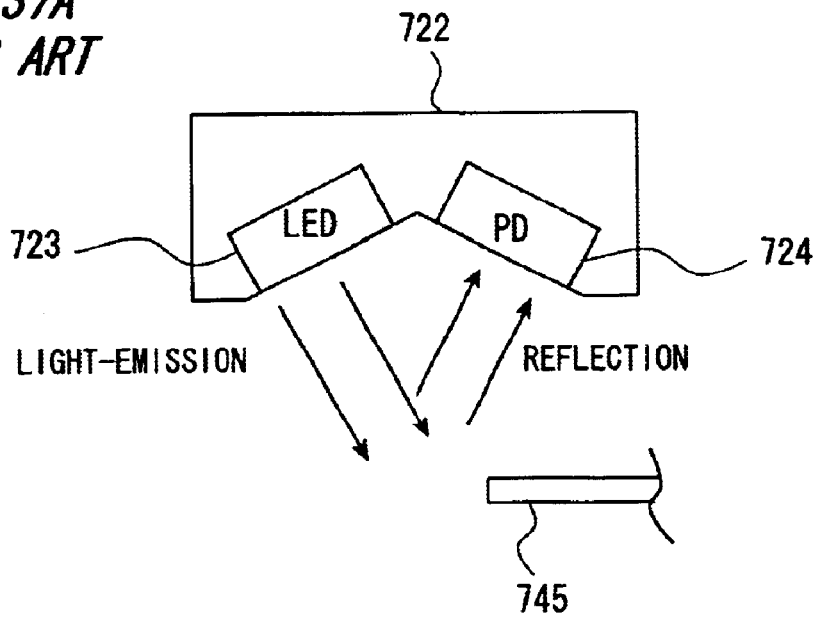
FIG. 37A PRIOR ART
FIGS. 37A and 37B respectively display a state where there is no paper and a state where there is paper in the graph of FIG. 36.
Figure 37B:
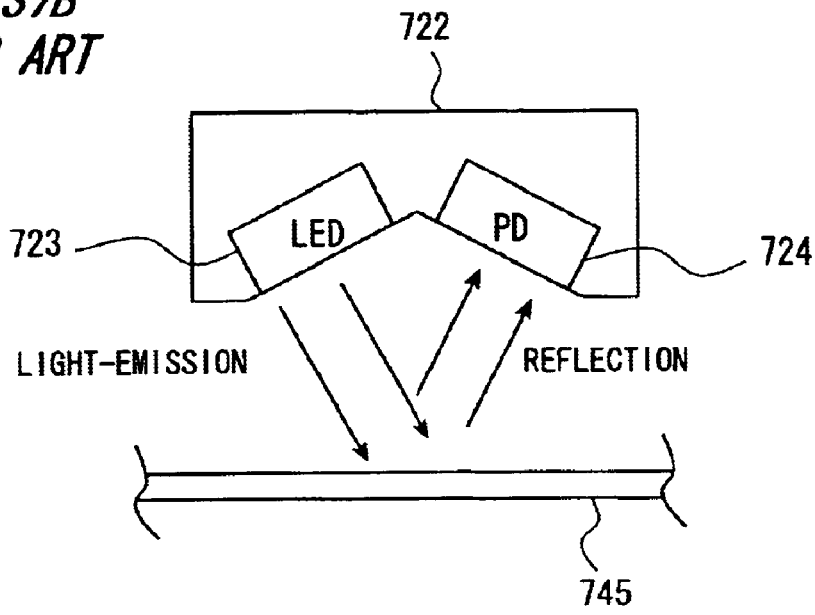
FIG. 37B PRIOR ART
Figure 38:
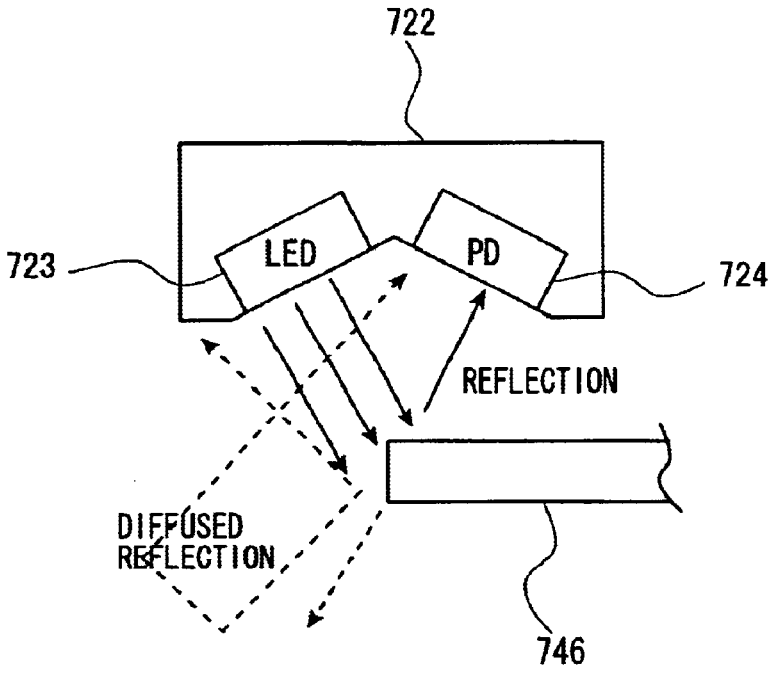
PRIOR ART FIG. 38
FIG. 38 is a diagram showing the transferring tray an end of which diffuses light beams.
Figure 39:
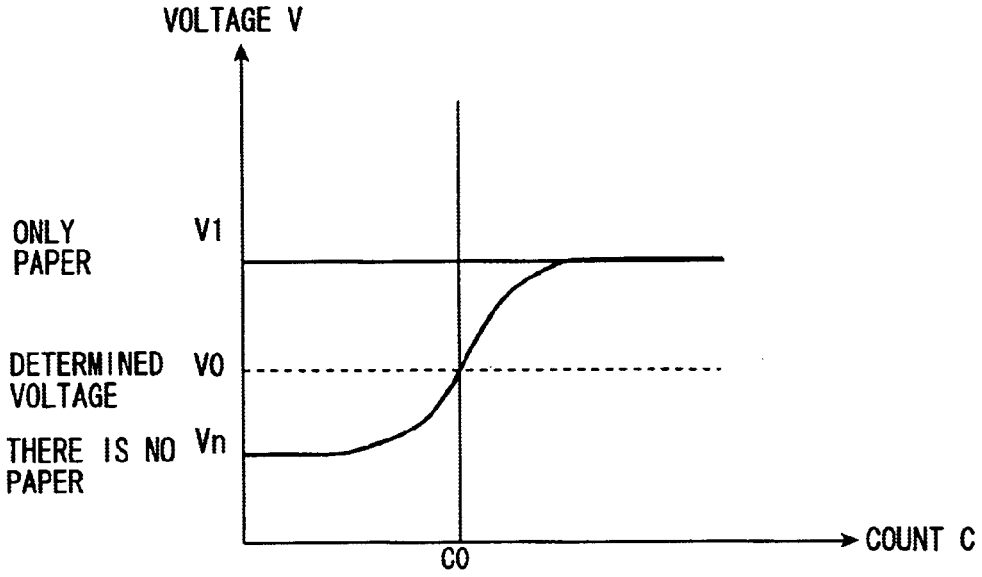
PRIOR ART FIG. 39
FIG. 39 shows output voltages of the photo diode when the transfer tray is fed. Due to diffusion, the output voltage increases slowly.
Figure 40:
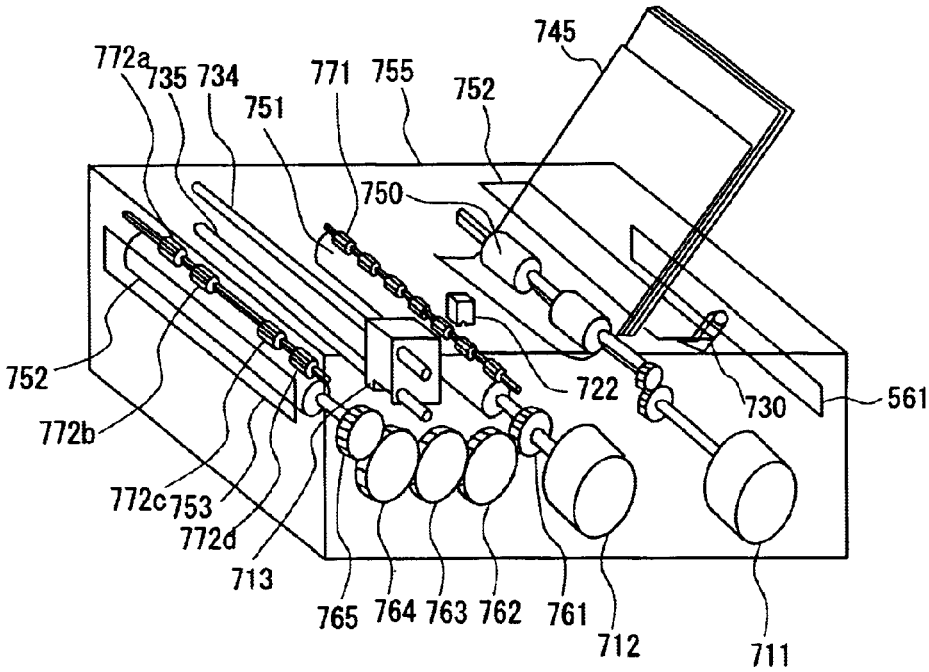
PRIOR ART FIG. 40
FIG. 40 is a perspective view showing the arrangement of optical sensors in the conventional printer.
Figure 41:
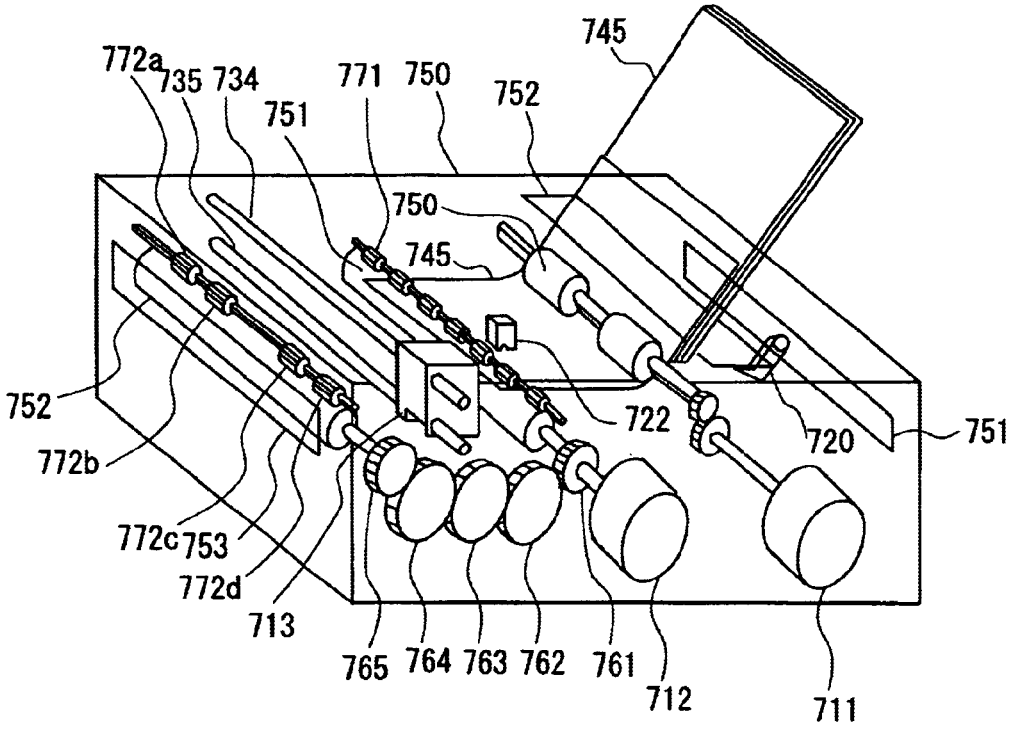
FIG. 41 is a perspective view showing the arrangement of optical sensors in the conventional printer.

By providing spacing, at the time of the actual print operation, a distance from an ink nozzle to the print face of the optical disk 547 is appropriately maintained. (See a bottom face of the recording head 631 shown with a hidden line in FIG. 34B). A size of spacing is set depending on the shape of the transfer tray 546, and it is not always necessary that the projection 633 is positioned at a higher position than the position of the recording head 631.

According to the present invention, it becomes possible to prevent operating errors resulting from errors in setting the paper gap and jamming of paper when extremely thick recording paper such as a transfer tray holding the optical disk are printed.

Figure 42:
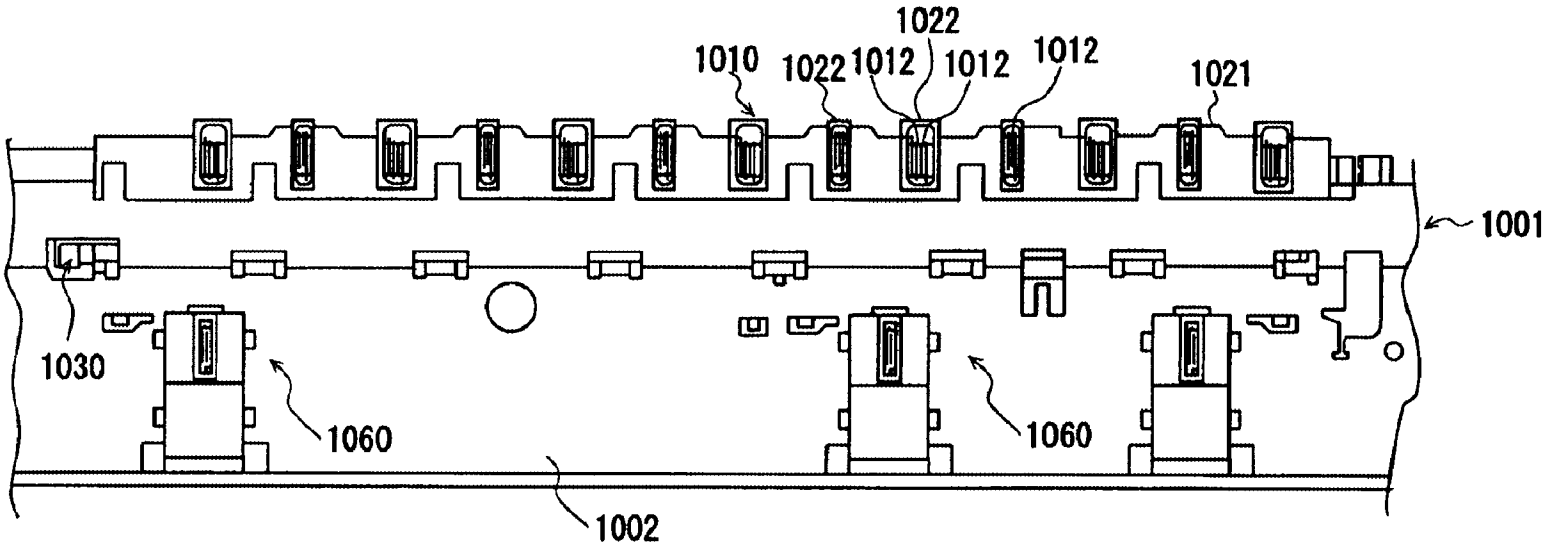
FIG. 42 is a top plan view showing a paper discharge following roller.
Figure 46:
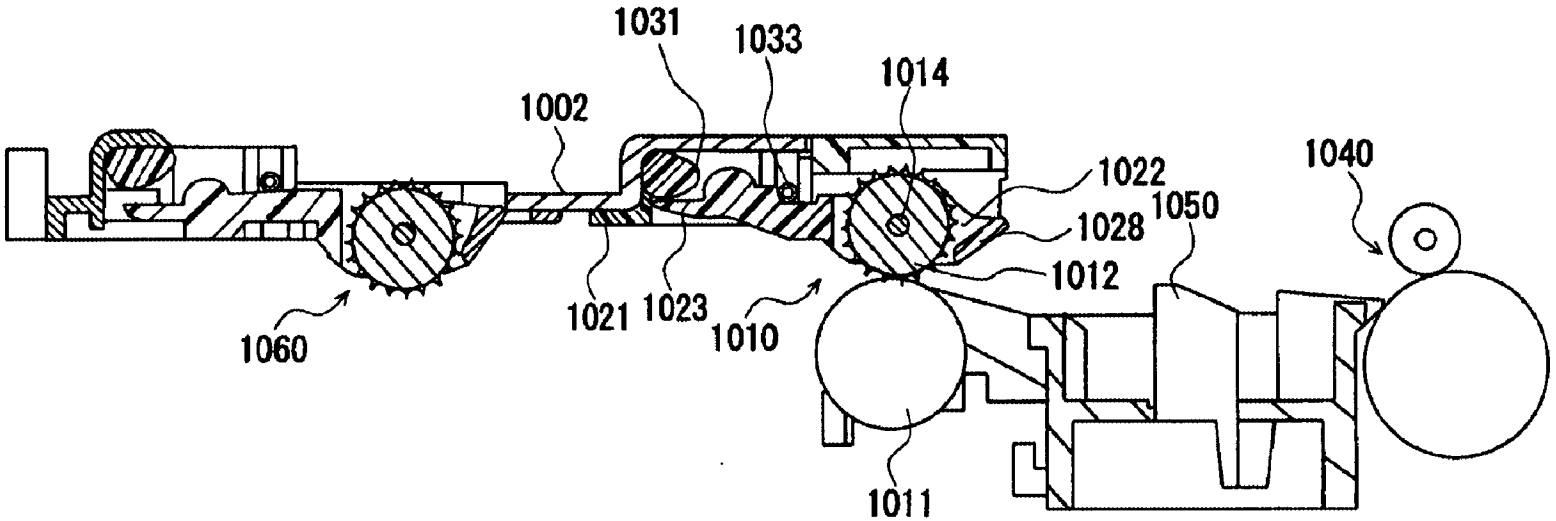
FIG. 46 is a cross-sectional view showing part of the paper discharge apparatus in the recording apparatus according to the invention.
Figure 47:
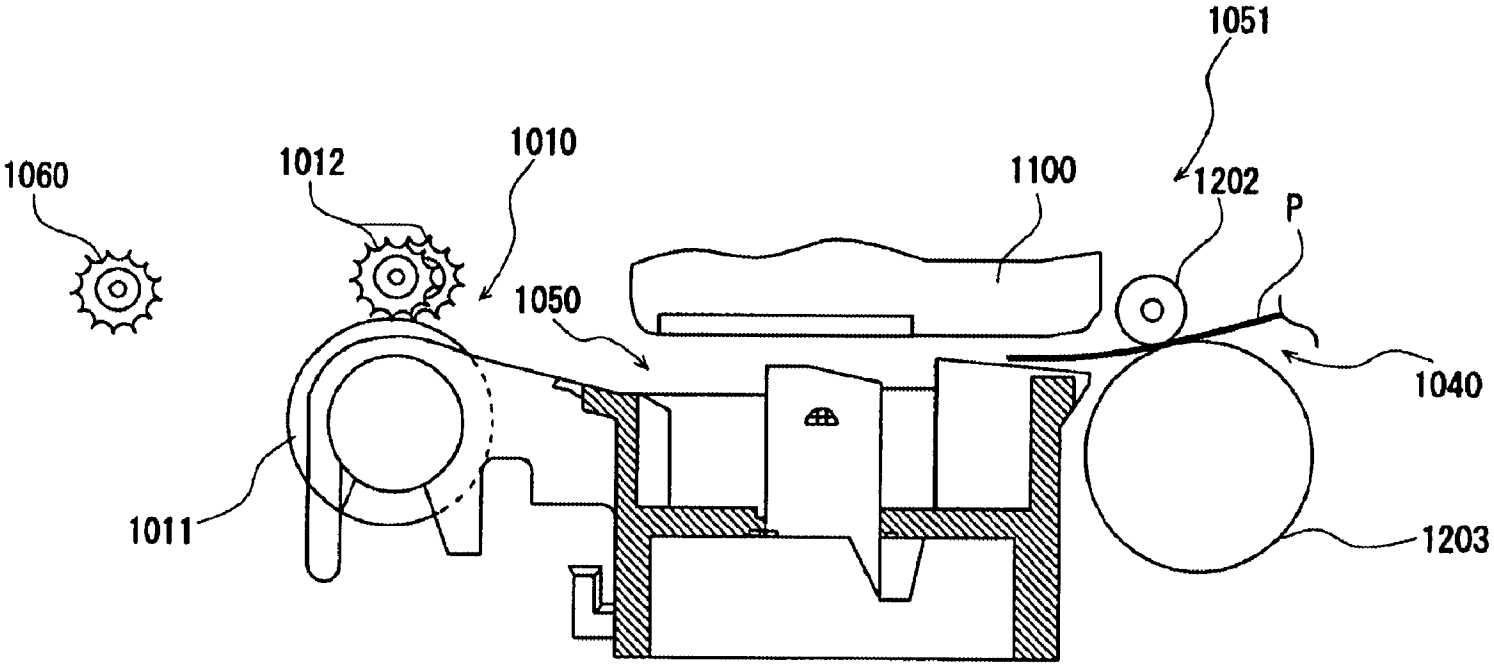
FIG. 47 is a sectional view showing part of the ink jet recording apparatus surrounding the recording region.

Following, an embodiment of another invention will be described referring to the figures. FIG. 42 shows a plan view of the arrangement of the paper ejection roller 1010 in the inkjet type recording apparatus. The roller 1010 is provided on a send-out following roller 1012 in a state where an upper part of a send-out following roller 1012 is exposed. The roller 1010 is aligned at several places in the main scanning direction according to the width of a sheet to be recorded P. A send-out roller 1060 is provided at a lower side of a transfer direction from the roller 1010. Normally, the number of the rollers 1060 is fewer than the number of the rollers 1012 and the roller 1060 is one part of a send-out apparatus (see FIG. 46). Description will be explained based on the roller 1012.

In FIG. 42, when the sheet to be recorded is forwarded, the sheet to be recorded is transferred from an upper side of the transfer direction (upper part in FIG. 42). The sheet to be recorded is sent to the outside of the recording apparatus via the roller 1060 provided at the lower side of the transfer direction (lower part in FIG. 42), while the sheet to be recorded by a driving roller (not shown) and the roller 1060. In a case of backward motion, the sheet to be recorded P is transferred towards upper part in FIG. 42. At this time, the roller 1012 is reversed. A forward direction is shown in a case where the upper part of the transfer direction and the lower part of the transfer direction are not specially mentioned.

Figure 43:
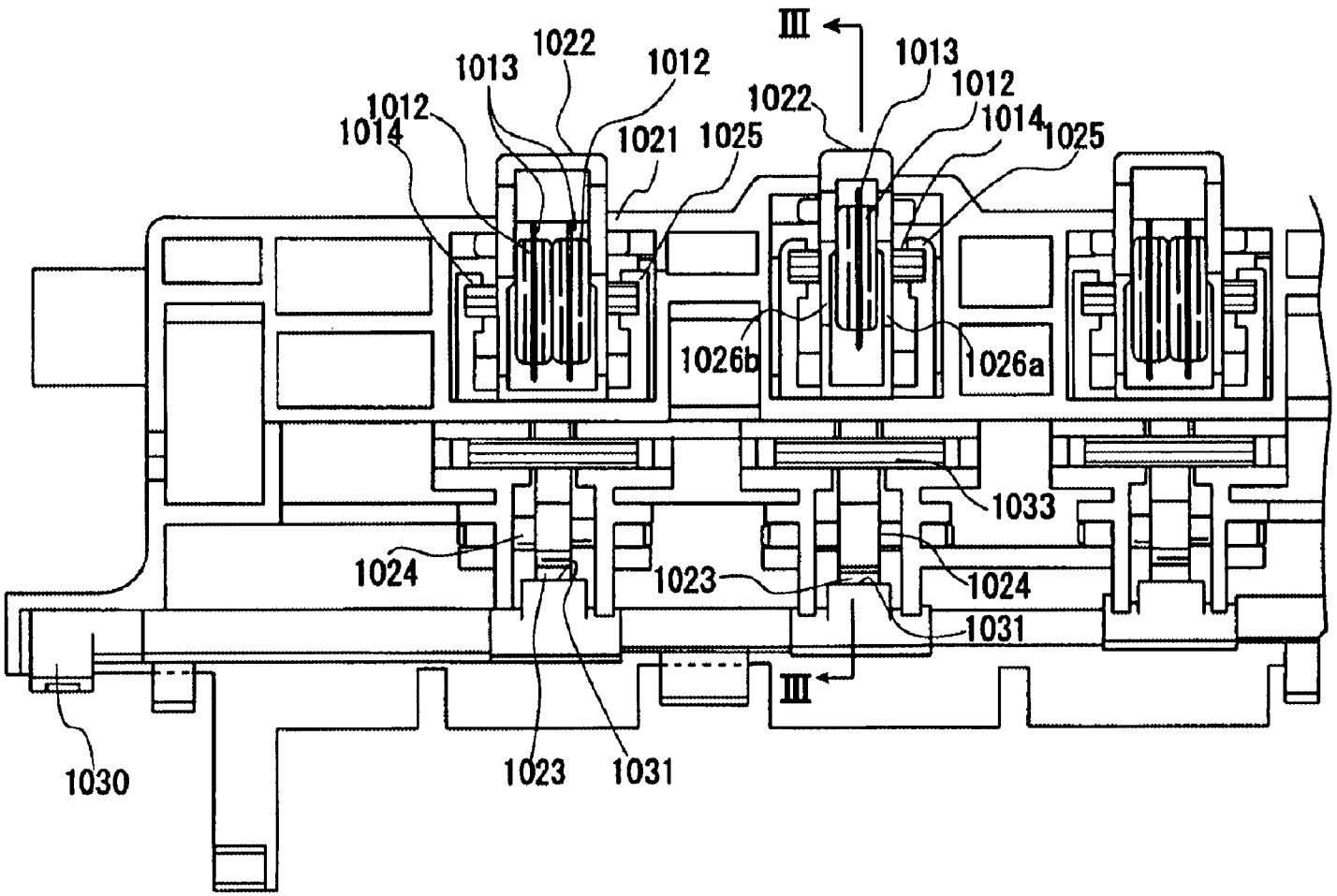
FIG. 43 is an enlarged view of a portion of FIG. 42 and depicts a state where a cover is removed in order to better show an internal configuration.
Figure 44A:
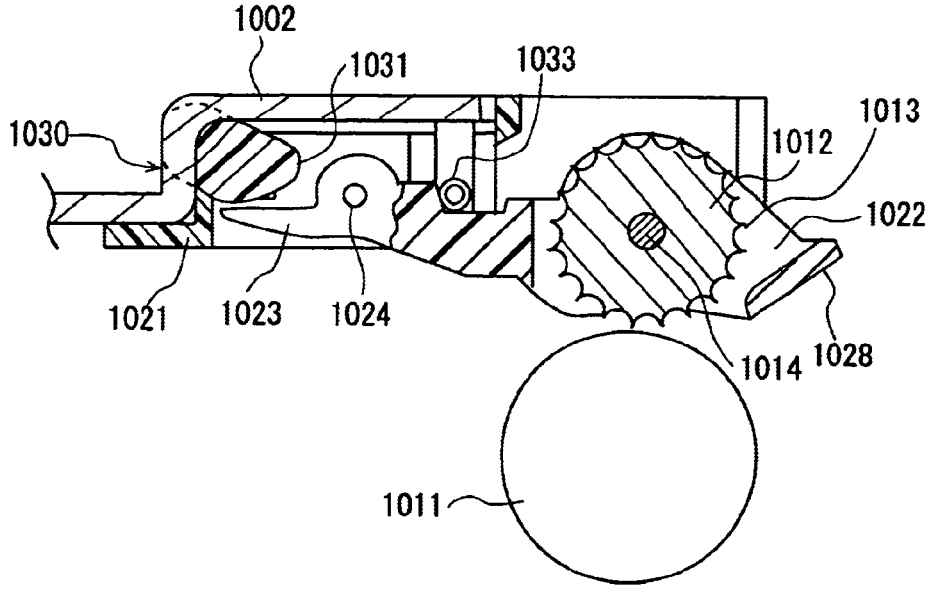
FIGS. 44A and 44B are cross-sectional views taken along line III—III in FIG. 43.
Figure 44B:
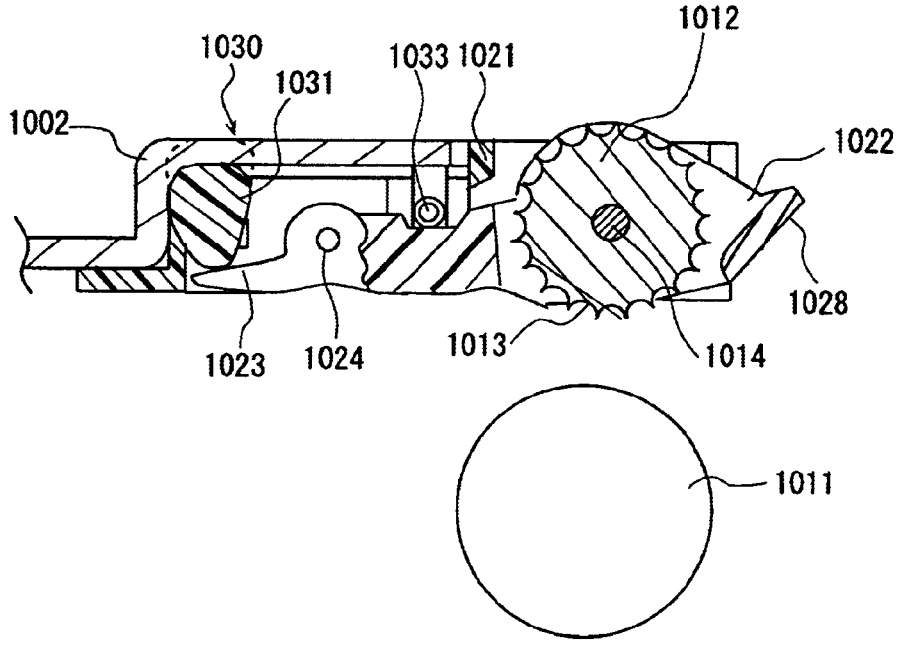

FIG. 43 is a view in which a main part of FIG. 42 is enlarged and shows a state where a send-out frame 1002 is taken off in order better display the internal configuration. FIGS. 44A and 44B are cross-sectional views of a main part of the III—III line in FIG. 43.

In the present embodiment, a holder for send-out following roller is comprised of a main holder 1021 as a first holder. The holder is comprised of several small holders 1022. The main holder 1021 itself is integrally formed in one-body and obtains a space capable of all small holder 1022 and the roller 1012. The small holder 1022 is held by the holder 1021. The holder 1022 has a cam follower 1023 of a cam 1031 at the proximal. As shown in FIGS. 44A and 44B, an end holding the roller 1012 is provided at a bearing part of a main holder (not shown) by referring a support part 1024 so that the holder 1022 is separated from the holder 1021 and can be swinging up and down. Up and down positions of the holder 1022 are switched by a cam mechanism comprised of the cam 1031 of a switching mechanism 1030 and a cam follower 1023.

The cam 1031 is rotatable and constitutes a release mechanism so that it is possible to switch into a state where the cam 1031 is contacted with a cam follower 1023 (FIG. 44B) and a state where the cam 1031 is not contacted with the cam follower 1023 (FIG. 44A) while the cam 1031 is rotated by operating the switching mechanism 1030. A bar spring 1033 pushes the small holder 1022 at a center part (upper side of transfer direction from a support part 1024) from the proximal side to the end side. The bar spring 1033 forces in a lower direction. When the cam 1031 is not contacted with the cam follower 1023, the distal side of the small holder 1022 is tilted in a lower direction. As the support part being a center, a position of the distal is a normal position so as to contact with the sheet to be recorded (FIG. 44A). The distal side of the small holder 1022 is swung in the upper direction as pivoting the support part 1024 against a force applied in downward direction by the base spring 1033 by contacting the cam 1031 with the cam follower 1023 using the switching mechanism 1030 and is shifted to evacuation position (Referring to FIG. 44B). By this release structure, one of two positions can be selected between the normal position (FIG. 44A), in which the following roller 1012 can be in contact with the sheet to be recorded, and the position, in which the following roller 1012 does not make contact with the sheet to be recorded (FIG. 44B).

A tilted face 1028 is provided at an end of the small holder 1022 and it is possible to lead transferred paper into a send-out passage (Roller 1012 and roller 1011 defined in FIG. 44) even if the small holder 1022 is either at a normal position or at an evacuation position.

The roller 1012 comprises double holders and a single holder that are alternately arranged. The double holder houses two following rollers 1012, each of which has teeth 1013 around its periphery, arranged in parallel as a pair inside one small holder 1022. The single holder houses one following roller 1012 inside the small holder 1022. The single roller is positioned further in the upstream side in the transfer direction than the position of the double roller. By this arrangement, the single roller has a role as a roller that prevents the sheet from jumping up.

Each of the following rollers 1012 is supported by the small holder 1022 such that each of the rollers 1012 can rotate around the axis 1014, independently. Furthermore, the axis 1014 penetrates through the wall bodies 1026*a* and 1026*b* of the small holder 1022 and is supported by the axis bearing part 1025, which is provided on both sides of the wall body 1026*a* and 1026*b*. Here, the axis 1014 may be a metal rod. The axis 1014 preferably is made of material that can elastically deform and has a core adjusting function. In the present embodiment, the bar spring is used as the axis 1014.

Figures 45A, 45B, 45C, 45D:
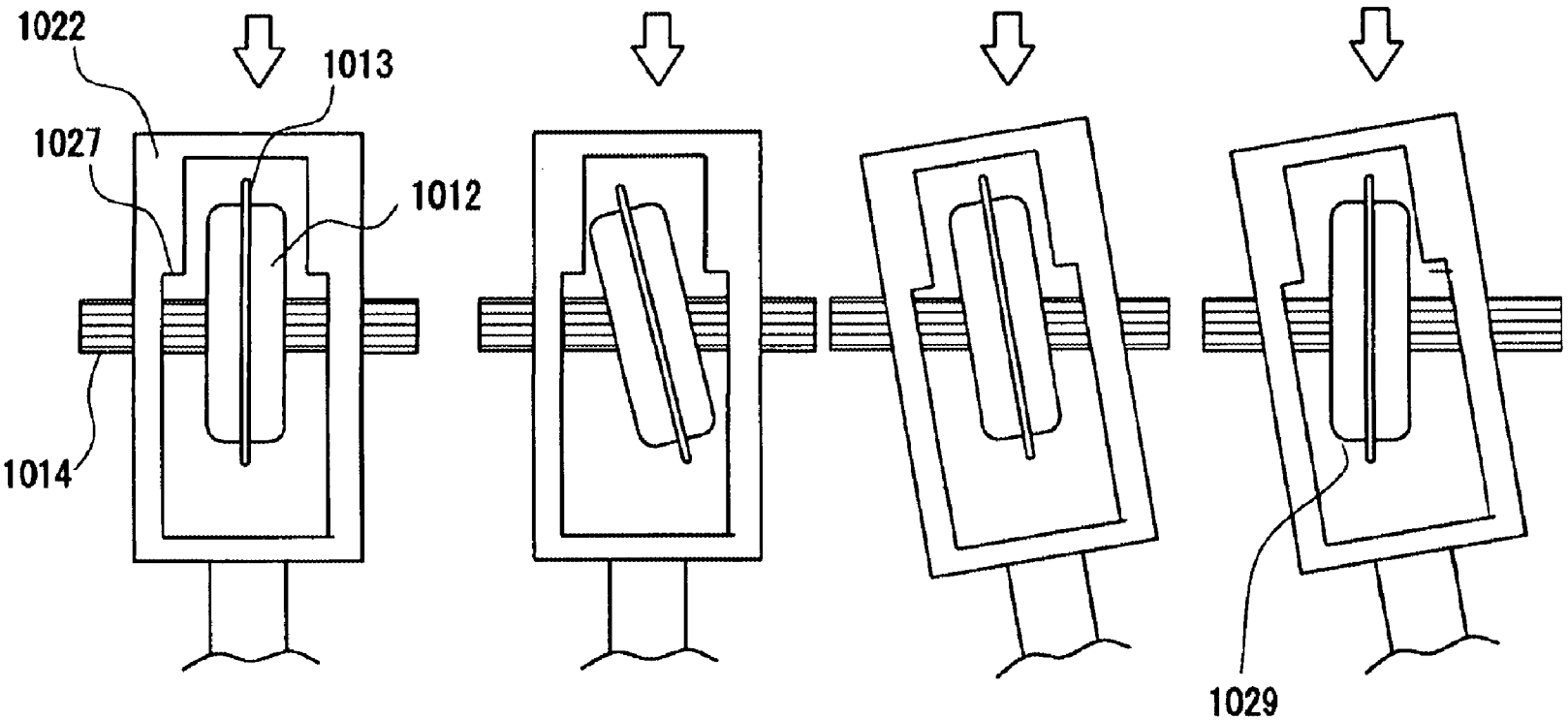
FIG. 45 is a schematic view showing the status of the paper discharge following roller and the holder when the recording medium is transferred.

In the present embodiment, the distance between the inside face of the wall body 1026*a* and 1026*b* becomes longer than that of the upstream side in the transfer direction by providing a step part 1027 (Refer to FIG. 45) on the inside face of two wall bodies 1026*a* and 1026*b* of the small holder 1022 at more upstream side than the supporting part of the axis 1014 in the transfer direction, that is, vertical direction in FIG. 45. By this structure, the space in the downstream side in the transfer direction inside the small holder 1022 is enlarged. Also, the space for allowing the following roller 1012 to be positioned parallel to the transfer direction of the sheet is formed. Therefore, the following roller 1012 can easily return to normal direction even when the small holder 1022 is slanted.

In the following, the principle in which the following roller 1012 returns to parallel condition is explained in FIG. 45. FIG. 45 exaggerates the characteristic of each part and a degree of slanting for convenience in explanation of the invention. Furthermore, the arrow in the drawing shows the direction for transferring the sheet.

There is a case where the roller 1012 is slanted from a state where the teeth 1013 is orthogonal to the paper to a state where the teeth 1013 is slanted to the right or left direction while the sheet to be recorded is transferred. The roller 1012 changes the direction of the roller 1012 inside the small holder 1022 from the direction parallel to a transfer direction (FIG. 45A) to the direction that is slanted from the transfer direction (FIG. 45B) in order to cancel the changes of the angle of the vertical direction.

On the other hand, the small holder 1022 originally serves to control the rotation direction of the roller 1012 and is constituted so that the small holder 1022 can be swung in an upper or lower directions of the small holder 1022.

Therefore, the supporting part 1024 that supports the small holder 1022 has a slight amount of room so that the supporting part 1024 can shake to the right or left direction on the supporting part 1024 as a bearing point. Because of the reason, with the change in direction of the roller 1012, the small holder 1022, which has a small room to receive the pivot movement in lateral direction with respect to the paper feeding direction, comes to be inclined by a distance of the pivot just like it is urged from inside against the discharge following roller 1012, and finally comes to a state where it stops at the inclination limitation point as shown in FIG. 44C. Here, the roller 1012 has a nature to return to the normal direction while rotating. However, because the small holder 1022 is still in the inclined state, the inner wall of the small holder 1022 prevents the roller 1012 from returning. If the recording medium is continued to be fed, the teeth 1013 may damage the recording surface of the recording medium causing fine recess or streaks because the discharge following roller 1012 cannot rotate smoothly. This may cause an undesirable exfoliation or picking of the surface of the recording medium and therefore printing quality may deteriorated.

According to the invention, a step part 1027 is located on an inner surface of the wall body 1026*a*, 1026*b* of the small holder 1022 so that a distance between the inner walls downstream in the paper feeding direction is made longer than a distance between the inner walls upstream in the paper feeding direction. Therefore, parts or members of the paper discharge following roller disposed at downstream in the paper feeding direction, which roller being to be returned to the normal direction, are allowed to be received within a space or relief space within the small holder 1022 widened by the steps 1027. Then the paper discharge roller 1012 can readily be returned to the normal direction as shown in FIG. 44D. Thus, to make the condition where the paper discharge following roller 1012 can be readily returned to the normal direction causes the time in which the teeth 1013 contacts the paper surface while kept in the inclined posture to be the shortest. Therefore, the result is that streaks on the surface of the recording medium, or exfoliation or picking on the coating paper can be avoided. In addition, the returning to the normal direction can be emphasized if the elastically deformable bar spring is used as a shaft body 1014 serving as an axis of rotation of the paper discharge following roller 1012 as in the present embodiment discussed above because of the core adjustment phenomenon.

As described above, the invention is described with reference to the ink jet type recording apparatus. However, the invention is not limited thereto or thereby. That is, the holder structure for the paper discharge following roller may also be applicable to other types of printers, copying machines, facsimile machines or the like having the same or similar recording medium discharging mechanism.

Figure 48:
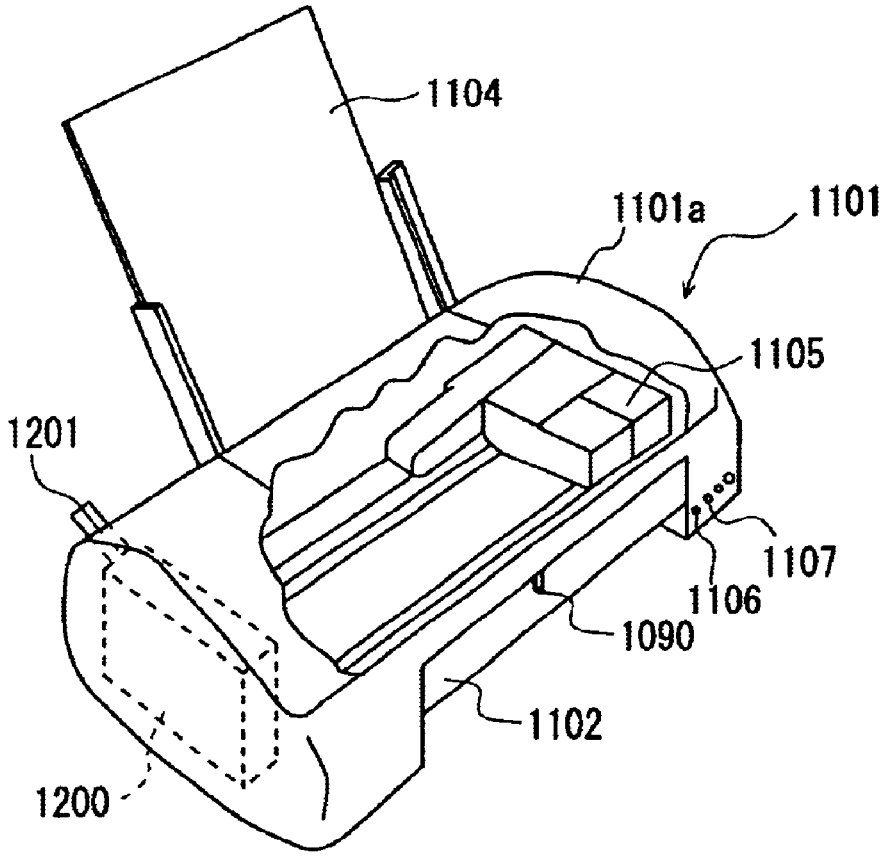
FIG. 48 is a perspective view showing an ink jet printer.
Figure 49:
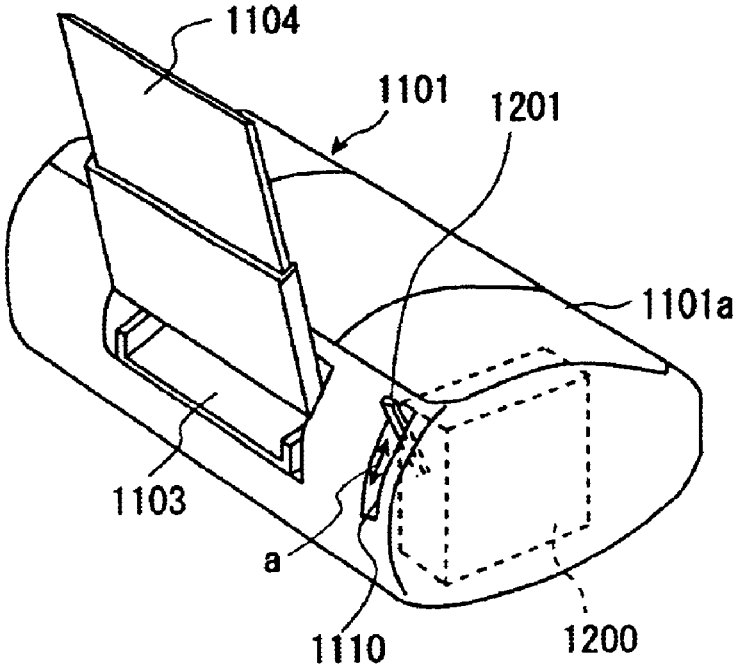
FIG. 49. is a perspective rear angle view of the ink jet printer in FIG. 48.

Next, a second embodiment of the present invention will be described with reference to FIGS. 48 through 71. FIG. 48 is a perspective view showing an ink jet printer according to a second embodiment of the invention. FIG. 49. is a perspective rear side angle view of the ink jet printer in FIG. 48. The ink jet printer is provided with a carriage 1105 in which a recording head 1100 is provided, a carriage driving mechanism (not shown), an auto sheet feeder (not shown), a paper gap switching mechanism/discharge following roller release mechanism/following roller separating mechanism 1200 in a body 1101 covered with a cover 1101*a*. Also, a discharge outlet 1102 is on the front face of the body 1102, and a hand feeder inlet 1103 is at the back face of the body 1101.

An auto sheet feeder tray 1104 is provided on the upper part of the outlet 1103 on the rear face of the body 1101. A control lever 1201 constituting a controlling mechanism 1120C (see FIG. 50) of a paper gap switching mechanism/discharge following roller release mechanism/following roller separating mechanism 1200 is projected from the body 1101 at the side of the outlet 1103.

The recording head 1100 has the ink cartridge (not shown) with a total of four colors, for example, yellow, magenta, cyan, black, and it is designed so as to be capable of being a full color printer. Ink jet timing of the recording head 1100 and scanning of a head driving mechanism are controlled by a dedicated controller held in the body 1101. Ink dot control with high precision and half tone processing are performed.

The sheet to be recorded is fed into the tray 1104, is automatically transmitted by the auto sheet feeder, and is sandwiched by a feeder main driver roller (not shown) and a following roller (not shown) further to be transmitted and then is sent out from the outlet 1102. The sheet to be recorded is fed by hand into the outlet 1103, is sandwiched by the feeder roller and the following roller similar to the above, and is transmitted. It is then sent out from the outlet 1102.

Normal paper, special purpose paper, recommended OHP sheet, glossy print paper, coated paper, coated film, label sheet, and post cards can be used as the sheet to be recorded, which is fed from the tray 1104. The thickness may vary, such as when cardboard or very thick cardboard is used (a tray for holding an information recording disk like a CD-R is included in this category) beside each piece of paper, that is, the printed material that is used may vary in thickness so that it is difficult to fold over.

The control lever 1201 constituting the control mechanism 1220C slides in step in a direction designated by the arrow along slit 1110 provided linearly on the body 1101 and can set the paper gap switching mechanism/discharge following roller release mechanism/following roller separating mechanism 1200. The paper gap switching mechanism can be adjusted by moving the recording head 1100 so that the distance between the paper face and a nozzle opening face of the recording head 1100, that is, the paper gap is almost always constant. The discharge following roller release mechanism can release up to a waiting avoid position where the discharge following roller is not in contact with the sheet to be recorded according to a kind of sheet to be recorded if required. The following roller separating mechanism applies pressure to the following roller to push the following roller to the main driving roller or releases pressure to separate the following roller from the main driving roller to sandwich the sheet to be recorded between the discharge main driving roller and the following roller or pull-out the sheet to be recorded from between the main driving roller and the following roller.

Figure 50:
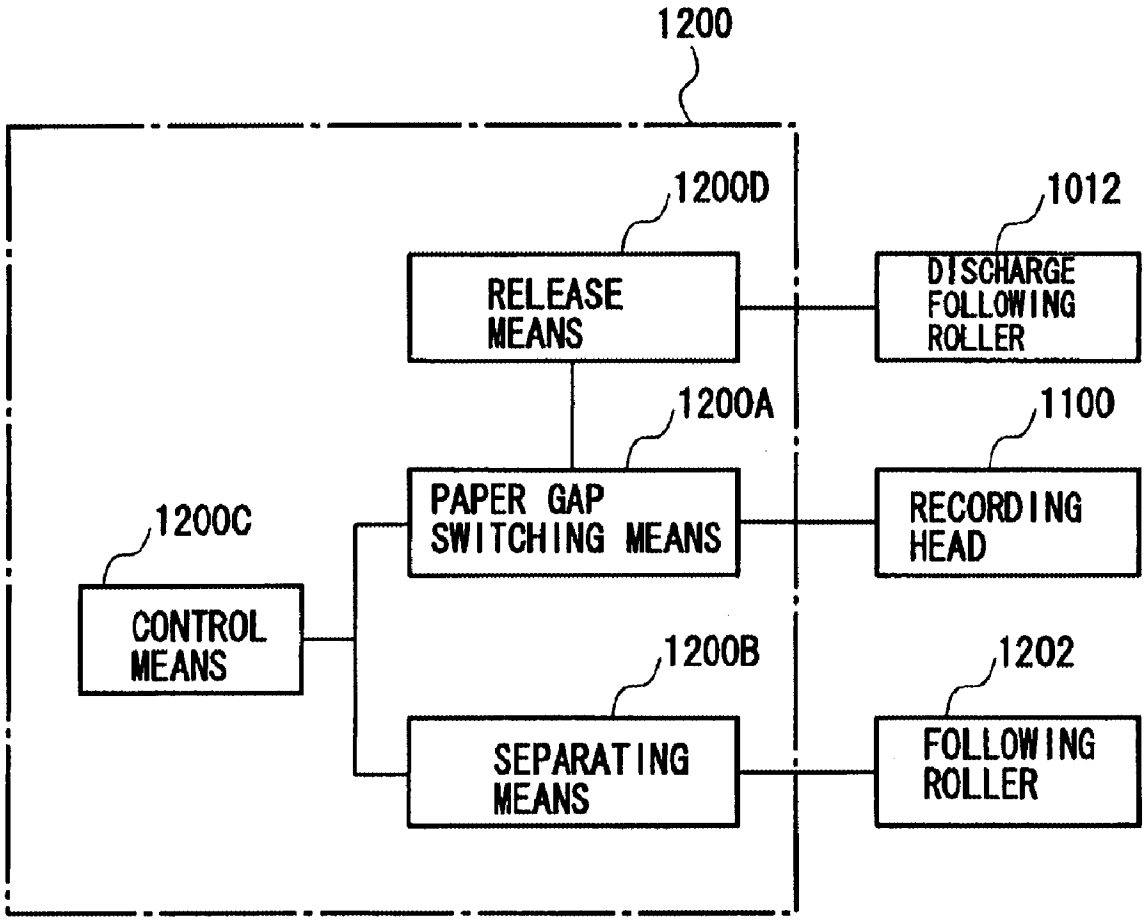
FIG. 50 is a block diagram showing the relationship between the control mechanism, the paper gap switching mechanism, the discharge following roller release mechanism, and the following roller separating mechanism 1200B in a paper gap switching mechanism/discharge following roller release mechanism/following roller separating mechanism.

FIG. 50 is a block diagram showing the relation of the control mechanism 1200C, a paper gap switching mechanism 1200A, discharge following roller release mechanism 1200D, and a following roller separating mechanism 1200B in paper gap switching mechanism/discharge following roller release mechanism/following roller separating mechanism 1200. Control mechanism 1200C is provided in association with the paper gap switching mechanism 1200A and the following roller separating mechanism 1200B mechanically shown in FIG. 50 and further the paper gap switching mechanism 1200A is associated with the discharge following roller release mechanism 1200D. That is, the slide operation in step of only one control lever 1201 constituting the control mechanism 1200C makes the paper gap switching mechanism 1200A, discharge following roller release mechanism 1200D, and the following roller separating mechanism 1260B operates and can set the recording head 1100, the discharge following roller 1012 and the following roller 1202 to a desired state.

Figure 51:
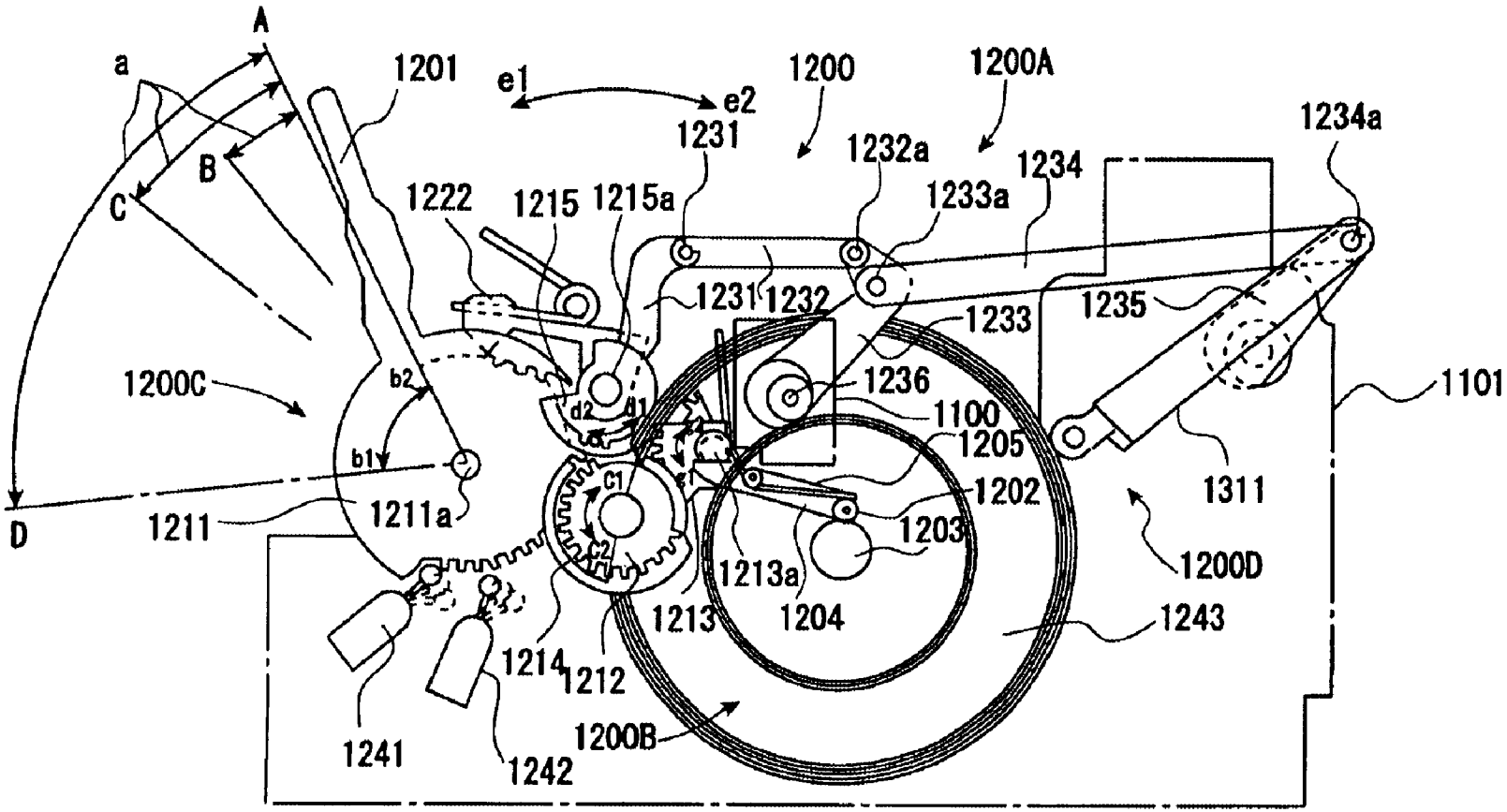
FIG. 51 is a side view showing a detailed example of the control mechanism, the paper gap switching mechanism, the discharge following roller release mechanism, and the following roller release mechanism.

FIG. 51 is a side view showing a detailed example of the control mechanism 1200C, the paper gap switching mechanism 1200A, the discharge following roller release mechanism 1200D, and the following roller release mechanism 1200B. The control mechanism 1200C contains a first intermittent gear 1211 having the control lever 1201, a second intermittent gear 1212 and a third intermittent gear 1214. The paper gap switching mechanism 1200A provides with an eccentric cam 1236 in which a carriage is set having a first link 1231, a second link 1232, a third link 1233, a four link 1234, a fifth link 1234, and the recording head 1100.

The discharge following roller release mechanism 1200D contains a cam shaft 1035 having a U-shaped receiving part 1317 and the cam 1031, a holder for the discharge following roller having the cam follower 1023, an arm part connected to the paper gap switching mechanism 1200A (6th link 1311) and a guide groove 1315 as a guide structure (See FIGS. 59–62). The following roller separating mechanism 1200B contains a 4th intermittent gear 1213 having an axis 1213*a* of which a part of circumference face is a flat face, a 5th intermittent gear 1215, a following roller arm at en end at which the following roller 1202 is rotatably set and is provided with a coil spring 1205.

The control lever 1201 is integrally formed so as to protect from a circumference part of the first intermittent gear 1211 and a ratchet 1222 is engaged with the first intermittent gear 1211. The control lever 1201 can be reciprocally rotated as shown in a direction designated by the arrow around the axis 1211*a* of the first intermittent gear 1211 and can determine a position of a position A, position B, position C, and a position D in the steps.

When the control lever 1201 is positioned at position A, this is the setting to use when recording on sheets of normal thickness, for example, normal paper. When the control lever 1201 is positioned at position B, this is the setting to use when recording on sheets are slightly thick, like cardboard. When a control lever 1201 is positioned at position C, this is the setting to use when recording on sheets that are very thick, for example, very thick paper including a tray for information recording disk. Further, when the control lever 1201 is then positioned at position D, the following roller 1202 is separated from the main driving roller 1203.

The first intermittent gear 1211 is provided so as to engage with the second intermittent gear 1212. The intermittent second gear 1212 is provided so as to be engaged with the fourth intermittent gear 1213. The third intermittent gear 1214, provided on the same axis with the second intermittent gear 1212, is provided so as to be engaged with the fifth intermittent gear 1215.

A center part of the coil spring 1205, an end is stopped at the following roller 1202 and the other end is contacted with the D axis 1213*a* of the fourth intermittent gear 1213, is stopped at an almost center part of the following roller arm 1204. The other end of a following roller 1204, at which the following roller 1202 is rotatably attached, is attached to an axis 1213*a*.

A free end of the first link 1231 of the first and second links 1231 and 1232, being L-shaped, connected by a hinge 1231*a* at axis 1215*a* of the intermittent fifth gear 1215. A free end of the second link 1232 is connected with the end part at a hinge 1233*a* of the third link 1233 of the third, fourth, and fifth links 1233, 1234, and 1235, being U-shaped, by hinges 1233*a* and 1234*a*, by the hinge 1232*a*. The free end of the third link 1233 is connected with the carriage 1105 via the eccentric cam 1236 and a free end of the fifth link 1235 is actually supported so as to be rotatable in the body 1101.

The sixth link 1311 is a crank shaped connection arm, and one end is connected with the hinge 1234*a* connecting with which the fourth and fifth links 1233 and 1234. The sixth link 1311 is stopped to a U-shaped receiving part (not shown) by a pin 1313 as a projecting part at the other end (see FIGS. 59 to 61).

Figure 66:
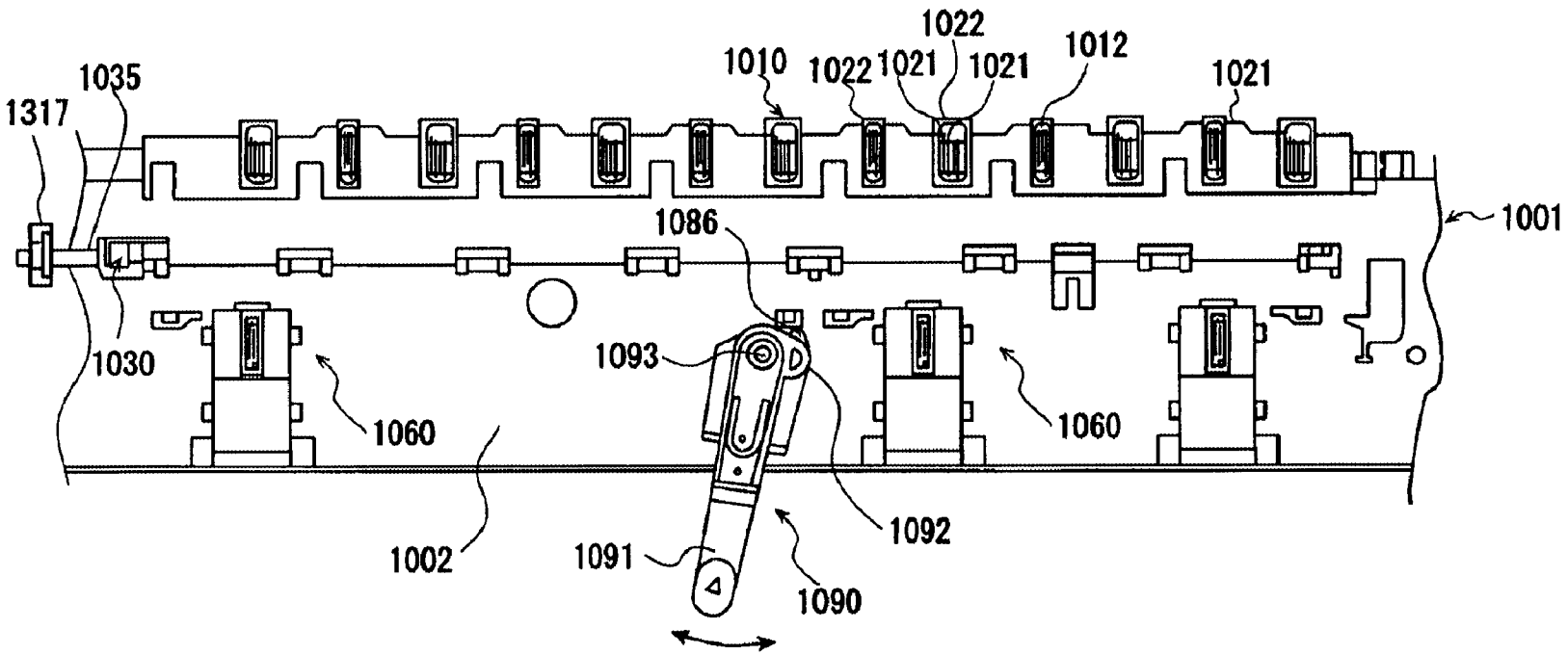
FIG. 66 is a front view of the ink jet printer showing the control part in the second release mechanism.

A holder for discharge following roller is constituted by a main holder 1021 as the first holder and a group of small holders 1022 as a second holder. The main holder 1021 itself is integrally formed and obtains a space capable of folding all of the small holders 1022 and the discharge following roller 1022 inside. The discharge following roller 1012 is arranged so that a pair of rollers having teeth 1013 on an outer circumference is stored in one of the small holders 1022. One roller is positioned at the slight upper side of the transfer direction from the pair of rollers as shown in FIG. 66.

Each discharge following roller 1012 is borne to the small holder 1022 so that the discharge following roller 1012 is rotatable by the axis 1014. The axis 1014 may be a metal bar, however, a flexible changeable axis having an elastic function 1014 is preferred.

An inclined surface 1028 is provided at the end part of the small holder 1022 and the sheet to be recorded can smoothly be read into a discharge passage (this is defined by the discharge following roller 1012 and the discharge driving roller 1011) at a position where the small holder 1022 is either at a normal position or at a waiting avoid position.

Although the small holder 1022 is held in the main holder 1021, the small holder has the cam follower 1023 of the cam 1031 at the proximal side. The proximal side holding the discharge following roller 1012, is moveable up and down, provided bearing a part of the main holder (not shown) by pivoting the supporting part 1024 so that the proximal side is separated from the main holder 1021. The bar spring 1033 pushes the holder 1022 at the center part (the upper side of the transferred direction from the supporting part 1024) from the proximal side to the end side of the small holder 1022 and forces it in a lower direction. Switching into an upper position and a downward position of the small holder 1022 is carried out by a mechanism comprised of the cam 1031 and the cam follower 1023.

Figure 62A:
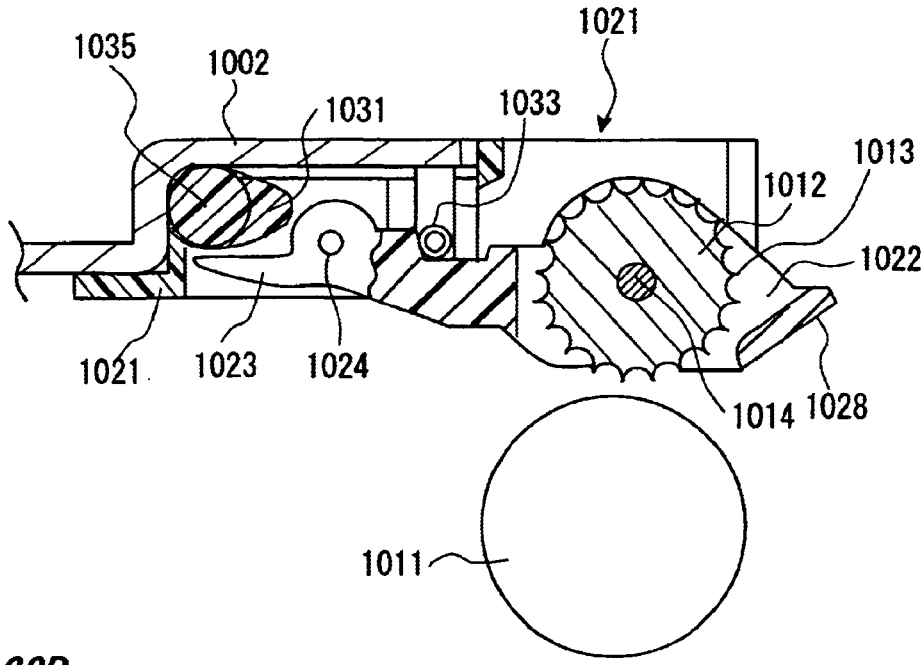
FIG. 62A is a diagram explaining the operation of the paper discharge following roller release mechanism.
Figure 62B:
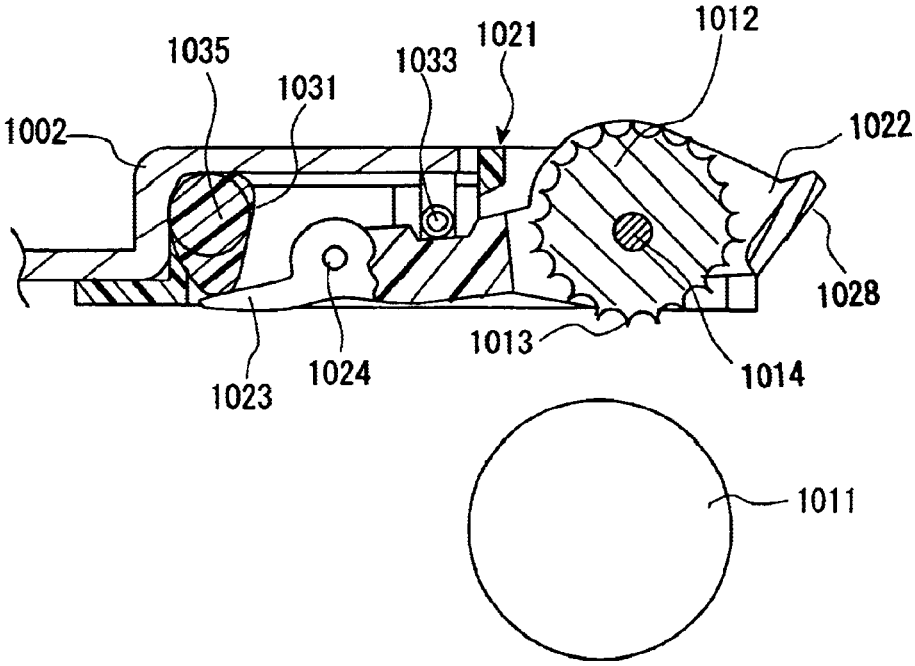
FIG. 62B is a diagram showing its released position.

In this example, the cam 1031 is capable of rotation and is designed so as to be capable of switching into a state where the cam 1031 is in contact with the cam follower 1023 shown in FIG. 62B and a state that it is not in contact with the cam follower 1023 shown in FIG. 62A. Thereby the release of the discharge following roller 1012 becomes possible. When the cam 1031 is not in contact with the cam follower 1023, the end side of the small holder 1022 moves down by pivoting the supporting part 1024 with a force of the bar spring 1033 and a position is a normal position capable of contacting with the sheet to be recorded (FIG. 62A). On the other hand, the end side of the small holder 1022 moves up by pivoting the supporting part 1024 against the force in a lower part with the bar spring 1033 and a position is transferred to the waiting avoid position by contacting the cam 1031 with the cam follower 1023 as best shown in FIG. 62B. The cam mechanism can select two positions, either a normal position where the discharge following roller 1012 can be in contact with the sheet to be recorded or the waiting avoid position where the discharge following roller 1012 is not in contact with the sheet to be recorded.

A limit switch 1241 turning on/off the auto sheet feeder and the limit switch 1242 turning on/off the printer by rotating the first intermittent gear 1211 is provided at the lower part of the first intermittent gear 1211.

An encoder 1243 used as a control when printing on the sheet to be recorded is provided to the main driving roller 1203.

Since the control mechanism 1200C operates three, system driving of the paper gap switching mechanism 1200A, the discharge following release mechanism 1200D and the following roller separating mechanism 1200B in series is provided, switching the paper gap, switching a release state of the discharge following roller, and switching a separating state of the following roller can be performed by operation of only the control mechanism 1200C. It becomes possible to smoothly switch the paper gap and operate the discharge following release and break the following roller separation without error. User friendliness can be improved.

Since each function of the paper gap switching, discharge following roller release, and following roller separation is integrated, structures of the control mechanism 1200C, the paper gap switching mechanism 1200A, the discharge following roller release 1200D, and the following roller separating mechanism 1200B are simplified. Design becomes simple and design error can be reduced. Manufacturing or assembly costs and labor costs can be reduced.

In a construction like this, the outline of the operation will be described relating to FIGS. 51–61. In a state of FIG. 51 when the control lever 1201 is positioned at position A, power from the coil spring 1205 pushed to the D axis 1213*a* is applied to the following roller 1202 so that the following roller 1202 pushes a paper P transmitted between the following roller 1202 and the main driving roller 1203. The recording head 1100 is set so as to be a paper gap ha matched with the paper P. The recording head 1100 thickness is about 0.6 mm or below including paper variety. The recording head 1100 is adjusted by moving so that the paper gap ha is about 1.2 mm.

Figure 59:
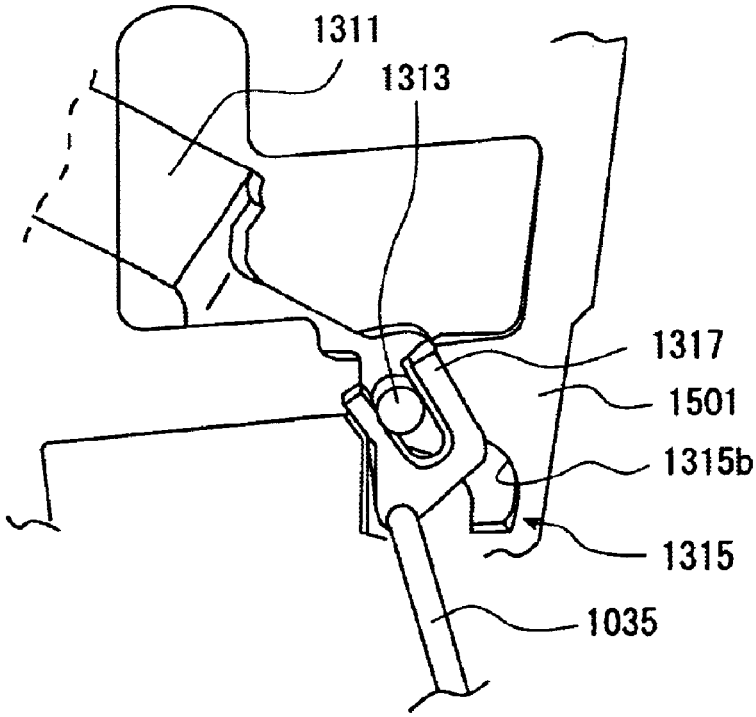
FIG. 59 is a perspective view showing part of the paper discharge following roller release mechanism in the same state as FIG. 51.

The sixth link 1311 is the most tilted and is shown in FIG. 51. The pin 1313 provided at the free end of the $6^{th}$ link shown in FIG. 59 is positioned around the end of the U-shaped receiving part and still does not push the U-shaped receiving part 1317. The cam shaft 1035 is not rotated and the cam 1031 is not in contact with the cam floor 1023 of the small holder 1022 as shown in FIG. 62A. The same following roller stays at the normal position and is able to stay in contact with the sheet to be recorded such as the paper. The limit switches 1241 and 1242 at this time are turned on and the lamps 1106 and 1107 shown in FIG. 48 provided on a front face of the body 1101 are lighted.

Figure 53:
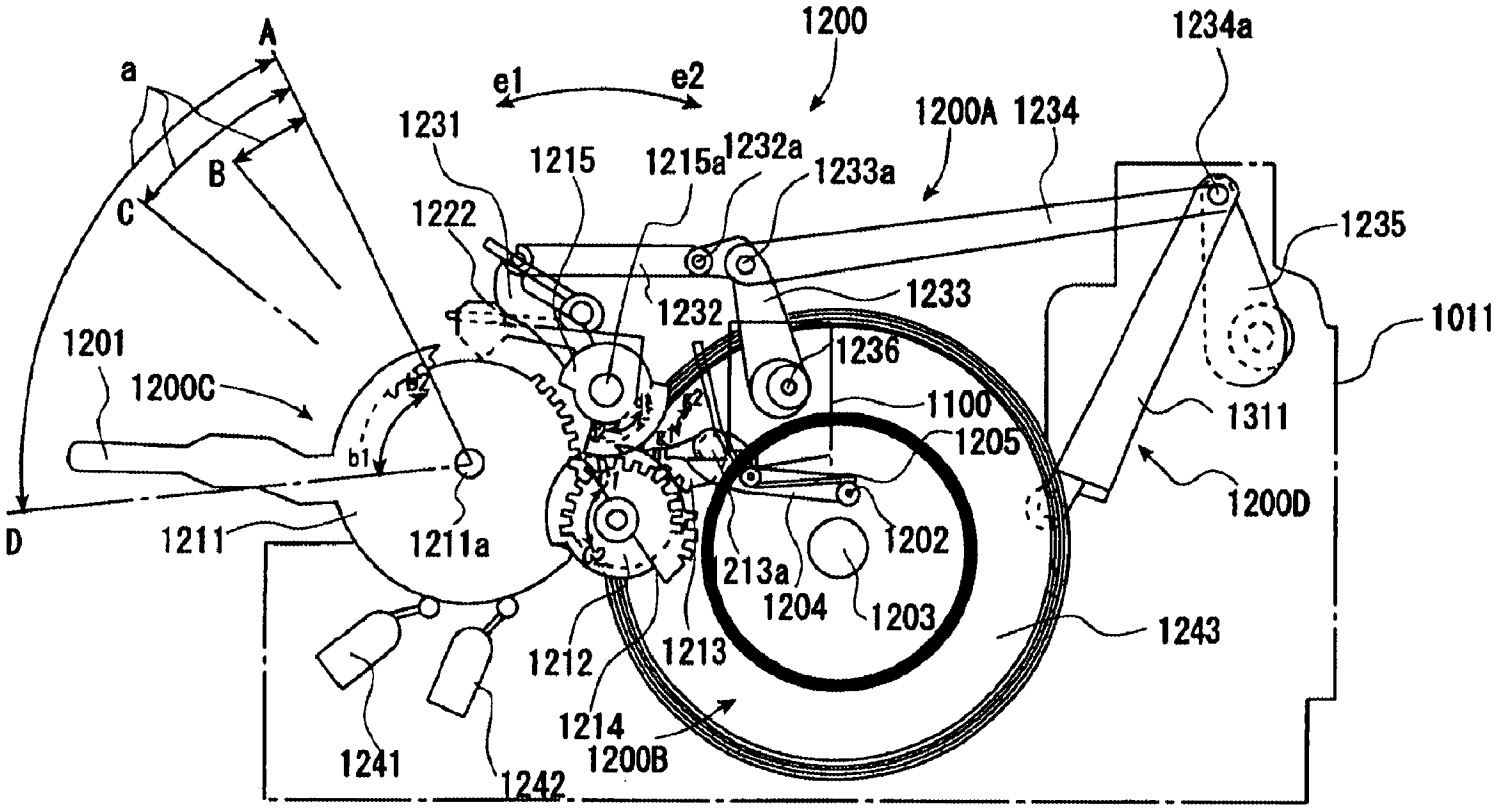
FIG. 53 is a side view showing the second operation of the paper gap switching mechanism/paper discharge following roller release mechanism/following roller spacing mechanism of the ink jet printer shown in FIG. 48.
Figure 54:
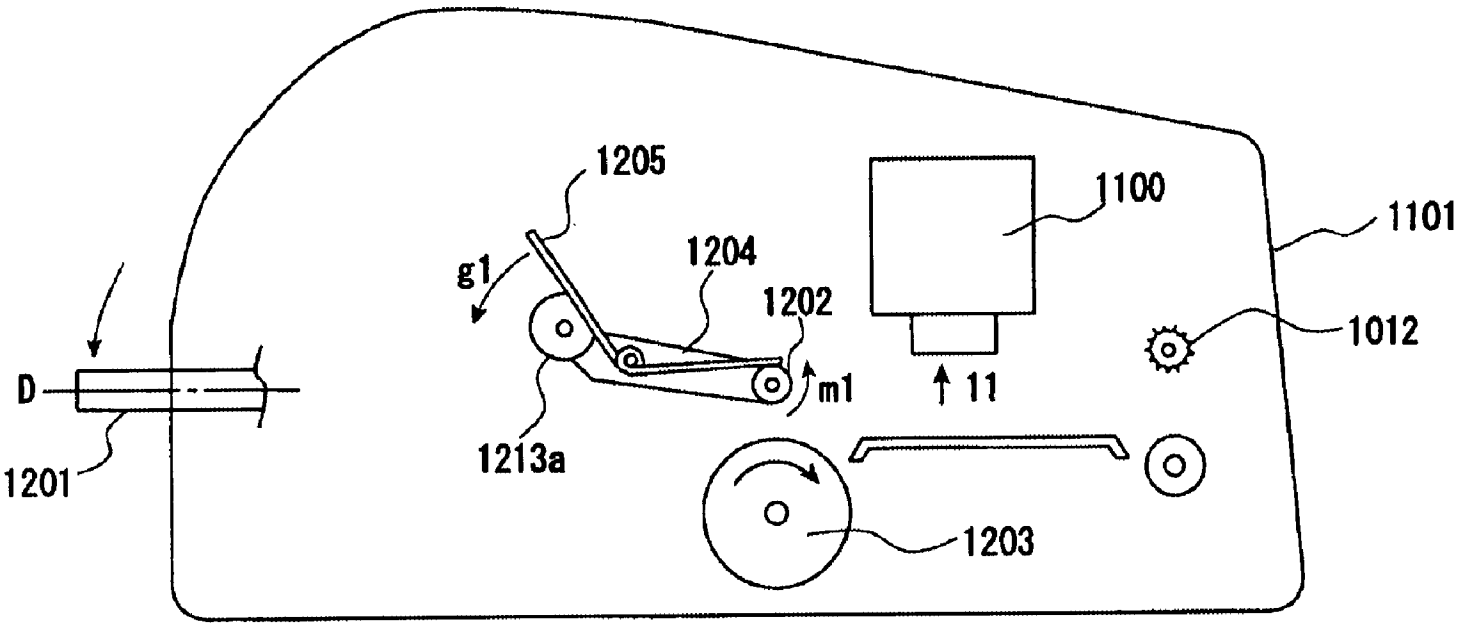
FIG. 54 is a side view showing the second operation of the paper gap switching mechanism/paper discharge following roller release mechanism/following roller spacing mechanism of the ink jet printer shown in FIG. 48.

Next in the state in FIG. 53, when the control lever 1201 is switched from position A to position D, the second intermittent gear 1212 and the fourth intermittent gear 1214 are first rotated in a direction designated by the arrow c1 and the fifth intermittent gear 1215 is further rotated in a direction designated by the arrow d1. As a result, since each of the links 1231–1235 is rotated in a direction designated by the arrow e1, the recording head 1100 is moved in a direction designated by the arrow a1, that is, it is moved up. Since the recording head 1100 has a thickness around 1.6 mm–2.5 mm including a variety of very thick paper, the recording head 1100 is moved up to about 2.8 mm.

In the way of operation, since the third intermittent gear 1213 starts to rotate in a direction designated by the arrow g1 as shown in FIG. 53, the coil spring 1205 is caught at a flat part of the D axis 1213*a* and the following roller 1202 is released from the force of the coil spring 1265 to be separated from the main driving roller 1203 into a direction as designated by the arrow ml.

A sixth link 1311 transfers to the most stand state by switching the control lever 1201 from position A into position B. The straight part 1315*a* of the guide groove 1315 from the end position of the U-shaped receiving part 1317 (see FIG. 59) to a position most deeply stopping to the U-shaped receiving part 1317.

Figure 60:
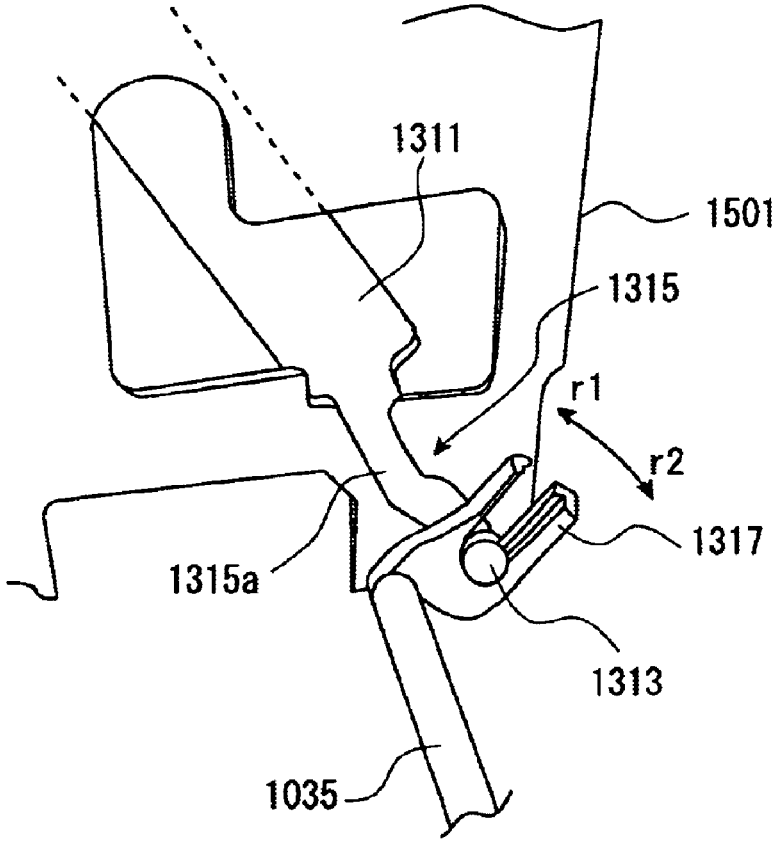
FIG. 60 is a perspective view showing part of the paper discharge following roller release mechanism in the same state as FIGS. 53 and 57.

The pin 1313 pushes the U-shaped receiving part 1317 to rotate the U-shaped receiving part 1317 in a direction designated by r2 in FIG. 60 along an arc part 1315*b* of the guide groove 1315. As a result, the cam shaft 1035 is rotated and become 1031 is contacted with the cam follower 1023 of the small holder 1022, then the proximal side of the small holder 1022 moves down. The end side of the small holder 1022 is swung against the force of the bar spring 1033 by pivoting the supporting part 1024 and the discharge following roller 1012 is moved to a position where it is not contacted even if the very thick paper such as CD-R tray is inserted. The discharge following roller 1012 in this state (waiting position) is changed from the normal position up to approximately 3 mm. It is possible that all of the discharge following rollers 1012 are to be released to the waiting position. The released discharge following roller 1012 in a plurality of discharge following roller 1012 arranged with direction of the sheet to be recorded inclined with a predetermined width. Only the discharge following roller 1012 of a part corresponding to a width of the CD-R is released viewed from the U-shaped receiving part 1317.

Since extra load to the cam shaft 1035 is not needed, a stable release can accurately be carried out.

In this state, both the limit switches 1241 and 1242 are turned off, and lamps 1106 and 1107 arranged in front of the body 1101 shown in FIG. 48 is operated to turn on and off.

Figure 55:
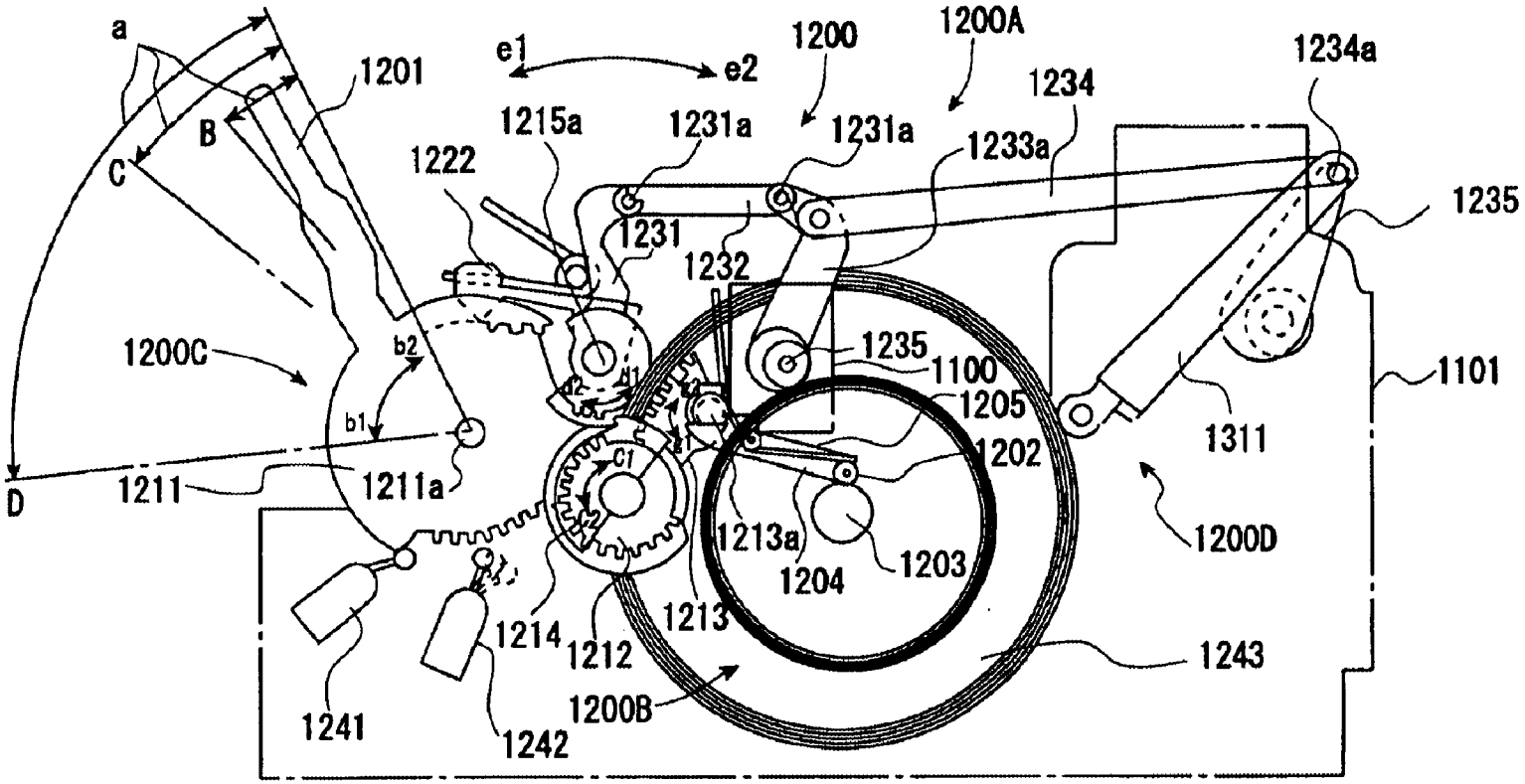
FIG. 55 is a side view showing the third operation of the paper gap switching mechanism/paper discharge following roller release mechanism/following roller spacing mechanism of the ink jet printer shown in FIG. 48.
Figure 56:
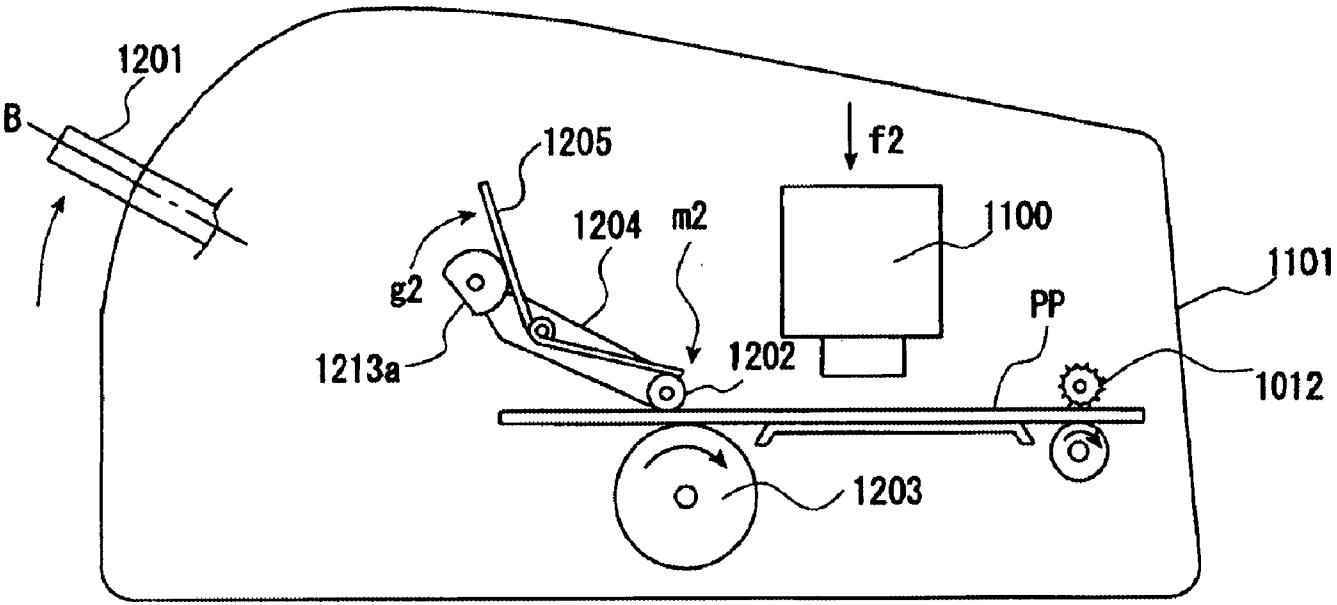
FIG. 56 is a side view showing the third operation of the paper gap switching mechanism/paper discharge following roller release mechanism/following roller spacing mechanism of the ink jet printer shown in FIG. 48.

Next, in a state shown in FIG. 55, that is, when the control lever 1201 is set to position B from position D, the first intermittent gear 1211, rotates along an arrow b2 in the drawings while fourth intermittent gear 1214 rotates around an arrow c2 as well as the second intermittent gear 1212 rotates and, in addition, a fifth intermittent gear 1215 rotates along an arrow d2. Because of these operation, each of the links 1231 through 1235 rotates along an arrow e2 and, therefore, the recording head 1100 moves toward an arrow f2, i.e., moving down.

Figure 52:
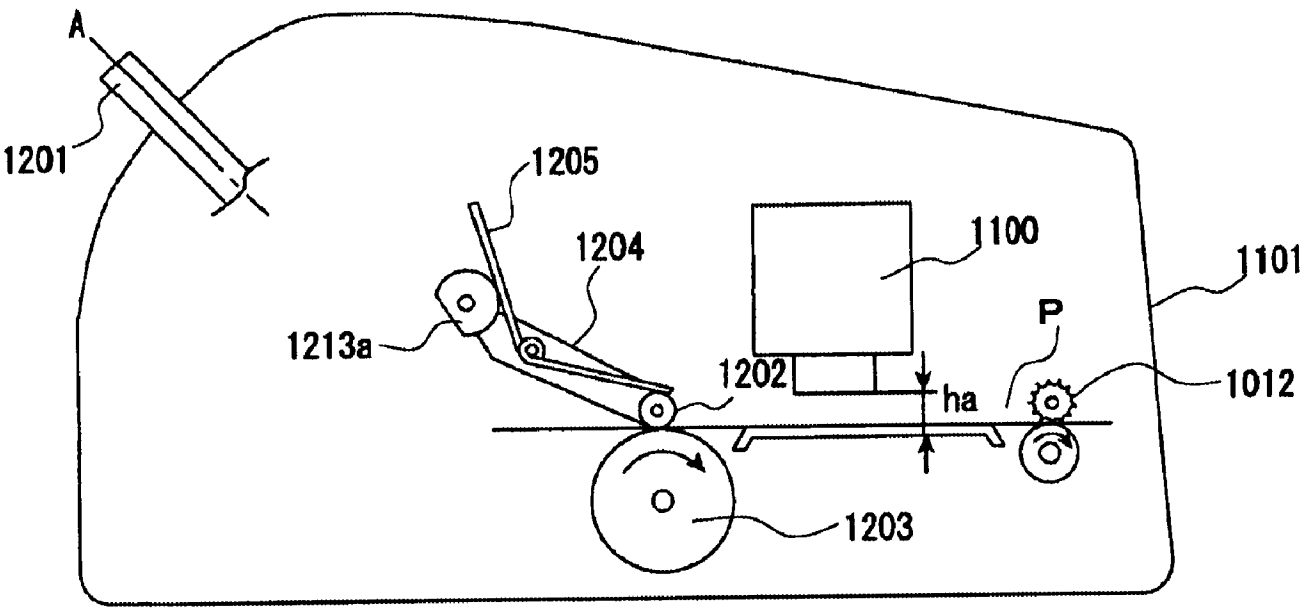
FIG. 52 is a side view showing the first operation of the paper gap switching mechanism/paper discharge following roller release mechanism/following roller spacing mechanism of the ink jet printer shown in FIG. 48.

The recording head 1100 is adjusted by moving to a position spaced around 1.5 mm from a position of the normal paper in FIG. 52. At the same time, since the third intermittent gear 1213 is rotated in a shown arrow g2 direction as shown in FIG. 55 and the coil spring 1205 is pushed to the D axis 1213*a*, a resilient force of the coil spring 1205 pushing to the D axis 1213*a* is applied so that the following roller 1202 is rotated in a shown arrow m2 direction and the following roller 1202 pushes the cardboard P transmitted between the following roller 1202 and the main driving roller 1203.

Figure 61:
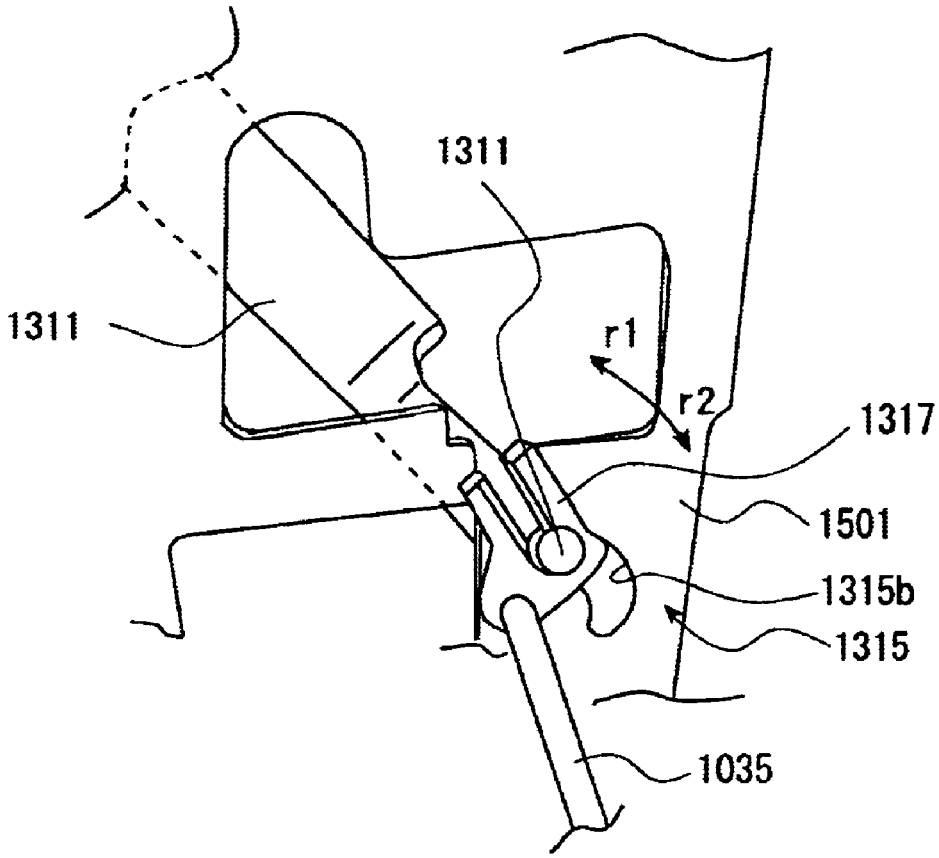
FIG. 61 is a perspective view showing part of the paper discharge following roller release mechanism in the same state as FIG. 55.

When the control lever 1201 is transferred to position B, the control lever 1201 is moved around the border of the arc part 1315*b* of the guide groove 1315 and the straight 1315*a* around the perimeter along the guide groove 1315 shown in FIG. 61 while the pin 1311 of the sixth link 1311 is connected with the U-shaped receiving part 1317 at the U-shaped bottom part. The U-shaped receiving part 1317 connected with the pin 1313 with the movement is also rotated in an r1 direction. The cam shaft 1035 is rotated in a synchronized rotation of the U-shaped receiving part 1317, as a result of this, the problem of the cam 1031 contacting with the cam follower 1023 is solved. The end side of the small holder 1022 is pushed up by pressure of the bar spring 1033 and a position of the small holder 1022 moves to the normal position contactable with the sheet to be recorded such as normal paper or cardboard (see FIG. 62A).

The limit switches 1241 and 1242 are turned on at this time, the lamp 1106 shown in FIG. 48 provided on the front face of the body 1101 flashes, and the lamp 1107 is turned on.

Figure 57:
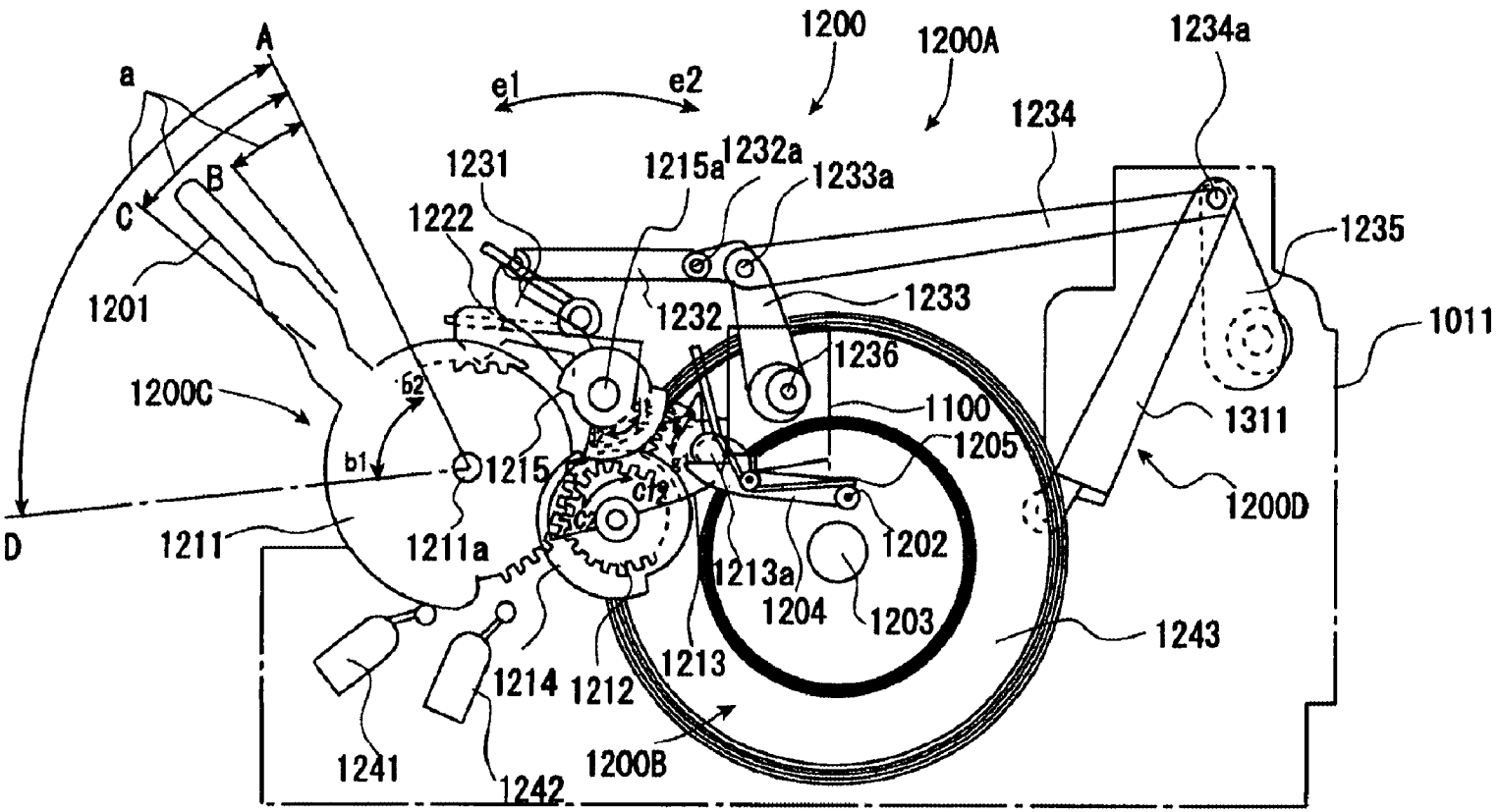
FIG. 57 is a side view showing the fourth operation of the paper gap switching mechanism/paper discharge following roller release mechanism/following roller spacing mechanism of the ink jet printer shown in FIG. 48.
Figure 58:
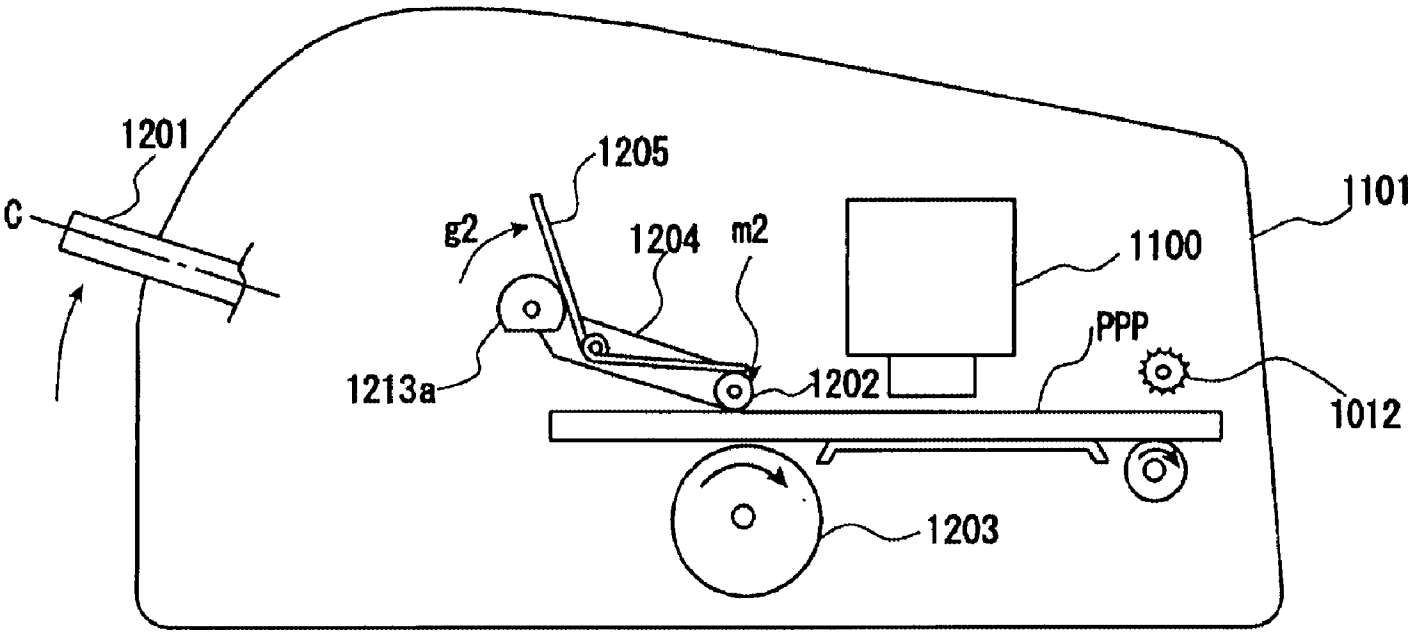
FIG. 58 is a side view showing the fourth operation of the paper gap switching mechanism/paper discharge following roller release mechanism/following roller spacing mechanism of the ink jet printer shown in FIG. 48.

Next, in a state shown in FIG. 57, that is, when the control lever 1201 is set to position C from position D, the first intermittent gear 1211 rotates along an arrow b2, the second intermittent gear 1212 and the fourth intermittent gear 1214 rotate along an arrow c2, whereas the third intermittent gear 1213 rotates along an arrow g2. As a result, the coil spring 1205 is urged against an axis D 1213*a*, and the following roller 1202 rotates along an arrow m2 so that the elastic force of the coil spring 1205 urged toward the D axis 1213*a* is applied to urge the very thick paper PPP fed between the main driving roller 1203.

On the other hand, since the fifth intermittent gear 1215 is not associated with the fourth intermittent gear 1214 in switching of position D and position C of the control lever 1201, the links 1231–1235 are not moved and the recording head 1100 is not moved. Therefore, the recording head 1100 stays at a position changed about 2.8 mm from a position normal paper in FIG. 52. Since the sixth link 1311 is not changed, a stopping state of the pin 1313 and the U-shaped receiving part 1317 is the same as 19 and the discharge following roller 1012 stays at the waiting avoid position.

At this time, the limit switch 1241 is turned off while the limit switch 1242 is turned on, and a lamp 1106 arranged in front of the body 1101 shown in FIG. 48 flashes whereas a lamp 1107 is turned on.

As described above, in the ink jet printer of the present embodiment, the paper gap is switched at position A for normal paper, position B for cardboard, and position C for CD-R tray in three steps by switching the control level 1201, the discharge following roller 1012 is not released at position A and B, and the discharge following roller 1012 is released at position C, and position D (following roller separation). Since the discharge following roller 1012 is released in only necessary timing while it is associated with the paper gap switching mechanism 1200A, the guide groove 1315 comprised of the straight part 1315*a* and the arc part 1315*b* and the U-shaped receiving part 1317 are used. In switching the control lever 1201 from position A to position B, movement of the paper gap switching mechanism 1200A is changed to moving of the straight part 1315*a* of the pin 1313 and movement is not converted into rotation of the U-shaped receiving part 1317. In switching the control lever 1201 from position B into position C, the pin 1313 moves the arc part 1315*b*, movement is not converted into rotation of the U-shaped receiving part 1317 and the cam mechanism is operated.

When the paper gap is set to the normal paper erroneously in printing the CD-R (control level 1201 is at position A) in the paper gap switching mechanism 1200A or the paper gap is set to cardboard (control level 1201 is at position B), a paper thickness detection mechanism in which the CD-R tray is separately provided considers as error of thickness and the printing task cannot be executed.

The ink jet printer in the second embodiment moves the recording head 1100, and a switching driving operation of three system is realized by one control lever 1201 constituting the control mechanism 1200C, accurate switching operation reads with high precision can be performed. The three system driving operation includes the paper gap switching mechanism 1200A switching the paper gap reads different intervals, the release mechanism 1200D changing the discharge following roller 1012 to switch the normal position and the waiting avoid position, and the following controller separating mechanism 1200B applying/releasing pressure to/from the following roller 1220 and adjusting pressure to push in order for the sheet to be recorded with a different thickness.

Setting, releasing and recovery, applying and switching can smoothly be performed. The paper gap with different intervals of the recording head 1100 is set by the paper switching mechanism 1200A through the second intermittent gear 1212 and the third intermittent gear 1214. The following roller makes the discharge following roller 1012 change according to the paper gap set to switching the lever from the normal position to the waiting avoid position is released and recovered. Pressure of the following roller 1202 by the following roller separate mechanism 1200B is applied. Further, the control mechanism 1200C, the paper gap switching mechanism 1200A, the discharge following roller release mechanism 1200D and the following roller separating mechanism 1200B of the discharge following roller can be realized by a gear mechanism, a link mechanism, and a cam mechanism that has a simple construction.

The ink jet printer of the second embodiment, the printer provides with a release mechanism capable of releasing the discharge following roller 1012 in printing normal paper or cardboard depending on the users use purpose, in addition, a release mechanism 1200D of the discharge following roller in association with the paper gap switching mechanism(often referred to as a first release mechanism hereinafter). The second release mechanism will be described referring to FIGS. 63–67 below.

Figure 63:
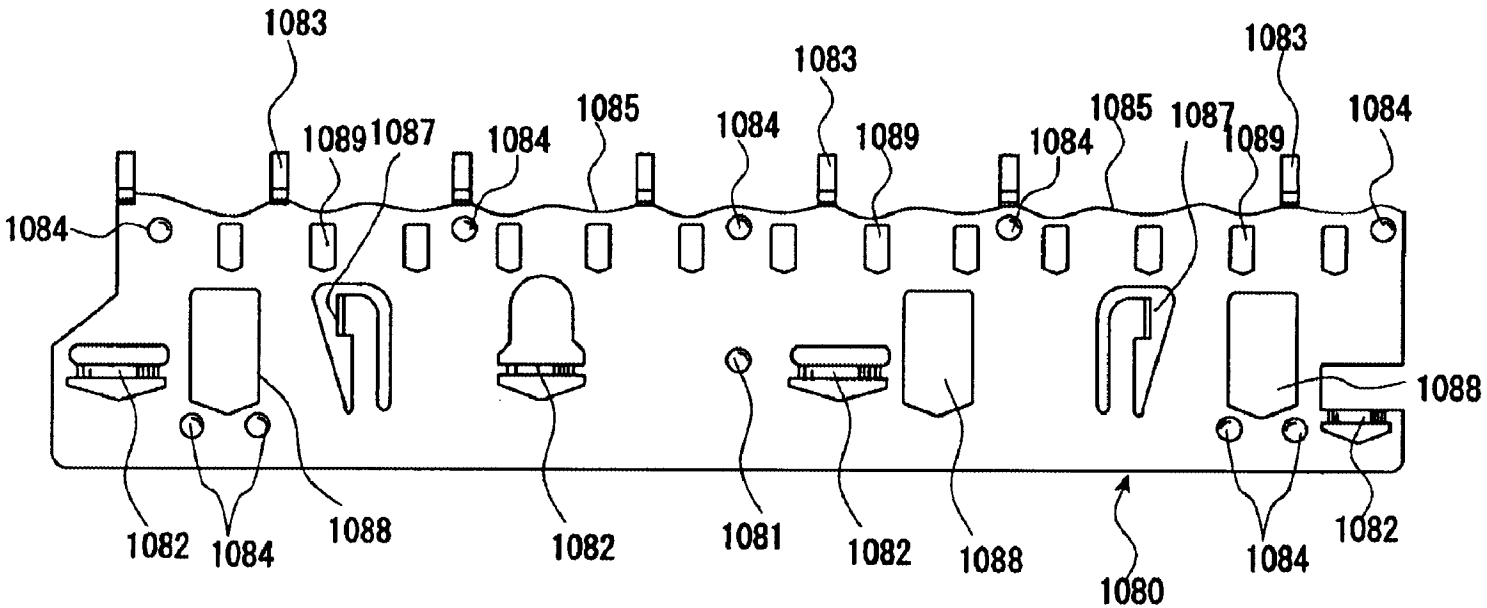
FIG. 63 is a plan view showing the plates used in the slide mechanism of the second release mechanism.

The second release mechanism can release the discharge following roller 1012 so as to separate from the first release mechanism 1200D and a plate 1080 is used and is shown as an example in FIG. 63 in the present embodiment.

Figure 64:
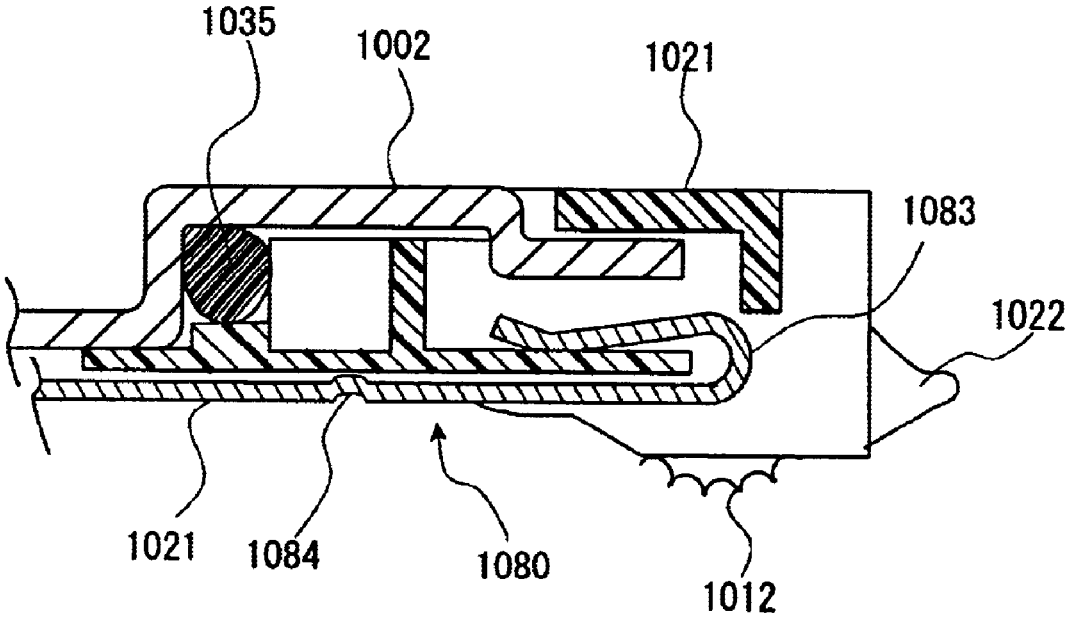
FIG. 64 is a diagram depicting the state of the plate shown in FIG. 63.

The plate 1080 is a flat board of a material of an SUS and it is provided to the discharge frame 1002 from the lower part of the small holder 1022 as shown in FIG. 64. Seven hooks 1083 are formed on the front part of the plate (shown on the upper side of FIG. 63) and can slide forwards and backwards and are stopped by the main holder 1021. Similarly, four hangers 1082 are stopped by catches (not shown) formed on the discharge frame 1002 so as to slide forwards and backwards. Position determine parts 1087 are inserted into a slit of the discharge frame 1002, and right/left positions are determined and the plate 1080 is provided. Width of the plate 1080 corresponds with the arranged discharge following roller 1012 in the second release mechanism different from the first release mechanism so that all of the discharge following rollers 1012 are swung. A large opening part 1088 is provided at a position corresponding to the discharge roller 1060 (see FIG. 66) in a case the plate 1080 is set and a small opening part 1089 is formed so that the end of the proximal side of the small holder 1022 is put in the case the discharge following roller 1012 is swung to the waiting position. A sliding face at a time of position determination of a height direction of the plate and slide is formed.

Since the plate 1080 is attached to the discharge passage of lower face of the discharge frame 1002, the printing task is performed at the end of the plate 1080 that is a recording pad and an edge on the opposite side to the transmitted sheet recorded is formed into a wave shape, occurrence of paper jam, etc. can be avoided since catching is avoided by passing the leading edge of paper with a wave shaped edge 1087, even if the sheet to be recorded jumps up to the plate 1080 by call and is transferred.

Figure 65A:
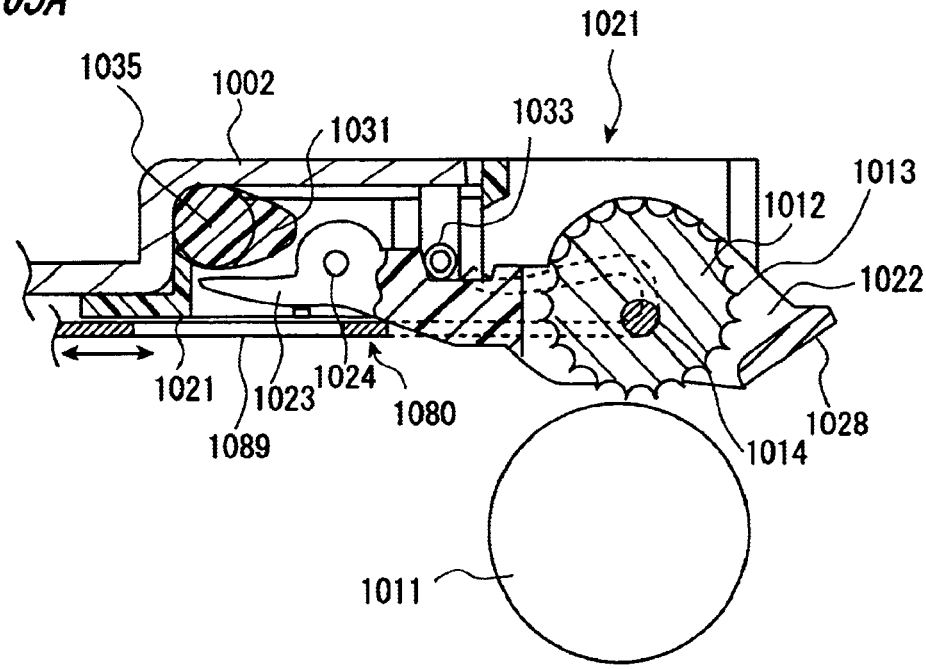
FIGS. 65A and 65B are side views depicting the operation to release the discharge following roller with the second release mechanism.
Figure 65B:
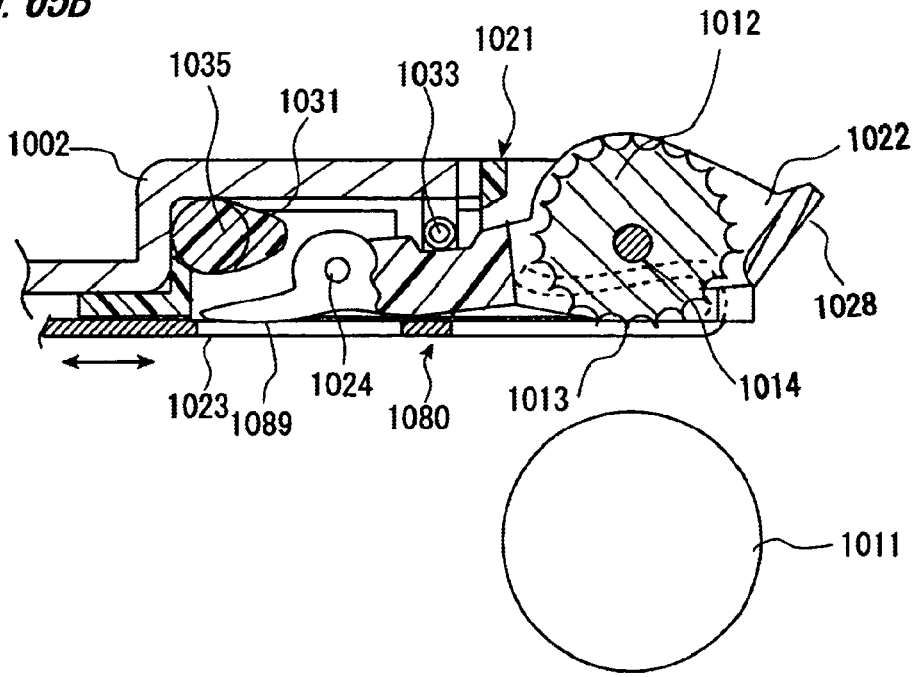

FIGS. 65A and 65B are side views explaining operation to release the discharge following roller 1012 with the second release means. FIG. 65A shows a state where the discharge following roller 1012 is at the normal position. The end of the small holder 1022 is swung up by pivoting the supporting part 1024 by sliding-contact upper face of the plate 1080 on a bottom part of the small holder 1022 as shown in FIG. 65B when the plate 1080 slides from the position into the front direction. The discharge following roller 1012 is released up to the waiting avoiding position by the swinging. Swinging width in the second release mechanism(change amount of discharge following roller) is set to a swinging width, which is narrower, for example about 1 mm, than a swinging width by the cam mechanism in the first release mechanism 1200D described in FIG. 62. Release operation of the discharge following roller 1012 of the is associated with the paper gap switching mechanism 1200A and change width in releasing is also set at the same width as paper gap adjustment in the first release mechanism 1200A. The paper gap is always wide at the other time of releasing the discharge following roller 1012 and the carriage is changed to an upper position having the same width. In contrast, since the discharge following roller 1012 can independently be released with a state where the paper gap is minimal not relating to paper gap adjustment, the discharge following roller 1012 at the waiting avoid position is knocked with a carriage reciprocal moving a lower position in a state of the minimum paper gap and there is a probability to prevent normal printing if change amount of the discharge following roller 1012 is too large. Therefore change amount of the second release mechanism is set to, for example, approximately 1 mm and contact with the carriage at the lower position is avoided in the present embodiment.

FIG. 66 is a main part front view of the ink jet printer explaining the control part 1090 in the second release means. The control pad 1090 is constituted so that the second control lever 1091 can easily be visually recognized from the front side of the ink jet printer around the front center part of the ink jet printer, and it is projected up to a position where it can control and the second release mechanism can be switched, more particularly, the control pad 1090 is attached to the discharge frame 1002 by rotatably pivoting the supporting part 1093 and a stopping projection (not shown) is provided in a downwards direction at a stopping part 1092 apart from the supporting part 1093 and is inserted in a stopping hole 1081 of the plate 1080 through a guide hole 1080 of the discharge frame 1002. When the second control lever 1091 is swung from a state in FIG. 66 where it is at the standard position on the right side, the stopping projection makes the plate 1080 slide forward by pivoting the supporting part 1093 and the discharge following roller 1012 becomes the waiting avoid state (FIG. 65B). The plate 1080 is fixed on the lower side through the guide hole 1086 of the discharge frame 1002. In contrast the second control lever 1091 is swung up to the standard position from this state (separating position of the second control lever 1091) to the left side, the stopping projection makes the plate 1080 slide backward by pivoting the supporting part 1093 and the discharge following roller 1012 returns to the normal position (FIG. 65A).

Figure 67:
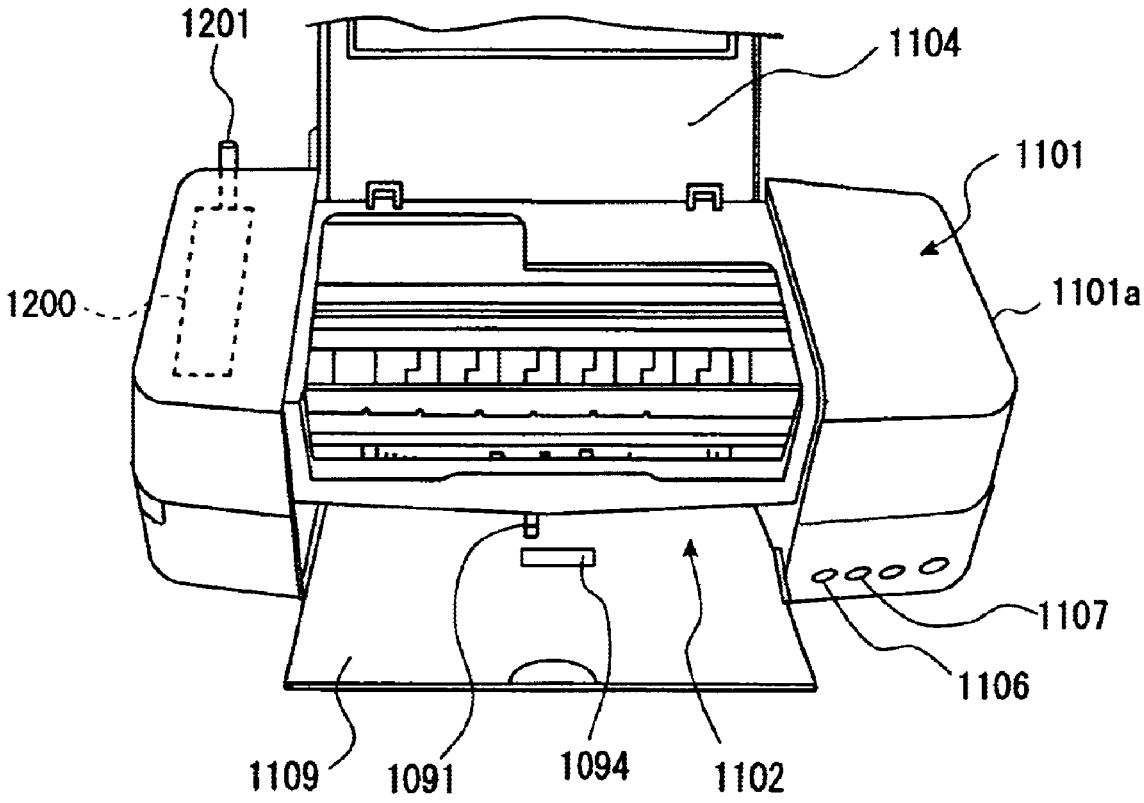
FIG. 67 is a front perspective view of the ink jet printer according to the present embodiment viewed from the front upper side and shows a state where the outside tray is open.

FIG. 67 is a perspective view of the ink jet printer according to the present embodiment viewed from the front upper side and shows a state where the outside tray 1109 is opened. Recovery mechanism 1094 for recovering the second control lever 1091 to the reference position (the left side position in FIG. 67) is provided at a position corresponding to the second control lever 1091 when the tray 1109 is closed in the discharge tray 1109. One part of the upper face of the discharge tray 1109 is contacted with the second control lever 1091 at the separating position in a state where the discharge 1109 is closed. The part is formed at the tilted face of low friction coefficient with an angle that is not contacted when the lever returns to the reference position 1091. The tilted face may be the full upper face of the discharge tray 1109 and may be a face, for example, curve tilted in an arc shape. When the user leaves the control lever 1091 at the separating position of the discharge following roller 1012 and intends to close the discharge tray 1109, and the end of the second control lever 1091 is contacted on the tilted face as the recovering mechanism 1094. Thereby the end part of the second control lever 1091 slides along the tilted face by using pressure at the time of close operation and the end part is swung to the reference position of the discharge following roller 1012 and can automatically recovery. Rotation structure may be provided at a end of the second control lever 1091 if required so that pressure of operation closing discharge tray 1109 can efficiently be converted into recovery operation.

As another example of the recovery mechanism 1094, the recovery mechanism 1094 can be stopped with the second control lever at the time of initially operating the carriage 1105 driven in a stage power supply of the ink jet printer is on. A mechanism can be employed. The mechanism returns the second control lever 1091 to the reference position according to the reciprocal movement of the carriage in the initial operation.

In an ink jet printer of the second embodiment, a linear scale, a detection mechanism 1105 moving position of the carriage in the main scanning direction can be changed according to paper gap adjustment with the paper gap switching means. Association mechanism of the linear scale will be described referring to FIGS. 68–71 below.

Figure 68:
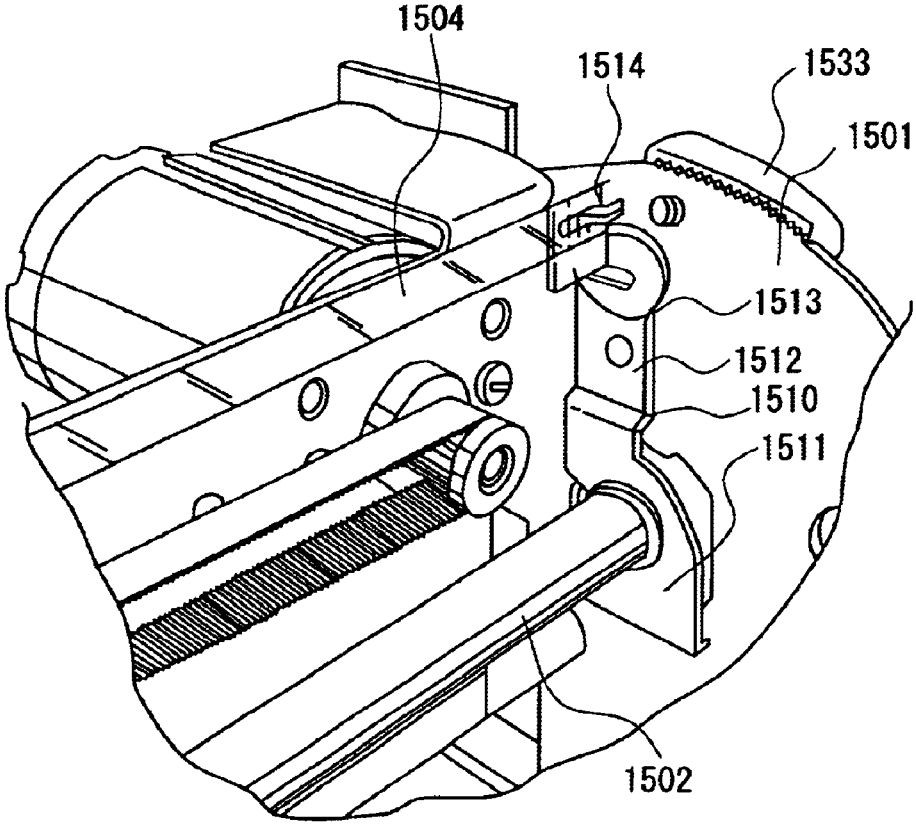
FIG. 68 is a front perspective view showing a state where a holder is set to the ink jet printer.
Figure 69:
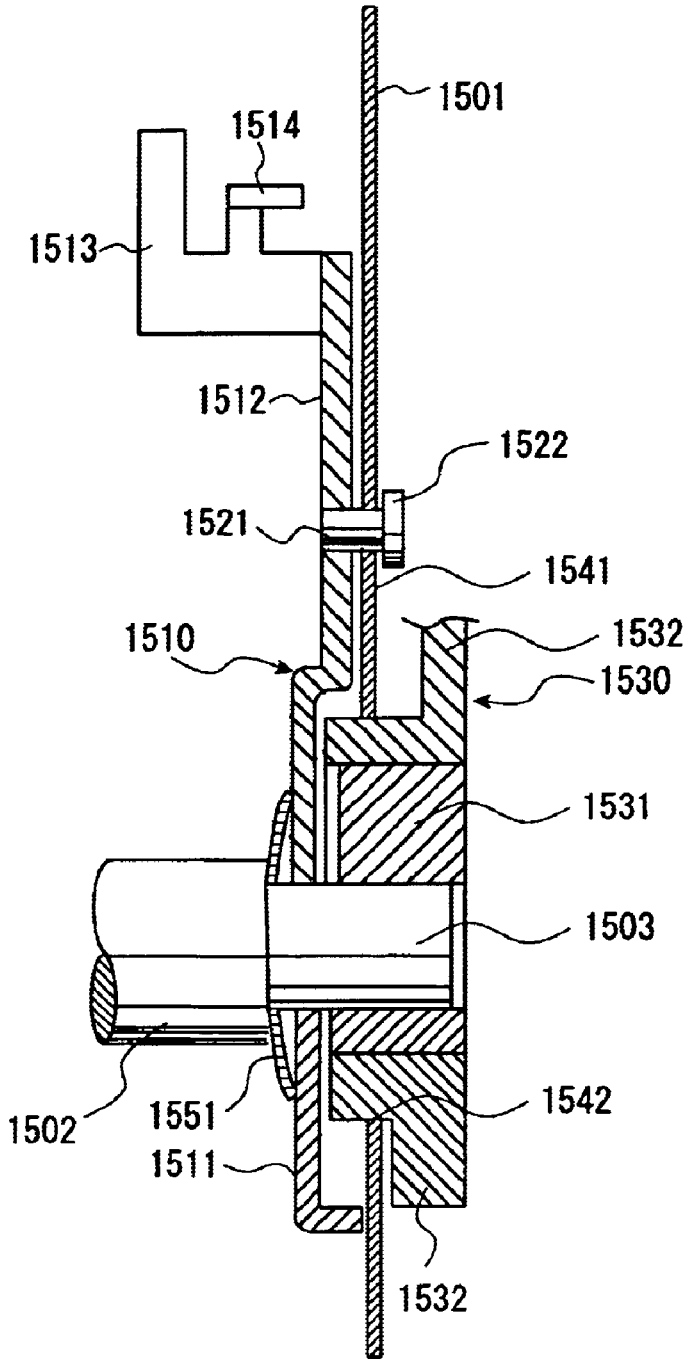
FIG. 69 is across-sectional view of a portion of FIG. 68.

FIG. 68 is a main perspective view showing a state where a holder 1510 is set to the ink jet printer of the embodiment. FIG. 69 is a main part cross-sectional view of a circumference in FIG. 68. The carriage guide axis 1502 is supported by side frames 1501 via an eccentric mechanism 1530 so that the carriage guide axis 1502 can be moved up and down. Since the eccentric axis may be employed, an eccentric bush is used as the eccentric mechanism 1530. Since a cross-sectional concentration axis can be used as the carriage guide axis 1502 by using an eccentric bush and a move distance can be long without a diameter of the carriage guide axis 1502 itself, it becomes possible to wide width changing the carriage and a free level of paper gap adjusting becomes high.

Although shapes of the holder 1510 are any shapes if the carriage guide axis 1502 is associated with the linear scale 1504; the carriage guide axis is set to the holder 1510 at a slightly wide lower part, an attachment 1513 of the linear scale is provided at an upper part, middle of both parts are, in a substantially vertical direction, extended from a lower part to an upper part, and an extending part 1512 contacted on a wall face of the side frame 1501 is provided. The holder 1510 has a bearing shaped part of a substantially semi half circle corresponding to an outer circumference of a small diameter axis 1503 for the carriage guide axis 1502 at a part set to the carriage guide axis 1502. The holder 1510 is set to the carriage guide axis 1502 so that the small axis 1503 of the carriage guide axis 1502 is engaged with the bearing shaped part. Further, a dish-like spring 1551 is held at an engagement portion of the carriage guide axis 1502 so that the holder 1510 is urged against the side frame 1501.

The holder 1510 engaging with the carriage guide shaft 1502 is substantially U-shaped, and an upper part and a lower part of the U-shaped shaft contact the side frame 1501. The plate like plain surrounding the engagement portion defines a spaced member 1511 which is distanced from the wall surface of the side frame 1501. Owing to the spaced member 1511, a load applied to the carriage guide shaft 1502 is relieved to the side frame 1501 in such a manner that it bridges the eccentric mechanism 1530 engaging with the side frame 1501, so that the load on the eccentric mechanism 1530 is reduced.

That is, the carriage guide shaft 1502 receives both the load in a horizontal direction generated by the reciprocating movement of the carriage in the main scanning direction and also the load in a vertical direction generated by the up-down displacement of the carriage itself and the eccentric mechanism 1530. Those loads tends to be concentrated to the eccentric mechanism 1530 which is supported at both ends thereof by the carriage guide shaft 1502. However, the load is relieved by the spaced member 1511 of the holder 1510 to the side frame 1501 serving as a construction member, so that the load applied to the eccentric mechanism 1530 can be reduced.

A mounting part 1513 of a linear scale 1504 is a part formed by bending to be substantially orthogonal with the flat plain of the holder 1510 at the upper part of the holder 1510 disposed to rise up from the lower part, so that it extends in parallel with a tape-like linear scale 1504. Further, by further bending a part of the mounting part which is bent a hook member 1514 for engagement is formed. The hook member 1514 hooks on an engagement hole formed at an end of the linear scale 1504 so that the linear scale is mounted.

Figure 70:
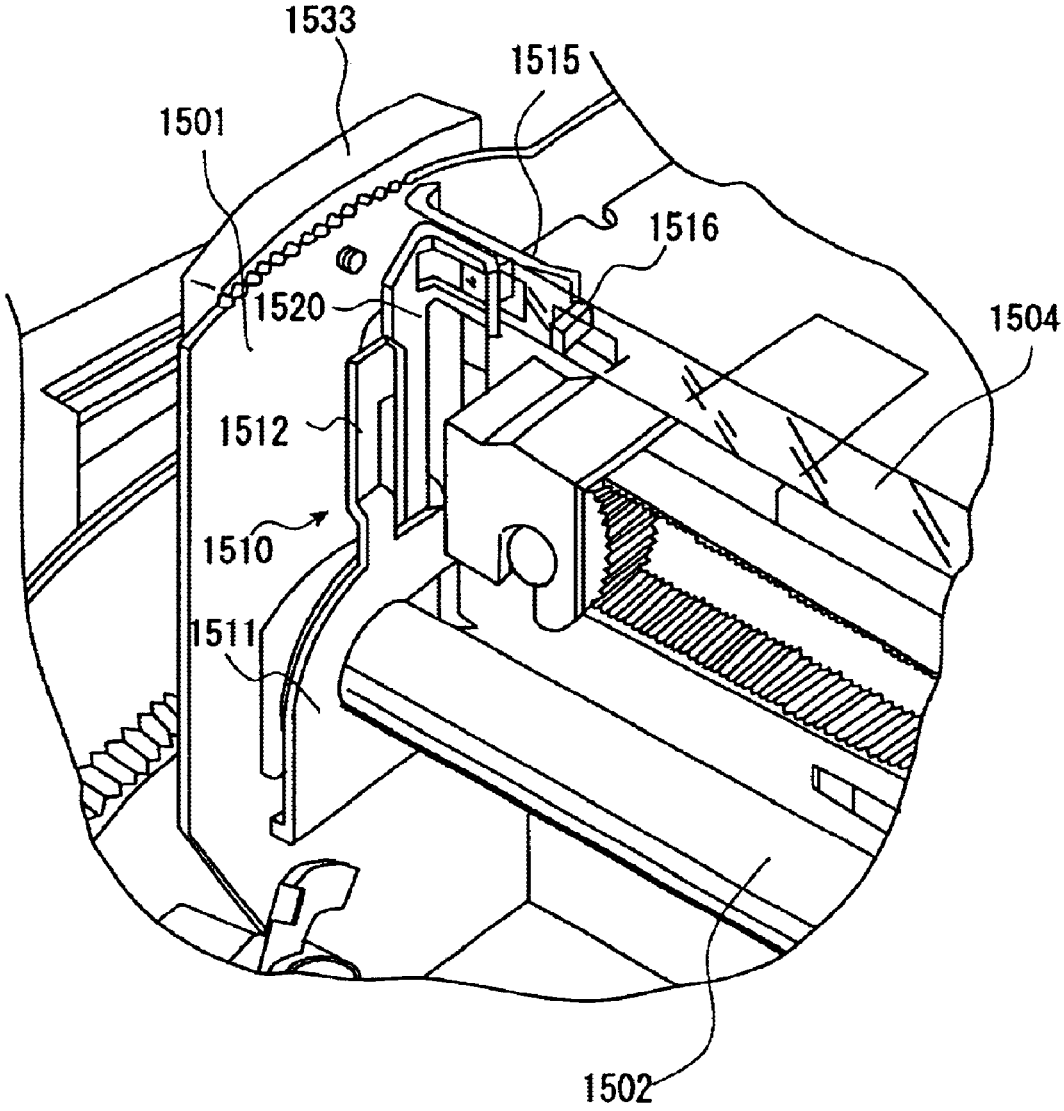
FIG. 70 is a perspective view showing part of the holder mounted on the side frame side of the apparatus shown in FIG. 68.

FIG. 70 is a perspective view showing an essential part of the status of the holder 1510 mounted on the side frame 1501 opposite side of the status shown in FIG. 68. The fundamental structure of the holder 1510 is the same as shown in FIGS. 68 and 69, and formed by using the flat plate member. A spaced member 1511 is formed to be spaced from the side frame 1501 at a lower part thereof and engages with the carriage guide shaft 1502 at the part. In FIG. 70, unlike FIG. 68, the linear scale 1504 is not mounted directly onto the holder 1510 but to a leaf spring 1520 mounted on the holder 1510. That is, the holder 1510 is formed with an opening approximately at the center thereof, and the leaf spring 1520 is fit in the opening. The leaf spring 1520 is secured to the holder 1510 at a lower part thereof by a mechanism not shown in the FIG. drawings, and the mounted movably in up-down direction along the same locus as the carriage guide shaft 1502 and the holder 1510. At an upper portion of the leaf spring, there is provided a mounting portion of the linear scale 1504 formed by bending same to be approximately orthogonal with respect to the flat plate surface of the leaf spring 1520, that is, to be in parallel with the tape like linear scale 1504. Like the mounting part 1513 of the linear scale 1504 shown in FIG. 68, a hook member for mounting the linear scale 1504 is formed. The hook member hooks on an engagement opening formed in an end of the linear scale 1504, so that the linear scale is mounted. Thus, the mounting part of the linear scale 1504 is formed on the leaf spring 1520 mounted on the holder 1510 and the linear scale 1504 is mounted to the mounting part. Due to the structure, the linear scale 1504 can be held while applying a tension by mechanism of the elastic force of the leaf spring 1520. In the present embodiment, the leaf spring 1520 is prepared separately from the holder 1510, it may be possible that a part of the holder 1510 is designed to be elastically deformable, so that the same elastic force is obtained as the leaf spring 1520.

An upper part of the holder 1510 shown in FIG. 70 is bent to be substantially orthogonal with the flat plate surface of the holder 1510, that is, to be in parallel with the take-like linear scale 1504, so that a positioning member 1515 is formed in the height direction of the linear scale 1504. A projecting piece 1516 is formed by further bending in orthogonal a part of the positioning member 1515 formed by bending, and the projecting piece 1516 is inserted into an opening formed for positioning the linear scale 1504 in the height direction, so that the height of the linear scale 1204 can be defined without deviating in vertical direction.

Figure 71:
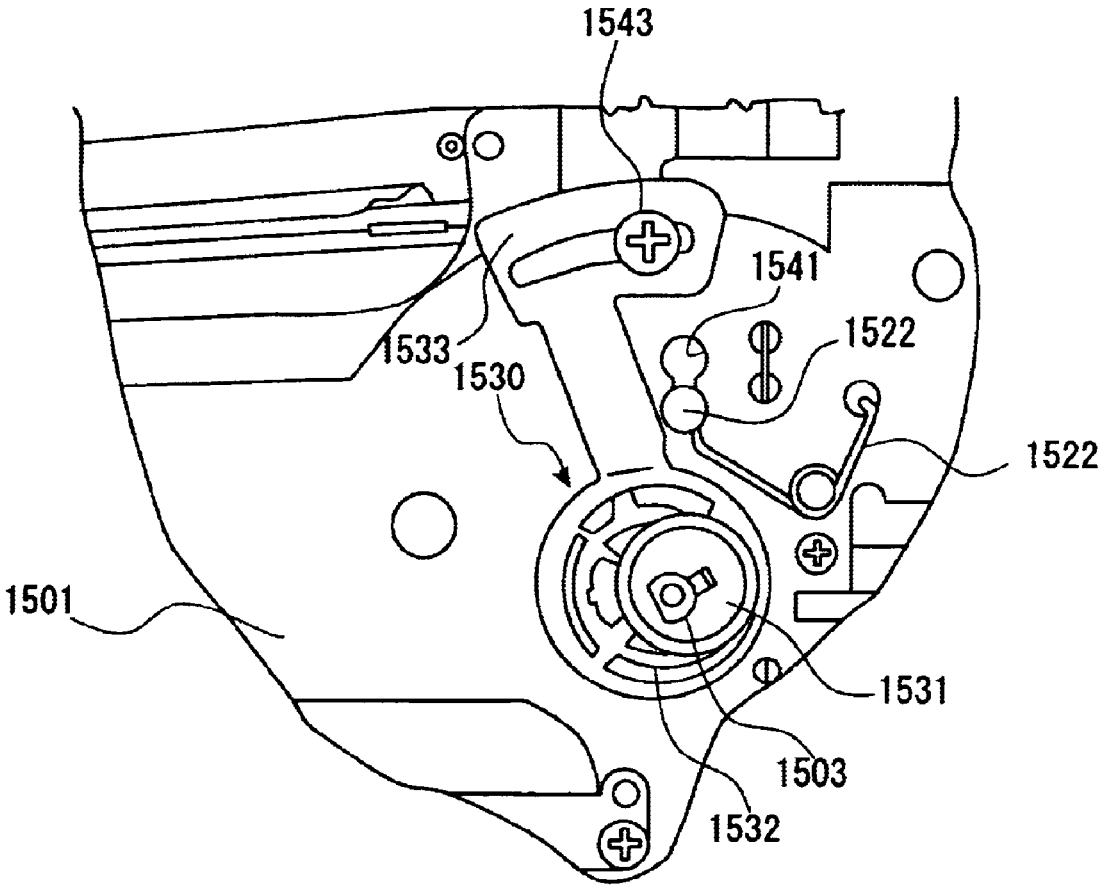
FIG. 71 is a side view showing the outside of the side frame of the ink jet printer shown in FIG. 48.

As shown in FIGS. 69 and 71, a projection 1521 is formed at a flat plate like rising-up part of the holder 1510 rising in vertical from the lower part thereof. The projection 1521, cooperating with a guide hole 1541 formed in the side frame 1501, forms a guide structure which defines a locus of the holder 1510 when it moves up and down. A lower half shape of the guide hole 1541 is designed to be the same locus as the displacement locus of the carriage guide shaft 1502. Therefore, the projection 1521 fitted in the guide hole 1541 is guided in the guide hole 1541 when it is moved to make the same locus as the carriage guide shaft 1502. Therefore, as the linear scale 1504 mounted on the holder 1510 moves along the same locus as the carriage guide shaft 1502, i.e., the carriage, the displacement of the linear scale 1504 while maintaining the relative position with the carriage can be accomplished.

Further, a tip end of the projection 1521 is T-shaped in cross section which performs as a remove-preventing member 1522 from the guide hole 1541. An upper part of the guide hole 1541 is made wide compared with a lower locus shape, and by inserting the projection 1521 into the guide hole 1541 from the top when the holder 1510 is mounted, the fitting operation of the projection 1521 into the guide hole 1541 can be readily achieved. Further, the projection 1521 is linked to the side frame 1501 by a chattering-preventing spring 1522 for preventing any chattering within the guide hole, so that the projection 1521 can be guided in stable in the guide hole 1041.

Based upon the above explanation, the operation of the linear scale interlocking mechanism of the present embodiment.

The linear scale 1504 is installed to the holding unit 1510 or the bar spring 1520, which is mounted to the holding unit 1510. This holding unit 1510 changes the position up and down with synchronizing with the displacement of the carriage guide axis 1502, which has an eccentric mechanism 1530 for adjusting a paper gap. As a result, the displacement of linear scale 1504 displaces up and down with corresponding with the displacement of the carriage guide 1502.

As explained above, as a result of mounting the holding unit 1510 of the linear scale 1504 to the carriage guide axis 1502, which adopts eccentric mechanism 1530, synchronously, the carriage guide 1502 and the linear scale 1504 displaces corporately. Therefore, it is possible to adjust the paper gap and change the position of the linear scale by only one switching operation. A eccentric mechanism 1530 is not limited to the eccentric mechanism as mentioned-above, but a known mechanism such as eccentric axis may also be adopted.

The various types of the embodiments of the present invention are explained above. However, the present invention is not limited to the embodiments mentioned above, but other embodiments can also be applied to the present invention within the scope of the present invention defined by the appended claims.

For example, the paper gap switching unit 1200A (and the release unit 1200D of the following roller) and the second lacking teeth gear 1212 and the third lacking teeth gear 1214 may be separately manufactured and connected to be coaxial. Furthermore, the paper gap switching unit 1200A (and the release unit 1200D of the following roller) and the second lacking teeth gear 1212 and the third lacking teeth gear 1214 may be manufactured previously as one-body.

Furthermore, in the above-mentioned embodiments, the switching position of the operation lever 1201 is explained for the case in which the positions A, B, C, and D of four steps are set sequentially. The position A is a position for using a sheet having a normal thickness, that is, a normal paper. The position B is a position for using a sheet having a slightly large thickness, that is, a cardboard. The position C is a position for using a sheet having a large thickness, that is, a cardboard having a large thickness including an information recording disk tray. The position D is a position where the following roller 1202 is separated from the main roller 1203.

However, the present invention is not limited to the above embodiment, but other embodiment may be applied if the three positions of the position P, the position Q, and position R are set sequentially. The position P is a position for setting a first paper gap. The position Q is a position for setting a second paper gap that is larger than the first paper gap. The position R is a position where the following roller 1202 is separated from the main roller 1203.

Furthermore, the switching position that is sequentially set is not limited to the order of A, B, C, and D, but other desired order may be applied to the present invention. For example, in case of the above switching positions P, Q, and R, any one of the order of an order P, Q, R, an order R, P, Q, and an order P, R, Q may be applied.

Furthermore, in the above embodiment, the cam mechanism, which comprises cam 1031 and cam follower 1023, is used in the first release unit 1200D, and the slide mechanism of the plate 1080 is used in the second release unit. However, other mechanism that can achieve the same object can be applied for the present invention.

Moreover, the pushing mechanism of the following roller 1202 in the following roller separating mechanism 1200B is not limited to the coil spring 1205 and 1305, and other mechanism of an elastic member such rubber can be applied. Furthermore, if the D axis 1213*a* is formed in a fan-shape having an acute angle, the operation angle of the operation lever 1201 can be taken desirably.

According to the holder and the paper ejection apparatus having a holder, and a printing apparatus having the paper ejection apparatus of the present invention, a release mechanism that can changes the position of the following roller holder to the normal position or the evacuation position is provided. The normal position is a position where the holder can contact with the sheet. The evacuation position is a position where the following roller does not contact with the sheet.

For example, the printing using coating paper may be performed at the evacuation position so that the peeling off or damage of the paper can be prevented. Therefore, the printing condition can be selected according to the purpose of

What is claimed is:

1. A transferring tray for use with a printing apparatus for printing on a major surface of a disc-shaped recording medium, wherein the printing apparatus includes, a carriage having a printing head, reciprocating in a main scanning direction, a transferring unit transferring the recording medium in a sub scanning direction, a detecting unit detecting transfer of the recording medium by the transferring unit, and a recording unit printing on the first major surface of the recording medium, the transferring tray comprising:

a rectangular tray body made of a material which is not detected by the detecting unit and having a first major surface and a second major surface, wherein the tray body includes a plurality of grooves defining a plurality of convex portions and a plurality of concave portions all arranged parallel to the sub scanning direction, wherein those of the plural convex portions located on the first of the major surfaces form the respective plural concave portions on the second of the major surfaces, and those of the plural convex portions located on the second of the major surfaces form the respective plural concave portions on the first of the major surfaces;

a detected portion formed on either the first or the second major surfaces of the tray body, and which is detected by the detecting unit; and a mounting portion having a mounting recess for receiving the recording medium such that one of the major surfaces of the recording medium and one of the major surfaces of the tray body are substantially co-planar when the recording medium is mounted on the transferring tray.

2. The transferring tray according to claim 1, wherein the tray body has a through-hole in the mounting recess, the hole being smaller than the mounting recess, and at least a portion of the recording medium can be contacted through the hole.

3. The transferring tray according to claim 1, wherein the material of the tray body has a black color.

4. The transferring tray according to claim 1, wherein the tray body is made from a single piece of integrally-molded plastic.

5. The transferring tray according to claim 1, wherein the transferring unit includes a driving roller and a following roller, and wherein both a thickness of a starting portion and a thickness of an end portion of the tray body decrease toward a tip end of the tray body.

6. A transferring tray for use with a printing apparatus for printing on a major surface of a disc-shaped recording medium, wherein the printing apparatus includes, a carriage having a printing head, reciprocating in a main scanning direction, a transferring unit transferring the recording medium in a sub scanning direction, wherein the transferring unit includes a driving roller and a following roller, a detecting unit detecting transfer of the recording medium by the transferring unit, and a recording unit printing on the first major surface of the recording medium, the transferring tray comprising:

a rectangular tray body made of a material which is not detected by the detecting unit and having a first major surface and a second major surface and wherein both a thickness of a starting portion and a thickness of an end portion of the tray body decrease toward a tip end of the tray body;

a detected portion formed on either the first or the second major surfaces of the tray body, and which is detected by the detecting unit; and a mounting portion having a mounting recess for receiving the recording medium such that one of the major surfaces of the recording medium and one of the major surfaces of the tray body are substantially co-planar when the recording medium is mounted on the transferring tray.

7. The transferring tray according to claim 6, wherein the tray body has a through-hole in the mounting recess, the hole being smaller than the mounting recess, and at least a portion of the recording medium can be contacted through the hole.

8. The transferring tray according to claim 6, wherein the material of the tray body has a black color.

9. The transferring tray according to claim 6, wherein the tray body is made from a single piece of integrally-molded plastic.

10. A printing apparatus for printing on a first major surface of a disc-shaped recording medium, the recording medium also having a second major surface, the printing apparatus comprising:

a carriage having a printing head, the carriage reciprocating in a main scanning direction;

a transferring unit that moves the recording medium in a sub scanning direction;

a detecting unit that detects movement of the recording medium by the transferring unit;

a recording unit that prints on the first major surface of the recording medium; and a transferring tray that receives the recording medium, the transferring tray including, a rectangular tray body made of a material which is not detected by said detecting unit and having a first major surface and a second major surface, a detected portion formed on either the first or the second major surfaces of the tray body, and which is detected by the detecting unit, and a mounting portion having a mounting recess for receiving the recording medium such that one of the major surfaces of the recording medium and one of the major surfaces of the tray body are substantially coplanar when the recording medium is mounted on the transferring tray, further comprising an ejecting unit including an ejection driving roller and an ejection follower roller, wherein the tray body of the transferring tray includes a plurality of long grooves defining a plurality of convex portions and a plurality of concave portions all arranged parallel to the sub scanning direction, and wherein those of the plural convex portions located on the first of the major surfaces forms the respective plural concave portions on the second of the major surfaces, and each of those plural convex portions located on the second of the major surfaces forms the respective plural concave portions on the first of the major surfaces, at least one of the convex portions being formed on a portion of the one of major surfaces of the tray body that contacts the ejection follower roller, that convex portion which is formed on the portion comes up to a substantially same level as the first major surface of the recording medium.

11. The transferring tray according to claim 10, wherein the tray body has a through-hole in the mounting recess, the hole being smaller than the mounting recess, and at least a portion of the recording medium can be contacted through the hole.

12. The transferring tray according to claim 10, wherein the material of the tray body has a black color.

13. The transferring tray according to claim 10, wherein the tray body is made from a single piece of integrally-molded plastic.

14. A transferring tray which is received in a printing apparatus that prints on one major surface of a thin recording medium held in the transferring tray, the printing apparatus including a carriage having a printing head which reciprocates in a main scanning direction, a transferring unit that moves the transferring tray holding the recording medium along a transferring path in a sub scanning direction, and a recording unit that prints on the one major surface of the recording medium, the transferring tray comprising:

a plate having an area in which the recording medium is received; and an outline picture depicting an element of the printing apparatus, the outline picture being located at a position on the transferring tray that aligns with the location of the element of the printing apparatus when the transferring tray is set to a predetermined position on the transferring path of the transferring unit.

15. The transferring tray according to claim 14, wherein the outline picture is substantially the same size as the element and the predetermined position is located where the outline picture overlaps with the element so that the element covers the outline picture.

16. The transferring tray according to claim 14, wherein the outline picture depicts an ejection follower roller that is a part of the transferring unit.

17. The transferring tray according to claim 14, wherein the outline picture is drawn with a substantially same color as the element.

18. The transferring tray according to claim 14, wherein, along with the outline picture, an arrow showing a direction for inserting the transferring tray into the printing apparatus is drawn on the transferring tray.

19. The transferring tray according to claim 14, wherein the recording apparatus further includes a detecting unit that detects movement of the recording medium by the transferring unit, and wherein the transferring tray is made of a material which is not detected by said detecting unit and the transferring tray further comprises a detected portion formed on either one of a first and a second major surface of the tray body, which said detected portion is detected by the detecting unit.

20. The transferring tray according to claim 14, further comprising a mounting portion having a mounting recess for receiving the recording medium such that a first and a second major surface of the recording and one of the major surfaces of the tray body are substantially coplanar when the recording medium is mounted on the transferring tray, and a detaching hole is located in the area on which the recording medium is mounted, the detaching hole being smaller than the mounting area.

21. The transferring tray according to claim 14, further comprising a first stopper that makes contact with the carriage when the printing head is closer to the first of the major surfaces of the transferring tray than a predetermined distance, and so prevents the printing head from scanning on the transferring tray.

22. The transferring tray according to claim 21, further comprising a second stopper that makes contact with the carriage when the transferring tray is inserted into the printing apparatus in a direction other than a predetermined direction, without regard to a distance between the printing head and the transferring tray, and so prevents the printing head from scanning on the transferring tray, wherein the second stopper is positioned so as not to contact the carriage when the transferring tray is inserted to the printing apparatus in the predetermined direction and the printing head prints on the first major surface of the recording medium.

23. The transferring tray according to claim 14, wherein the recording apparatus further includes a starting end detecting unit having a lever which is biased to return to a standing orientation, the lever being pivoted so as to protrude into the transferring path and also to be rotatable in the sub scanning direction, for detecting a starting end of the recording medium, and wherein the transferring tray further comprises a protective portion having a shape such that the transferring tray is drawn out from the transferring path without reversely rotating the lever after the transferring tray is inserted to the transferring path of the transferring unit while the first major surface faces the printing head.

24. A printing apparatus comprising:

the transferring tray according to claim 14, wherein the transferring tray is moved with the recording medium, and the printing head prints on the first major surface of the recording medium.

25. A printing apparatus as claimed in claim 24, further comprising:

a detecting unit that detects the recording medium which is moved by said transferring unit, wherein said plate has a rectangular plate shape and is made of a material which is not detected by said detecting unit and a detected portion which is detected by said detecting unit; and said tray body has a mounting groove, on which said recording medium can be mounted so that the first face of said recording medium upon which printing is performed is substantially coplanar with the plane of said recording medium mounting side when said recording medium is mounted.

26. A printing apparatus as claimed in claim 25, further comprising:

an ejection unit having an ejection driving roller and an ejection follower roller having a plurality of teeth; wherein:

said tray body has a plurality of grooves formed on both sides of said tray body in a direction parallel to the sub scanning direction along which said transferring tray is moved so that said tray body has a plurality of convex face regions and a plurality of concave face regions; and said plurality of grooves are formed such that a back face of said convex face region becomes said concave face region, and a back face of said concave region becomes said convex face region; and a region that contacts with said ejection following roller becomes said convex face region, and said convex face and the printing face of said recording medium mounted on said convex face are substantially coplanar.

27. A printing apparatus as claimed in claim 24, wherein:

the printing apparatus records an image on the recording medium by moving the printing head, located at a predetermined printing position in the sub scanning direction, in a main scanning direction and then after the printing head has moved in the main scanning direction, moving said recording medium in said sub scanning direction and, if desired, repeating such movements; and said transferring unit is provided in each of an upstream side and a downstream side of said printing position along said sub scanning direction, and said transferring unit has a first paper sending roller and a second paper sending roller that each holds and transfers said recording medium, and said transferring unit selectively transfers said recording medium in toward said upstream side and said downstream side in the sub scanning direction; and said printing apparatus further comprising:

a paper feeding unit provided at an upstream position in said sub scanning direction;

a detecting part provided at a position where an optical axis to be detected is located at a point more downstream side than the holding position of said second paper sending roller and a second follower roller provided downstream of said printing position; said detecting part outputting a voltage according to a reflected light amount of the object at said position and detecting said object by judging whether said detected voltage surpass a predetermined threshold value (T0) at default condition;

a recording unit for recording a value of said detected voltage detected by said detecting part; and a transferring control unit for controlling said transferring unit to move said recording medium downstream by a predetermined amount in the sub scanning direction so that said detection part detects a tip portion of said recording medium; recording a detected voltage (T1) detected by said detecting part at said transferring position and then moving said recording medium to the upstream side in the sub scanning direction by said transferring unit; recording a detected voltage (T2) detected by said detecting part when there is no recording medium on said recording unit; and calculating a average value (T0Vp) of said detected voltage (T1) and said detected voltage (T2); moving said recording medium to the downstream side in the sub scanning direction by said transferring unit after modifying a predetermined threshold value for detecting the existence of said object to said average value (T0VP) calculated from said default threshold value (T0); and setting said recording medium to an initial position referring to a point where said detected voltage detected by said detecting part reaches to said average value (T0Vp).

28. A printing apparatus as claimed in claim 27, further comprising:

a second detection part provided at a position located further upstream than a holding position of said first paper sending roller and first follower roller provided at an upstream side of said printing position to detect a presence of said recording medium at said position; and a third detection part provided at an intermediate position between said second detecting part and said paper feeding unit in said sub scanning direction for detecting a presence of said recording medium at said intermediate position.

29. A printing apparatus as claimed in claim 24, further comprising:

an initial setting unit for said recording medium, said initial setting unit including said transferring unit, which can move said recording medium toward an upstream side and a downstream side of a transferring passage, an optical sensor, a recording unit, and a calculating unit; wherein:

said optical sensor changes an output voltage according to the object;

said recording unit stores a previously predetermined voltage value;

said transferring unit transfers said recording medium by a predetermined distance from a time when the output voltage value of said optical sensor exceeds said predetermined voltage value during transferring of said recording medium so that the object of said optical sensor becomes said recording medium only;

said recording unit records an output voltage value of said optical sensor in said condition as a first measurement value;

said transferring unit further moves said recording medium in the reverse direction toward downstream side of said transferring passage to remove said recording medium from a detection range of said optical sensor;

said recording unit records an output voltage value of said optical sensor in said condition as a second measurement value;

said calculation unit calculates an average value of said first measurement value and said second measurement value; and said transferring unit moving said recording medium upstream side of said transferring passage and moving said recording medium for a predetermined amount referring to a position which is to be an average value calculated by said calculation to perform initial setting of said recording medium.

30. A printing apparatus as claimed in claim 29, wherein said optical sensor has a light-emitting element and a light-receiving element, and said optical sensor detects an existence of the object by catching light that has been emitted from said light-emitting element and is reflected from the object back to said light-receiving element.

31. A printing apparatus as claimed in claim 30, wherein said transferring tray, on which said recording medium is mounted, can be moved inside the transferring passage of the printing apparatus by said transferring unit.

32. A printing apparatus as claimed in claim 24, wherein said transferring unit comprises a structure for moving said recording medium by driving a motor with a motor driving control unit, the motor driving a roller; and said printing apparatus further comprising an optical sensor; and said printing apparatus moves said recording medium both forward and backward, so that the recording medium enters into the detection range of said optical sensor, using a structure for moving said recording medium; the printing apparatus detecting an amount of light at each of a forward position and a backward position of said recording medium; and controlling movement of said recording medium with said motor driving control unit based on the light detected at each of the forward and backward positions, wherein;

said optical sensor is arranged at a position closer to a recording medium ejection opening than a structure that performs the moving of said recording, medium in said recording medium passage of the printer apparatus.

33. A printing apparatus as claimed in claim 32, wherein said printing apparatus is a printer for performing printing by scanning the printing head; and the structure for moving said recording medium includes two rollers, which are driven synchronously by a same motor through a power transmission mechanism; and said scanning operation of said printing head is performed at a position between said two rollers in said transferring path.

34. A printing apparatus as claimed in claim 24, wherein said transferring unit comprises a structure for moving said recording medium by driving a motor with a motor driving control unit; and said printing apparatus further comprising an optical sensor having a detection range; and said printing apparatus performs both a forward movement and a backward movement of said recording medium, which enters into the detection range of said optical sensor, using a structure for moving said recording medium to and detecting a light amount at a forward sending position and a backward sending position of said recording medium, and the motor driving control unit controlling movement of said recording medium based on said detection results; and the structure for moving the recording medium including a roller driven by said motor and a notched roller which is pushed against said roller, said notched roller holding said recording medium together with said roller and moving said recording medium; and an optical axis of said optical sensor is arranged closer to a recording medium ejection opening than a center position of said notched roller in the said transferring path.

35. A printing apparatus as claimed in claim 24, wherein said transferring unit comprises a structure for moving said recording medium by driving a motor with a motor driving control unit; and said printing apparatus further comprising an optical sensor having a detection range; and said printing apparatus performs both a forward movement and a backward movement of said recording medium, which enters into the detection range of said optical sensor, using a structure for moving said recording medium; and detecting a light amount at a forward sending position and a backward sending position of said recording medium; and controlling movement of said recording medium with said motor driving control unit based on said detection results; and the structure for moving said recording medium including a roller driven by said motor and a plurality of notched rollers which are pushed against said roller, said notched roller holding said recording medium together with said roller and moving said recording medium; and said optical sensor is arranged between said plurality of notched rollers in the paper width direction of said recording medium.

36. A printing apparatus as claimed in claim 24, wherein said printing apparatus performs a printing operation by driving a moving motor of said recording medium with a motor driving control unit to move said recording medium in a sub scanning direction and driving a carriage motor to move a carriage, on which said printing head is mounted, in a main scanning direction; and said motor driving control unit has:

an current detecting unit for detecting an amount of electric current consumed by said carriage motor;

a judging unit for determining a type of said recording medium installed in the printing apparatus by obtaining information about the detected current value; and said judging unit determines that said recording medium has a problem when said consumption current value detected by said current detecting unit exceeds a predetermined value during the process when said amount of current consumed by said carriage motor is detected while said recording medium is sent under a main scanning lines, along which said carriage moves, by a moving motor of said recording medium and moves said carriage to a predetermined position on said recording medium.

37. A printing apparatus as claimed in claim 36, wherein the printing apparatus moves said transferring tray, on which said recording medium is mounted, in the transferring passage of said printing apparatus with a moving motor of said recording medium; and the printing apparatus has a gap adjusting unit for setting a size of a gap between said printing head and a platen by moving said carriage up and down according to a type of said recording medium; and a convex part, which has a predetermined height, is provided on said carriage; and said convex part contacts with a side face of an edge of said recording medium when said carriage scans in the condition where said recording medium, which has a thickness larger than the thickness of the type of said recording medium set by said gap adjusting unit, is positioned under said main scanning line.

38. A printing apparatus as claimed in claim 36, wherein said motor driving control unit stops the operation of driving said motor when said judging unit judges said recording medium has a problem.

39. A printing apparatus as claimed in claim 36, further comprising:

a screen display unit that can rewrite information, which is to be displayed on a screen by a display control unit; and said display control unit controls said screen display unit such that said screen display unit displays information for suggesting resetting said gap adjusting unit to the size of said gap that is adjusted to said recording medium mounted in the printer when said judging unit judges said recording medium has a problem.

40. A printing apparatus comprising:

the transferring tray according to claim 14; and a detecting unit detecting the recording medium that is moved by the transferring unit, wherein the transferring tray further comprises:

a tray body having a rectangular plate shape and which is made of a material which is not detected by said detecting unit, the tray body having a first major surface and a second major surface;

a detected portion formed on either of the first and the second major surfaces of the tray body, which is detected by the detecting unit; and a mounting portion having a mounting recess such that one of the first and the second major surfaces of the recording medium and one of the first and the second major surfaces of the tray body are substantially co-planar when the recording medium is mounted on the transferring tray.

41. A printing apparatus as claimed in claim 40, wherein the tray body of the transferring tray includes a plurality of long grooves defining a plurality of convex portions and a plurality of concave portions all arranged parallel to the sub scanning direction, and wherein those of the plural convex portions located on the first of the major surfaces forms the respective plural concave portions on the second of the major surfaces, and those of the plural convex portions located on the second of the major surfaces forms the respective plural concave portions on the first of the major surfaces.

42. A printing apparatus as claimed in claim 40, wherein the transferring unit includes a driving roller and a following roller, and wherein a thickness of a starting portion and an end portion of the tray body decreases toward a tip end of the tray body.

43. A printing apparatus as claimed in claim 40, wherein the tray body has a hole in the mounting recess, the hole being smaller than the mounting recess, and at least a portion of the recording medium is exposed through the hole.

44. A printing apparatus as claimed in claim 40, wherein said plate is made of a material that has a black color.

45. A printing apparatus as claimed in claim 40, wherein said plate is made from a single piece of integrally-molded plastic.

* * * * *